US012716183B2

(12) United States Patent
Yuan et al.

(10) Patent No.: US 12,716,183 B2
(45) Date of Patent: Aug. 25, 2026

(54) SNOW THROWER AND STEERING METHOD THEREOF

(71) Applicant: Greenworks (Jiangsu) Co., Ltd., Changzhou (CN)

(72) Inventors: Hongde Yuan, Changzhou (CN); Yu Wang, Changzhou (CN); Xiaohui Huo, Changzhou (CN); Shuhua Li, Changzhou (CN); Haiyun Ding, Changzhou (CN)

(73) Assignee: Greenworks (Jiangsu) Co., Ltd., Changzhou (CN)

( * ) Notice: Subject to any disclaimer, the term of this patent is extended or adjusted under 35 U.S.C. 154(b) by 405 days.

(21) Appl. No.: 18/474,243

(22) Filed: Sep. 26, 2023

(65) Prior Publication Data

US 2024/0011232 A1 Jan. 11, 2024

Related U.S. Application Data

(63) Continuation of application No. PCT/CN2022/085263, filed on Apr. 6, 2022.

(30) Foreign Application Priority Data

Apr. 6, 2021 (CN) ..... 202120693849.7
Jun. 10, 2021 (CN) ..... 202110648432.3
(Continued)

(51) Int. Cl.
*E01H 5/09* (2006.01)

(52) U.S. Cl.
CPC ..... *E01H 5/098* (2013.01)

(58) Field of Classification Search
CPC ..... E01H 5/098
See application file for complete search history.

(56) References Cited

U.S. PATENT DOCUMENTS 6,944,979 B2 * 9/2005 Hanafusa ..... E01H 5/04 37/260
10,214,869 B1 * 2/2019 Krajewski ..... E01H 5/09
(Continued)

FOREIGN PATENT DOCUMENTS

CN 104805795 A * 7/2015 ..... E01H 5/098
CN 105421278 A 3/2016
(Continued)

*Primary Examiner* — Matthew R Buck

(57) ABSTRACT

The disclosure provides a snow thrower and a steering method thereof. The snow thrower includes a chassis, a wheel assembly, a working assembly, a power assembly and a battery assembly. The wheel assembly is connected with the chassis and includes wheels arranged at both sides of the chassis. The working assembly is connected with the chassis and includes an auger assembly and an impeller assembly. The auger assembly includes an auger and a auger housing at least partially accommodating the auger. The impeller assembly includes an impeller and an impeller housing at least partially accommodating the impeller. The power assembly includes a motor and is connected with the working assembly to drive the working assembly to work. The battery assembly is connected with the power assembly and the wheel assembly, and the battery assembly includes at least one battery.

19 Claims, 49 Drawing Sheets

(30) Foreign Application Priority Data

| | | |
|---|---|---|
| Jun. 10, 2021 | (CN) | 202110648433.8 |
| Jun. 10, 2021 | (CN) | 202110648435.7 |
| Jun. 10, 2021 | (CN) | 202110650005.9 |
| Jun. 10, 2021 | (CN) | 202110650011.4 |
| Jun. 10, 2021 | (CN) | 202110650012.9 |
| Jun. 10, 2021 | (CN) | 202121300922.6 |
| Jun. 10, 2021 | (CN) | 202121301363.3 |
| Jun. 10, 2021 | (CN) | 202121301632.3 |
| Jun. 10, 2021 | (CN) | 202121301633.8 |
| Jun. 10, 2021 | (CN) | 202121303266.5 |
| Jun. 10, 2021 | (CN) | 202121304255.9 |
| Jun. 10, 2021 | (CN) | 202121305509.9 |
| Jun. 10, 2021 | (CN) | 202121305535.1 |
| Jun. 10, 2021 | (CN) | 202121305943.7 |
| Jun. 10, 2021 | (CN) | 202121306043.4 |
| Jun. 10, 2021 | (CN) | 202121306078.8 |
| Jun. 10, 2021 | (CN) | 202121306134.8 |
| Nov. 12, 2021 | (CN) | 202122779777.0 |
| Feb. 14, 2022 | (CN) | 202220297171.5 |

(56) References Cited

U.S. PATENT DOCUMENTS

| | | | | |
|---|---|---|---|---|
| 2005/0088123 | A1* | 4/2005 | Wakitani | B62D 11/003 318/67 |
| 2011/0094129 | A1* | 4/2011 | Rowe | E01H 5/045 37/246 |
| 2014/0202047 | A1* | 7/2014 | Kawakami | E01H 5/098 37/257 |
| 2017/0101756 | A1* | 4/2017 | Zhang | B60K 1/00 |
| 2021/0040701 | A1* | 2/2021 | Yamaoka | H02K 11/0094 |
| 2021/0095433 | A1 | 4/2021 | Landry et al. | |
| 2022/0098811 | A1* | 3/2022 | Bonney | E01H 5/098 |

FOREIGN PATENT DOCUMENTS

| | | | |
|---|---|---|---|
| CN | 209560387 | U | 10/2019 |
| CN | 210162184 | U | 3/2020 |
| CN | 111719485 | A | 9/2020 |
| CN | 112176932 | A | 1/2021 |
| CN | 112796267 | A | 5/2021 |
| CN | 113322878 | A | 8/2021 |
| CN | 113322879 | A | 8/2021 |
| CN | 113338212 | A | 9/2021 |
| CN | 113338213 | A | 9/2021 |
| CN | 215052590 | U | 12/2021 |
| CN | 215052592 | U | 12/2021 |
| CN | 215165162 | U | 12/2021 |
| CN | 215405842 | U | 1/2022 |
| CN | 215405843 | U | 1/2022 |
| CN | 215405844 | U | 1/2022 |
| CN | 215405845 | U | 1/2022 |
| CN | 215441711 | U | 1/2022 |
| CN | 215482673 | U | 1/2022 |
| CN | 215948050 | U | 3/2022 |
| EP | 2080835 | A2 | 7/2009 |
| FR | 2523168 | A1 | 9/1983 |
| KZ | 30807 | A4 | 12/2025 |
| RU | 37732 | U1 | 5/2004 |

* cited by examiner

SNOW THROWER AND STEERING METHOD THEREOF

CROSS REFERENCE TO RELATED APPLICATION

The present application is a continuation of PCT application No. PCT/CN2022/085263 filed on Apr. 6, 2022, which claims the benefit of CN202110650005.9 filed on Jun. 10, 2021, CN202120693849.7 filed on Apr. 6, 2021, CN202121306134.8 filed on Jun. 10, 2021, CN202121301632.3.X filed on Jun. 10, 2021, CN202121300922.6 filed on Jun. 10, 2021, CN202121301633.8 filed on Jun. 10, 2021, CN202121303266.5 filed on Jun. 10, 2021, CN202121301363.0 filed on Jun. 10, 2021, CN202121306043.4 filed on Jun. 10, 2021, CN202121306078.8 filed on Jun. 10, 2021, CN202121305943.7 filed on Jun. 10, 2021, CN202110650012.9 filed on Jun. 10, 2021, CN202110648432.3 filed on Jun. 10, 2021, CN202121304255.9 filed on Jun. 10, 2021, CN202110648435.7 filed on Jun. 10, 2021, CN202122779777.0 filed on Nov. 12, 2021, CN202121305509.9 filed on Jun. 10, 2021, CN202110650011.4 filed on Jun. 10, 2021, CN202110648433.8 filed on Jun. 10, 2021, CN202121305535.1 filed on Jun. 10, 2021, CN202220297171.5 filed on Feb. 14, 2022. All the above are hereby incorporated by reference.

TECHNICAL FIELD

The disclosure belongs to the technical field of the outdoor tools, particularly to a snow thrower and a steering method thereof.

BACKGROUND

Snow throwers are a kind of tool that may effectively remove snow in winter and save time and effort. Especially in some alpine regions, an effective use of snow throwers may greatly reduce manpower and improve efficiency.

Currently, most of the snow throwers on the market are powered by an engine, which are not environmentally friendly and have a lot of noise. An operation of these snow throwers is inconvenient, and wear between components is relatively large. Furthermore, most of the snow throwers that use lithium batteries are hand push snow throwers with low power. A snow removal efficiency is not very high, and a thickness of snow removal is limited. The conventional snow throwers also have a problem of unstable traveling, especially when encountering obstacles or places with large ups and downs, problems such as inclining and overturning are prone to occur, which causes the snow throwers to be damaged and cannot be used. In addition, the snow thrower needs to drive the traveling wheel to rotate through a complex deceleration structure, which occupies a large space and increases a volume of the snow thrower. Currently, the snow thrower further includes a complex transmission structure, and a transmission mode causes parts being easy to wear and reduces a duration life of the snow thrower.

SUMMARY

The disclosure provides a snow thrower and a steering method thereof. With the snow thrower and the steering method thereof of the disclosure, performances of the snow thrower may be improved and cost may be reduced.

The disclosure provides a snow thrower. The snow thrower includes a chassis, a wheel assembly, a working assembly, a power assembly and a battery assembly. The wheel assembly is coupled to the chassis and configured to support the snow thrower to enable the snow thrower to walk on a surface. The wheel assembly includes wheels arranged at both sides of the chassis. The working assembly is coupled to the chassis and includes an auger assembly and an impeller assembly. The auger assembly includes an auger and an auger housing at least partially accommodating the auger. The impeller assembly includes an impeller and an impeller housing at least partially accommodating the impeller. The power assembly includes a motor and the motor is coupled to impeller housing and configured to drive the working assembly to work. The battery assembly is configured to supply power to the power assembly and the wheel assembly, and the battery assembly includes at least one battery.

Optionally, the snow thrower further includes a first rotation shaft and a second rotation shaft. The first rotation shaft is connected with the auger housing, and the auger is connected on the first rotation shaft. The second rotation shaft is connected with the first rotation shaft, and the impeller is connected on the second rotation shaft.

Optionally, a movement gap is between the impeller and an inner side wall of the impeller housing, and the movement gap gradually increases along a rotation direction of the impeller.

Optionally, the motor is mounted on an upper portion of the impeller housing, and an output shaft of the motor is oriented facing the rear of the snow thrower.

Optionally, a center of gravity of the battery assembly is located on a central axis in a forward direction of the snow thrower.

Optionally, the wheel assembly further includes a wheel hub motor and a fixed part. An output shaft of the wheel hub motor is connected with the chassis, and the wheel is coupled to the wheel hub motor. The fixed part is arranged on the chassis, and the fixed part is connected with the output shaft.

Optionally, at least two wheel hub motors are provided, and each of the wheel hub motors is independently controlled.

Optionally, the snow thrower further includes a control board assembly. The control board assembly is fixed in the chassis, and configured to control the battery assembly, the power assembly and the wheel assembly.

Optionally, the snow thrower further includes a fan. The fan is connected with the second rotation shaft, and the fan is located in the chassis.

Optionally, the chassis includes a connecting surface, a fixed component and a main housing. The connecting surface is connected with the working assembly. The fixed component is connected with the working assembly and defines a gap with the connecting surface. The main housing is clamped in the gap and connected with the connecting surface and the fixed component.

Optionally, the snow thrower further includes a control assembly. The control assembly includes an operation console, a first speed adjustment lever and a second speed adjustment lever. The first speed adjustment lever is used to adjust a traveling speed and/or traveling direction of the wheel assembly and arranged on the operation console. The second speed adjustment lever is used to adjust a running speed of the working assembly and arranged on the operation console. Wherein, the first speed adjustment lever is arranged at a first angle with a first direction, the second speed adjustment lever is arranged at a second angle with a first direction, and the first direction is a direction parallel to a rotation axis of the wheel assembly.

Optionally, the control assembly includes a first trigger, a linkage shaft, a second trigger and an interlocking structure. The first trigger is used to realize a first function. The linkage shaft is connected with the first trigger. The second trigger is rotatably connected with the linkage shaft to realize a second function. The interlocking structure is arranged on the linkage shaft and connected with the second trigger.

Optionally, a display light is arranged on the operation console, and the display light comprises a flexible light bar.

Optionally, the snow thrower further includes a chute control assembly. The chute control assembly includes a chute, a rotation component, a connecting shaft, a second gear, a first gear and a rocking trigger. One end of the rotation component is connected with the chute. The connecting shaft is connected with the rotation component. The second gear is connected with the connecting shaft to drive the connecting shaft to rotate. The first gear is meshed with the second gear. One end of the rocking trigger is connected with the first gear, and the other end of the rocking trigger extends to an operation end of the snow thrower.

Optionally, the snow thrower further includes an adjustment device. The adjustment device at least includes an operation part, a connecting assembly, a first connecting rod and a second connecting rod. One end of the connecting assembly is connected with one end of the operation part. One end of the first connecting rod is rotatably connected with the connecting assembly. One end of the second connecting rod is rotatably connected with the first connecting rod.

Optionally, the snow thrower further includes a worm gear and a worm gear housing. The worm gear is sleeved on the first rotation shaft, and the second rotation shaft is meshed with the worm gear. The worm gear housing is provided with a first penetrating hole and a second penetrating hole. The worm gear is located in the first penetrating hole. One end of the second rotation shaft is located in the second penetrating hole, and the worm gear is meshed to the second rotation shaft in the worm gear housing.

Optionally, the motor is connected with the working assembly through a transmission assembly. The transmission assembly includes a first transmission wheel, a second transmission wheel, and a belt or a chain. The first transmission wheel is arranged on an output shaft of the motor. The second transmission wheel is connected with the second rotation shaft to drive the second rotation shaft to rotate. The belt or the chain is used to connect the first transmission wheel with the second transmission wheel.

Optionally, the snow thrower further includes a tensioning structure to tension the belt. The tensioning structure includes a mounting plate, a tensioning plate, a tensioning wheel, a first tensioning spring, a ratchet wheel, a ratchet pawl, and a second tensioning spring. The mounting plate is connected with the impeller housing. The tensioning plate is connected on the mounting plate. The tensioning wheel is arranged on the tensioning plate. One end of the first tensioning spring is connected with the tensioning plate, and the other end of the first tensioning spring is connected with a fixed base of the motor. The ratchet wheel is arranged on the tensioning plate. The ratchet pawl is arranged on the mounting plate. The second tensioning spring is arranged on the mounting plate. One end of the ratchet pawl is matched with the ratchet wheel, and the other end of the ratchet pawl is connected with the second tensioning spring.

Optionally, the motor is connected with the working assembly through a transmission assembly, and the transmission assembly includes a transmission housing and a sprocket assembly. The sprocket assembly is mounted inside the transmission housing, and integral with the transmission housing. The sprocket assembly includes a driving sprocket, a driven sprocket and a chain. The driving sprocket is rotatably mounted with one end inside the transmission housing and connected with the power assembly. The driven sprocket is rotatably mounted with the other end inside the transmission housing. The chain is mounted around an outside of the driving sprocket and the driven sprocket and the chain is meshed with the driving sprocket and the driven sprocket. The driving sprocket is in a transmission connection with the driven sprocket through the chain.

The disclosure further provides a steering method of the snow thrower. The snow thrower includes a chassis and a wheel assembly connected with the chassis. The wheel assembly includes a first wheel and a second wheel. The steering method includes: obtaining a current traveling speed of the snow thrower; sending a steering signal to the wheel assembly; comparing the current traveling speed of the snow thrower with a preset steering speed; and controlling the first wheel to rotate in a direction opposite to the traveling direction, and controlling the second wheel to decelerate to the preset steering speed if the current traveling speed of the snow thrower is greater than the preset steering speed, and enabling a final speed of the first wheel to be equal to the preset steering speed.

With the snow thrower and its steering method of the disclosure as described above, through using belts or chains for connection, a wear between components is reduced, there is no transmission gap, and the cost is low. Through arranging the motor and a chute base on the impeller housing at the same time, a larger accommodating space is provided for a battery cavity and the battery. Through setting the chute control assembly, a snow blowing direction of the snow thrower may be adjusted. Through arranging the rocking trigger and the transmission structure, the snow blowing direction of the impeller housing may be controlled simply and directly. With the snow thrower provided by the disclosure, a snow removal is more flexible and convenient, and the cost is reduced.

Of course, it is not necessary for any product of the disclosure to achieve all of the above-described advantages simultaneously.

BRIEF DESCRIPTION OF THE DRAWINGS

In order to explain the technical solutions of the embodiments of the disclosure more clearly, the following will briefly introduce the drawings used in the description of the embodiments. Obviously, the drawings in the following description are only some embodiments of the disclosure. For those of ordinary skill in the art, other drawings can be obtained from these drawings without creative work.

FIG. 119 is a flowchart of operation S5 of the disclosure according to an embodiment.

FIG. 120 is a flowchart of a fourth control board controlling a first wheel hub motor and a second wheel hub motor of the disclosure according to an embodiment.

FIG. 121 is a schematic view of a traveling direction of the snow thrower of the disclosure according to an embodiment.

FIG. 122 is a schematic view of steering directions of a first wheel and a second wheel of the disclosure according to an embodiment.

FIG. 123 is a schematic view of a steering of the snow thrower of the disclosure according to an embodiment.

DETAILED DESCRIPTION

The technical solutions in the embodiments of the disclosure will be clearly and completely described below with reference to the accompanying figures in the embodiments of the disclosure. Obviously, the described embodiments are only some, but not all embodiments of the disclosure. Based on the embodiments of the disclosure, all other embodiments obtained by those of ordinary skill in the art without creative efforts shall fall within the scope of the disclosure.

Figure 1:
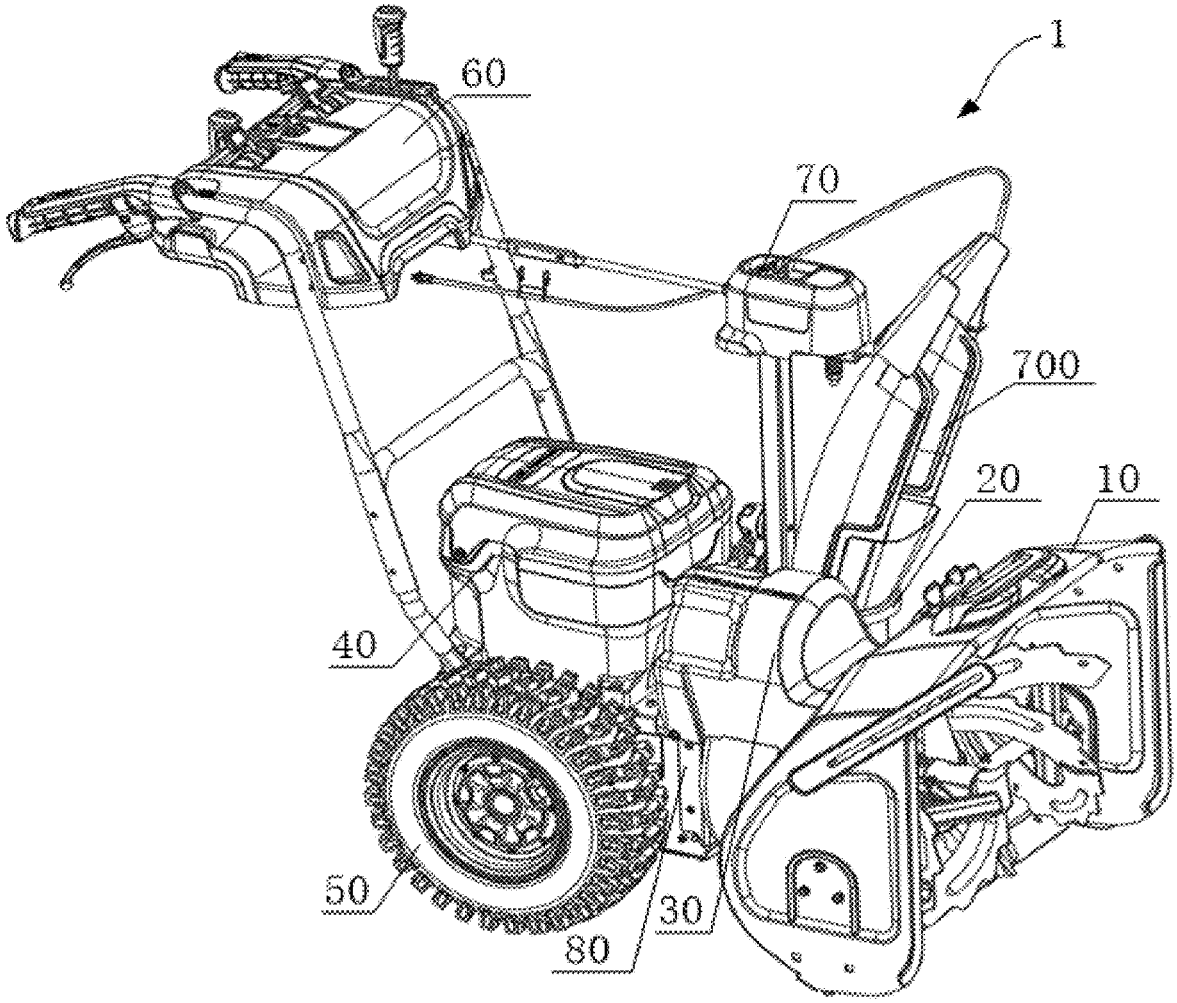
FIG. 1 is a perspective view of a snow thrower according to an embodiment.
Figure 8:
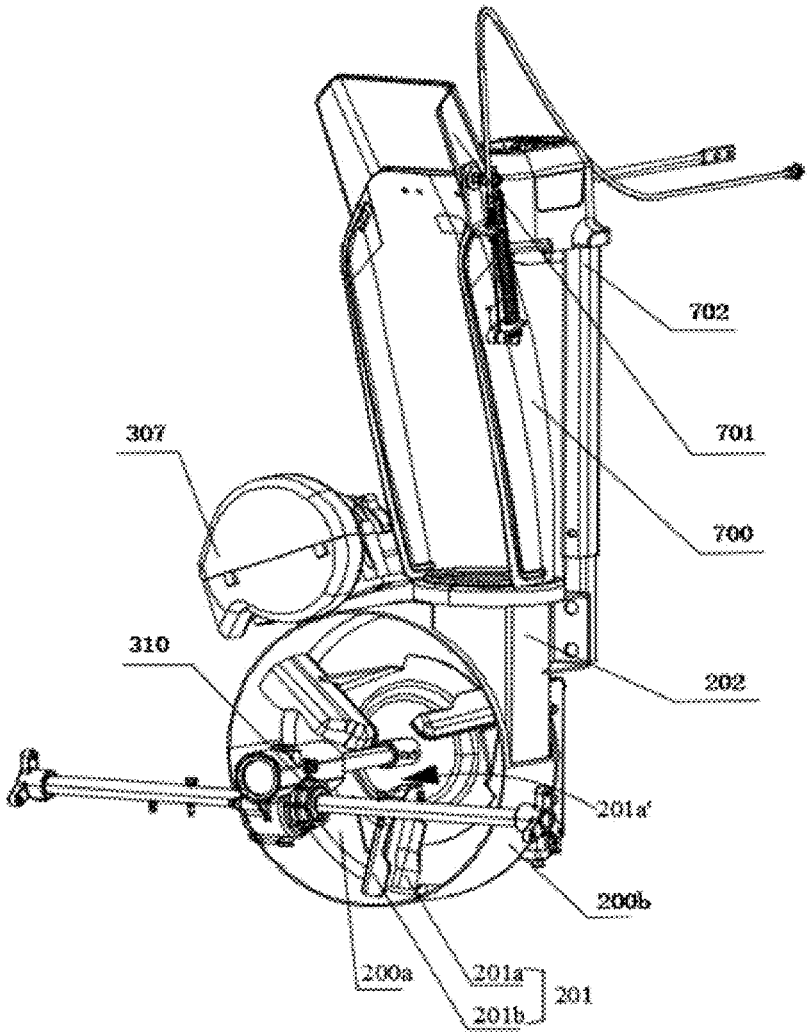
FIG. 8 is a schematic perspective view of an impeller assembly according to an embodiment.
Figure 9:
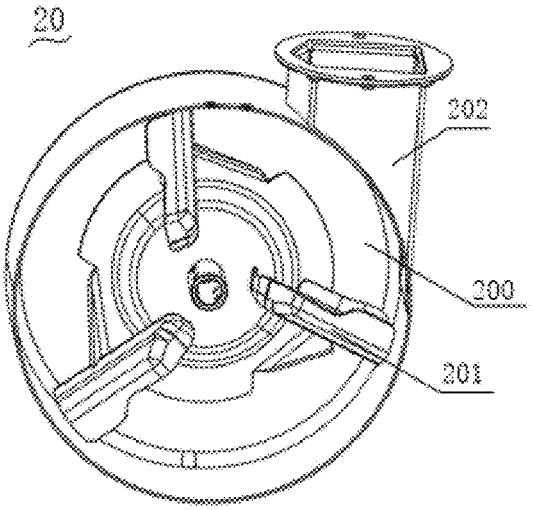
FIG. 9 is a schematic perspective view of an impeller housing according to an embodiment.
Figure 10:
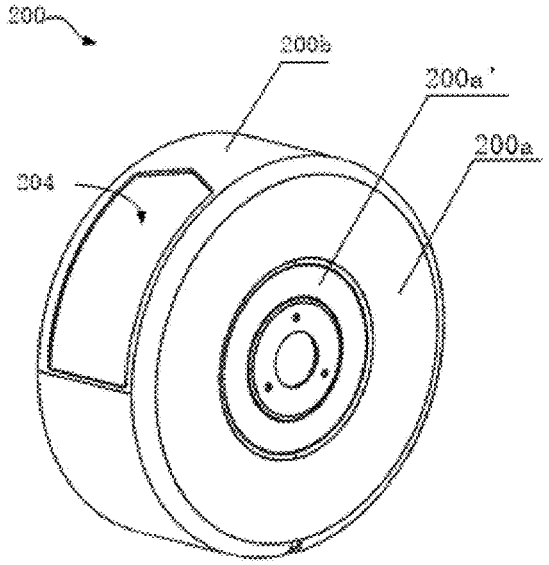
FIG. 10 is a perspective view of a middle housing according to an embodiment.
Figure 11:
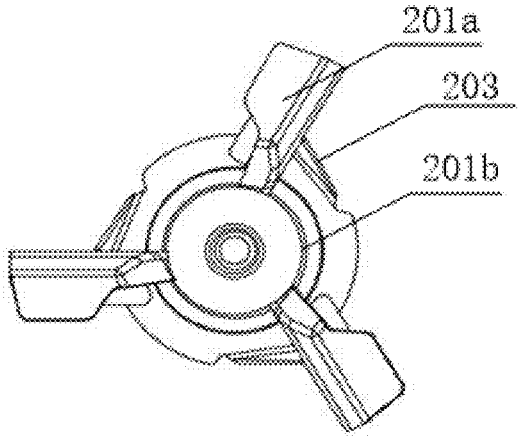
FIG. 11 is a schematic perspective view of an impeller according to an embodiment.

Please refer to FIG. 1 and FIG. 8. The disclosure provides a snow thrower. The snow thrower includes an auger assembly 10, an impeller assembly 20, a power assembly 30, a battery assembly 40, a wheel assembly 50, a control assembly 60 and a chute control assembly 70. Wherein, the auger assembly 10 and the impeller assembly 20 are a working assembly of the snow thrower 1. The auger assembly 10 collects snow on ground into a first accommodating space, and twists the snow into the impeller assembly 20 through an auger 101. An impeller 201 in the impeller assembly 20 throws the snow from the impeller housing 200 through rotation. Wherein, the power assembly 30 is connected with the auger assembly 10 and the impeller assembly 20 to drive the auger 101 and the impeller 201 to rotate. The battery assembly 40 is connected with the power assembly 30, the wheel assembly 50 and the control assembly 60 to supply power to all electrical components in the snow thrower 1. As used herein, the term "battery" or "battery assembly" encompasses the use of one or more batteries to power one or more components of an item of the snow thrower. The wheel assembly 50 is connected with the battery assembly 40 and the control assembly 60 for driving the snow thrower 1 to travel. The control assembly 60 is an operation end of the snow thrower 1. The chute control assembly 70 is used to adjust a snow blowing direction. The snow thrower 1 further includes a chassis 80, the battery assembly 40 is arranged on the chassis 80, and the wheel assembly 50 is fixed on both sides of the chassis 80.

Please refer to FIG. 1, FIG. 2, FIG. 4 and FIG. 10. In an embodiment of the disclosure, the auger assembly 10 includes the auger 101, an auger housing 100 and a snow shovel 102. The auger housing 100 is arranged at an end of a working surface of the snow thrower 1, and the auger housing 100 includes an arc surface 100*c* and two side surfaces. The arc surface 100*c* covers an upper side of the auger 101 and an opposite side of the working surface of the auger 101. The side surface includes a first side surface 100*a* and a second side surface 100*b*. The first side surface 100*a* and the second side surface 100*b* are perpendicular to a horizontal plane. The arc surface 100*c* and the two side surfaces define a first accommodating space for accommodating the auger 101 and the snow collected by the auger 101. The first accommodating space is connected with a second accommodating space, and the collected snow is thrown from an impeller housing 200.

Figure 4:
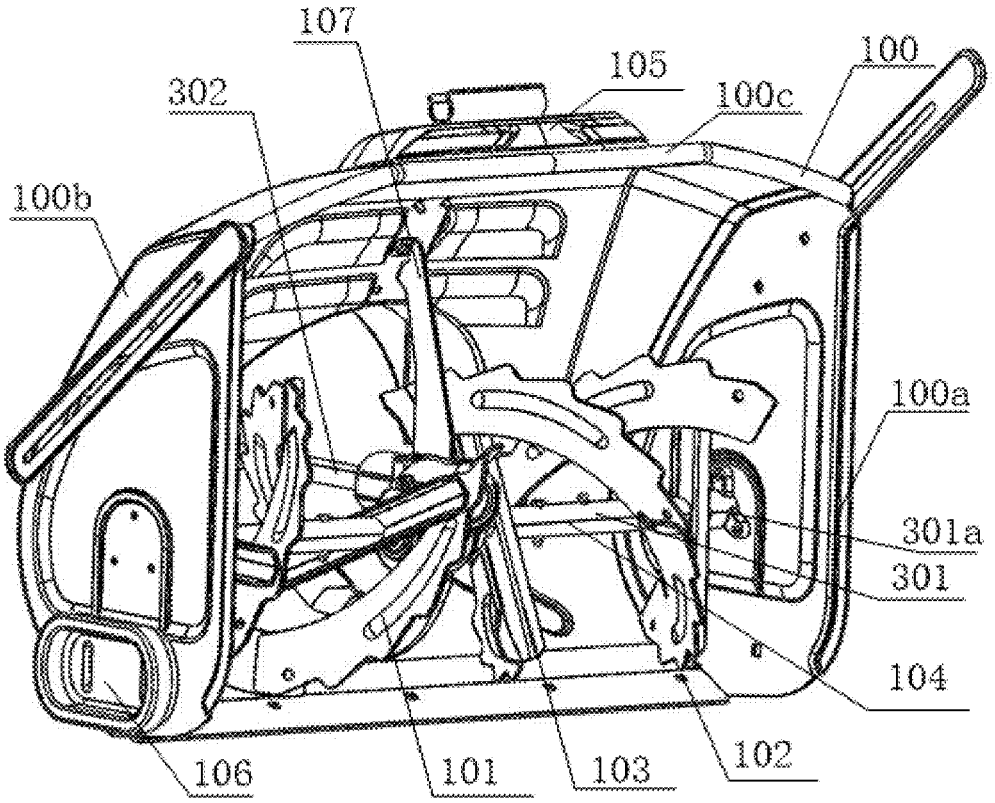
FIG. 4 is a perspective view of an auger assembly according to an embodiment.
Figure 5:
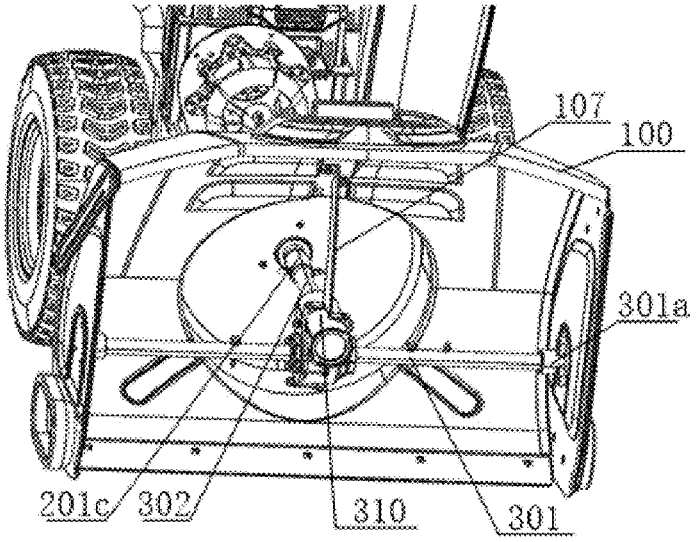
FIG. 5 is an internal perspective view of an auger housing according to an embodiment.
Figure 6:
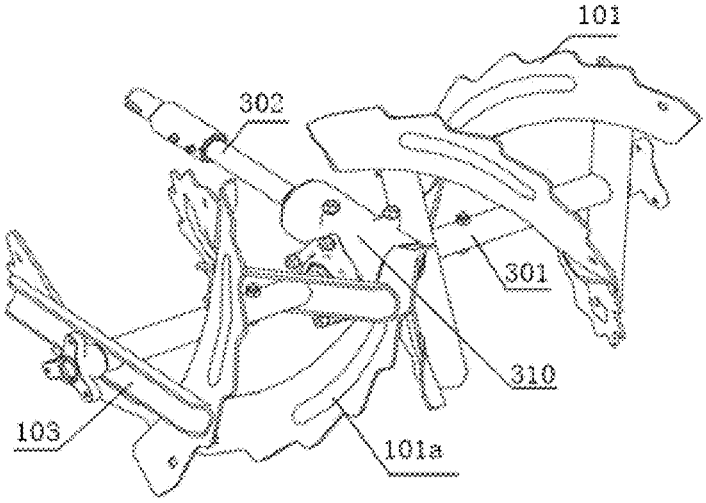
FIG. 6 is a schematic perspective view of an auger according to an embodiment.
Figure 7:
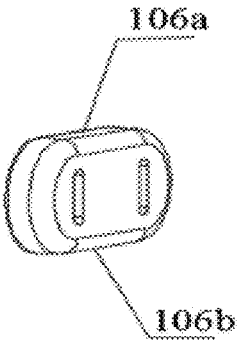
FIG. 7 is a schematic perspective view of a foot in the auger assembly according to an embodiment.

Further, please refer to FIG. 4 through FIG. 6. The auger 101 is arranged on a first rotation shaft 301. The first rotation shaft 301 is arranged in the first accommodating space of the auger housing 100 and is laterally arranged between the first side surface 100*a* and the second side surface 100*b*. The first rotation shaft 301 is parallel to the horizontal plane, and is fixed on the first side surface 100*a* and the second side surface 100*b* through an auger shaft base 301*a*. When the first rotation shaft 301 rotates, the auger 101 arranged on it rotates with a rotation of the first rotation shaft 301, thereby collecting the snow on the ground and enabling the snow enter the first accommodating space of the auger housing 100. In some embodiments, the auger 101 includes a plurality of auger blades, such as from 4 to 8, for example 4. A range of a diameter of the auger blade is, for example, from 250 mm to 320 mm, such as 274 mm. A range of a rotation speed of the auger is, for example, from 100 rmp to 150 rmp, such as 120 rmp. A range of a length of a single side of the auger 101 is, for example, from 250 mm to 300 mm, such as 271 mm. The auger blades of the auger 101 are arranged with a gap between each other, so that the auger 101 may define a helical structure. A helix angle of the helical structure is from 10 degrees to 80 degrees, for example, 30 degrees. A gap distance between the plurality of auger blades is from 2 mm to 50 mm, for example, 20 mm. There is a gap which is from 2 mm to 10 mm between the auger blade and the auger housing 100. The auger blade further has a gap which is from 5 mm to 30 mm between its free end and the ground, so that a high-speed rotation space may be defined when the auger blade rotates, which will not cause wear among the auger blades. In order to further enhance a strength of the blade, the auger blade is further provided with an arc-shaped groove 101*a* matched with an arc shape thereof. A depth of the arc-shaped groove 101*a* is from 2 mm to 5 mm, for example, 2 mm. For quickly removing and shoveling the snow, an end surface of the auger blade is provided with saw teeth.

Further, please refer to FIG. 4 through FIG. 6. The auger assembly 10 further includes a plurality of central tubes 104 and a plurality of auger supporting plates 103. The central tube 104 is fixed on the first rotation shaft 301 and covers the first rotation shaft 301 for protecting the first rotation shaft 301. For example, the number of the central tubes 104 is 2, which are located on both sides of a connection position between the first rotation shaft 301 and the second rotation shaft 302 respectively. The auger assembly 10 further includes the auger supporting plate 103. A midpoint of the auger supporting plate 103 is fixed on the first rotation shaft 301 or/and the central tube 104. Both ends of the auger supporting plate 103 are fixed with a blade of the auger. The number of auger supporting plates 103 is, for example, 4. Both ends of each two blades of the auger are fixed with the auger supporting plate 103.

Further, please refer to FIG. 4. The snow shovel 102 is arranged on a side of the arc surface 100*c* of the auger housing 100 close to the ground. When the snow thrower 1 is working, the snow shovel 102 is used to shovel the snow on the ground.

Further, please refer to FIG. 4. The auger housing 100 is further provided with a plurality of first lights 105. The first light 105 is mounted on a top of the arc surface 100*c* of the auger housing 100 and is located above the auger 101. The first light 105 is connected with the battery assembly 40. The first light 105 is used in a snow removal in a dark environment.

Please refer to FIG. 2, FIG. 4 through FIG. 7. The auger assembly further includes a foot 106. The foot 106 is connected with the auger housing 100. For example, there are two sets of feet 106, which are respectively connected with the first side surface 100*a* and the second side surface 100*b* to support the auger assembly 10. The foot 106 includes a first supporting surface 106*a* and a second supporting surface 106*b* arranged opposite to each other, so that when the first supporting surface 106*a* is worn, the foot 106 may be rotated to enable the second supporting surface 106*b* to contact the ground to support the auger assembly 10.

Please refer to FIG. 2 through FIG. 4, FIG. 8 through FIG. 23. The impeller assembly includes the impeller 201, the impeller housing 200 and a chute base 202. A side wall of the impeller housing 200 is provided with an opening. A bottom wall of the impeller housing 200 is provided with a through hole, the through hole is located in a center of the bottom wall, allows the second rotation shaft 302 to pass through and rotate in the through hole. At the same time, a circumference of the through hole defines a first concave area 200*a*', so that a strength of the impeller housing 200 may be enhanced. A side wall and a bottom wall of the impeller housing 200 are vertically arranged. When mounting the impeller housing 200, the side wall of the impeller housing 200 is connected with the auger housing 100 to define the second accommodating space, and the other side of the impeller housing 200 is connected with the chassis 80. The second accommodating space defined by the impeller housing 200 is connected with the first accommodating space. The snow collected by the auger 101 is squeezed into the second accommodating space by the auger 101. In an embodiment of the disclosure, the impeller housing 200 may be integrally formed with the auger housing 100, and a side of the impeller housing 200 is seamlessly connected with the arc surface 100*c*. A side wall of the impeller housing 200 is provided with a first opening 204. The first opening 204 is arranged on a side of the side wall of the impeller housing 200 for connecting the chute base 202.

Please refer to FIG. 1, FIG. 8 through FIG. 10. In an embodiment of the disclosure, the impeller housing 200 includes a middle housing 200*b* and a rear housing 200*a*. The middle housing 200*b* is the side wall of the impeller housing 200, and the rear housing 200*a* is a bottom wall of the impeller housing 200. The middle housing 200*b* is a cylindrical structure with two open ends, and is mounted to the chassis 80. An end opening of the middle housing 200*b* is sealed by the rear housing 200*a*. The rear housing 200*a* is a cover-shaped structure with a circular bottom surface, and is provided with a through hole for the second rotation shaft 302 to pass through. The first concave area 200*a*' is defined on a circumference of the through opening, so that a strength of the impeller housing 200 may be enhanced. At the same time, it is convenient to position a rotation shaft of the power assembly 30 of the snow thrower and the impeller 201. The rear housing 200*a* and the middle housing 200*b* are enclosed to define a second accommodating space with one end open. The second accommodating space is connected with the first accommodating space of the auger assembly 10 of the snow thrower, so that the snow collected by the auger assembly 10 may be thrown from the first accommodating space to the second accommodating space. A cylindrical surface of the middle housing 200*b* is provided with the first opening 204 that communicates with the chute base 202, so as to further throw the snow in the second accommodating space outward. A cylinder height of the cylindrical structure of the middle housing 200*b* is from 5 cm to 50 cm, for example, 20 cm, so as to ensure a depth of the second accommodating space. Further, a diameter of the cylinder is from 20 cm to 70 cm, such as 40 cm, 50 cm. Within a height and diameter range mentioned above, a snow collection capacity of the second accommodating space may be effectively guaranteed.

Please refer to FIG. 8 through FIG. 12. In an embodiment of the disclosure, the impeller 201 is located in the second accommodating space. The impeller 201 includes an impeller base 201*b* and an impeller blade 201*a*. A plurality of impeller blades 201*a* are welded together with the impeller base 201*b*. The impeller base 201*b* is circular. The impeller blades 201*a* are substantially evenly distributed on an outer circumference of the impeller base of the impeller 201. In some embodiments, the impeller blade 201*a* has a predetermined distance from a center of the impeller base 201*b*, and the impeller blade 201*a* on a side close to the center of the impeller base 201*b* has a lower height, so that the center of the impeller base 201*b* defines a second concave area 201*a*'. When the impeller 201 rotates at a high speed along with the second rotation shaft 302, the second concave area 201*a*' defines a vacuum low pressure area, and defines a pressure difference with a pressure of an external high pressure area, which can actively suck the external snow into the impeller housing 200 more and faster and enhances a kinetic energy of the snow throwing structure of the snow thrower, so that the snow in the first accommodating space close to an inlet of the impeller housing 200 is sucked into the impeller housing 200. A center of the impeller base 201*b* is fixed on the second rotation shaft 302, and the impeller base 201*b* is perpendicular to the second rotation shaft 302.

Please refer to FIG. 5, FIG. 8 through FIG. 12. In this embodiment, the impeller 201 includes at least one impeller blade 201*a*, such as 3 to 6 blades, for example, 3 blades. These impeller blades 201*a* are substantially evenly distributed in the second accommodating space, for example, arranged inside the rear housing 200*a*. The blade 201*a* is connected with the impeller base 201*b*, and the impeller base 201*b* is fixed on the second rotation shaft 302 of the power assembly 30. In other embodiments, the blade 201*a* is directly fixed on the second rotation shaft 302. Further, the impeller blade 201*a* may be welded and fixed with a central tube 201*c* sleeved on the second rotation shaft 302. The impeller 201 rotates with a rotation of the second rotation shaft 302, and the impeller blades 201*a* rotate synchronously, so that the snow in the second accommodating space is thrown out through the chute base 202 as described below. In order to ensure a strength of the impeller 201 and a smooth progress of a snow throwing operation, there is a gap which is from 4 mm to 8 mm between the impeller 201 and the cylindrical middle housing 200*b*, and there is also a gap which is from 4 mm to 8 mm between the impeller housing 200 and the cylindrical middle housing 200*b*. In some embodiments, the gap is from 4 mm to 5.5 mm, for example 4.5 mm. In other embodiments, there is a gap of 6.5 mm between the impeller 201 and the cylindrical middle housing 200*b*, so as to avoid a friction with the middle housing 200*b*, and within this range, the snow may flow smoothly, which may withstand greater snow pressure, and easily collect and throw snow with different thicknesses. There is also a certain distance between the impeller 201 and the rear housing 200*a*, and a distance between the impeller 201 and the rear housing 200*a* is, for example, 2 mm to 3 mm. In order to further ensure the strength of the impeller 201 and a smooth snow throwing, the impeller blade 201*a* is a metal blade with a flanging structure to enhance a strength of the impeller blade 201*a*. It should be noted that a length and width of the impeller blade 201*a* are not particularly limited, and these may be selected and adjusted according to a volume and shape of the middle housing 200*b*. For example, the length of the impeller blade 201*a* is from 5 cm to 10 cm, such as 6 cm, and the width of the impeller blade 201*a* is from 3 cm to 5 cm, such as 3 cm. A rotation speed of the impeller 201 is from 1000 rpm to 1250 rpm. In this embodiment, the rotation speed of the impeller 201 is, for example, from 500 rpm to 1500 rpm, and in other embodiments, the rotation speed of the impeller 201 is from 1000 rpm to 1250 rpm.

Please refer to FIG. 8 through FIG. 12. The impeller 201 further includes a plurality of supporting parts 203. The number of the supporting parts 203 is the same as the number of the blades 201*a*. The supporting parts 203 are arranged on an edge of the impeller base 201*b* and are perpendicular to a protruding part of the impeller base 201*b*. The supporting parts 203 are in contact with back surfaces of the blades 201*a* to be engaged with the blades 201*a*. When the blades 201*a* rotate and throw snow, the supporting parts 203 provide a supporting force for the blades 201*a*.

Further, please refer to FIG. 8 through FIG. 13. In an embodiment of the disclosure, the chute base 202 is located on a side of the impeller housing 200 and is connected with the first opening 204 on the side wall of the impeller housing 200. When the impeller 201 rotates with the second rotation shaft 302, the snow in the second accommodating space is thrown from the chute base 202 by the impeller 201. The disclosure does not limit a shape of the impeller housing 200. In this embodiment, the impeller housing 200 is, for example, a cylindrical shape. In other embodiments, the impeller housing 200 is, for example, a prismatic shape.

Please refer to FIG. 8 through FIG. 13. In an embodiment of the disclosure, the chute base 202 may be a cylindrical structure with two ends open, which is vertically fixed on the middle housing 200*b*. One end of the chute base 202 is connected with the first opening 204 on the middle housing 200*b* to communicate with the second accommodating space, and the other end of the chute base 202 is connected with the chute 700 with a deflector 701, so that when the impeller 201 rotates with the second rotation shaft 302, the snow in the second accommodating space is thrown by the impeller 201 through the chute base 202, the chute 700, and the deflector 701. Further, in order to implement the snow throwing operation quickly, effectively and continuously, the chute 700 is located on a tangent line of a centrifugal force in a rotation direction of the impeller 201. A height of the chute 700 is from 10 cm to 100 cm, for example, 50 cm. Within this range, an effectively remote throwing is possible. The impeller 201 may be rotated either clockwise or counterclockwise. Correspondingly, the chute 700 may be set according to the rotation direction of the impeller 201 and requirements of a surrounding environment (throwing the snow to an appropriate position), so as to smoothly throw the snow.

Please refer to FIG. 8 through FIG. 13. In an embodiment of the disclosure, the first opening 204 on the impeller housing 200 is pentagonal. Correspondingly, a second opening 205 is arranged at a part of the chute base 202 connected with the impeller housing 200. A shape of the second opening 205 is adapted to a shape of the first opening 204, which is also pentagonal. The first opening 204 and the second opening 205 with pentagon shapes facilitate a production of the chute base 202 and a connection between the chute base 202 and the impeller housing 200.

Figure 18:
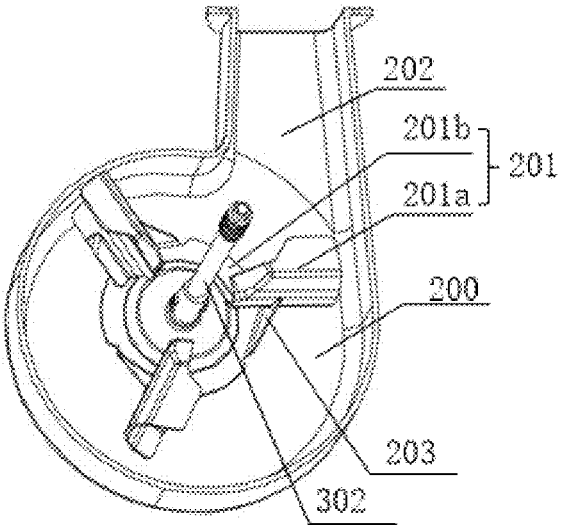
FIG. 18 is a perspective view of the snow throwing structure of the snow thrower according to an embodiment.
Figure 19:
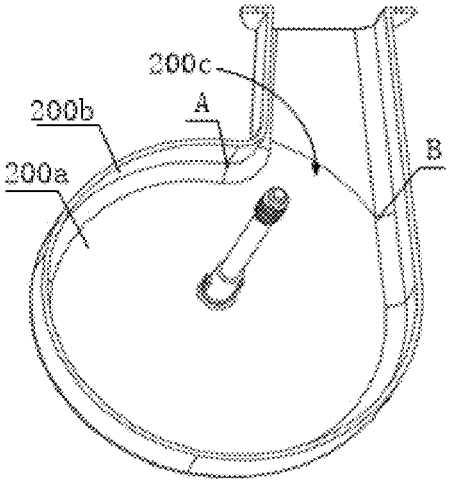
FIG. 19 is a perspective view of the impeller housing according to an embodiment.
Figure 20:
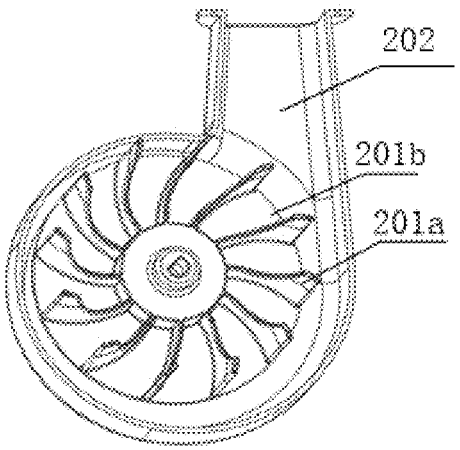
FIG. 20 is a perspective view of another snow throwing structure of the snow thrower according to an embodiment.
Figure 21:
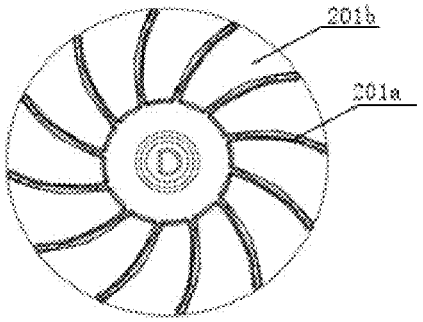
FIG. 21 is a front view of another impeller according to an embodiment.
Figure 22:
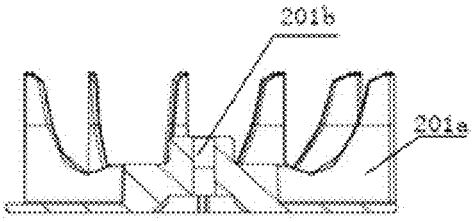
FIG. 22 is a side view of another impeller according to an embodiment.
Figure 23:
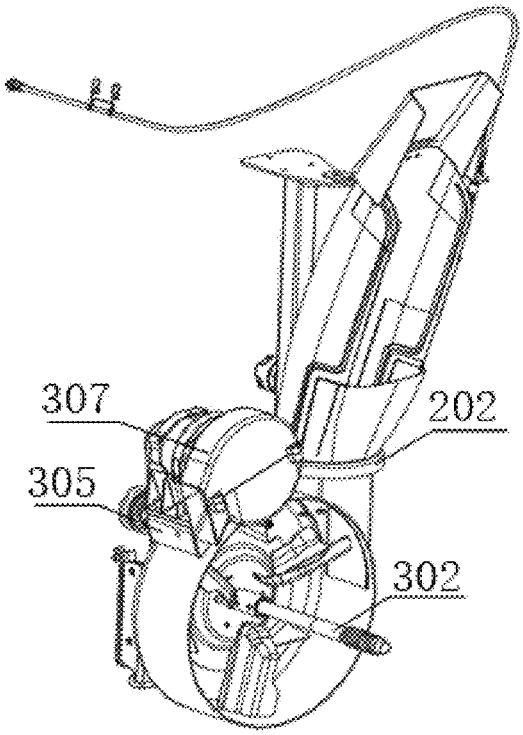
FIG. 23 is a perspective view of the impeller assembly according to an embodiment.
Figure 24:
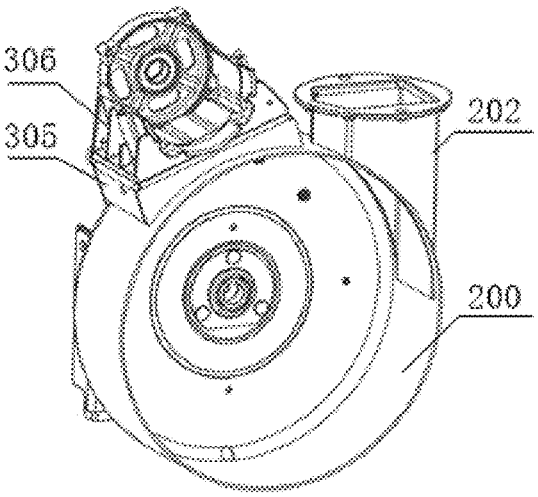
FIG. 24 is a perspective view of a fixed base and a bracket according to an embodiment.

Please refer to FIG. 18 and FIG. 20. In an embodiment of the disclosure, the rear housing 200*a* of the impeller housing 200 is provided with a through hole. The through hole is located in a center of the rear housing 200*a*, and allows the second rotation shaft 302 to pass through and rotate within the through hole. The middle housing 200*b* and the rear housing 200*a* of the impeller housing 200 are vertically arranged. When mounting the impeller housing 200, the middle housing 200*b* of the impeller housing 200 is connected with the auger housing 100 for communicating with the first accommodating space. At this time, the middle housing 200*b* of the impeller housing 200 is perpendicular to the rear housing 200*a*. The middle housing 200*b* of the impeller housing 200 is provided with an opening 200*c*. The opening 200*c* is arranged on a side of the middle housing 200*b* of the impeller housing 200 and is an inlet of the chute base 202.

Figure 12:
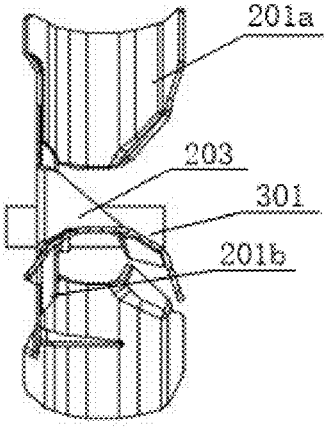
FIG. 12 is a side view of the impeller according to an embodiment.
Figure 13:
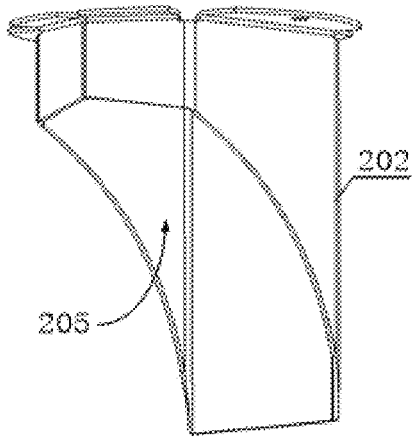
FIG. 13 is a perspective view of a base of a chute according to an embodiment.
Figure 14:
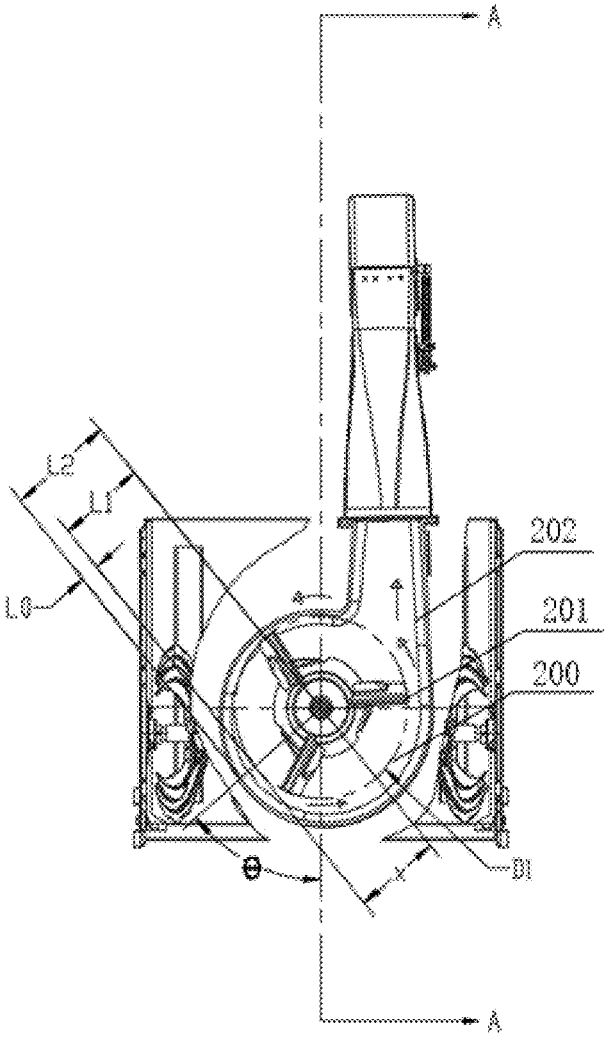
FIG. 14 is a cross-sectional perspective view of a snow throwing structure of the snow thrower in an A-A plane according to an embodiment.
Figure 15:
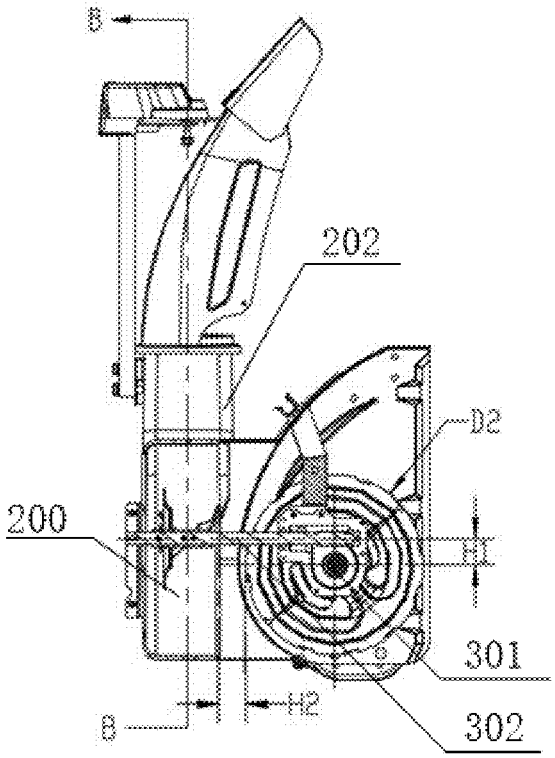
FIG. 15 is a cross-sectional perspective view of the snow throwing structure of the snow thrower in a B-B plane according to an embodiment.
Figure 16:
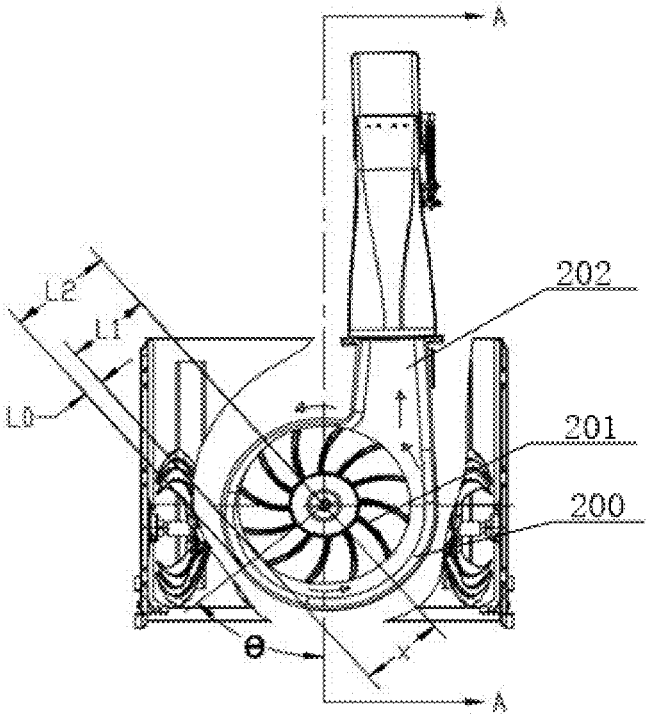
FIG. 16 is a cross-sectional perspective view of another snow throwing structure of the snow thrower in an A-A plane according to an embodiment.
Figure 17:
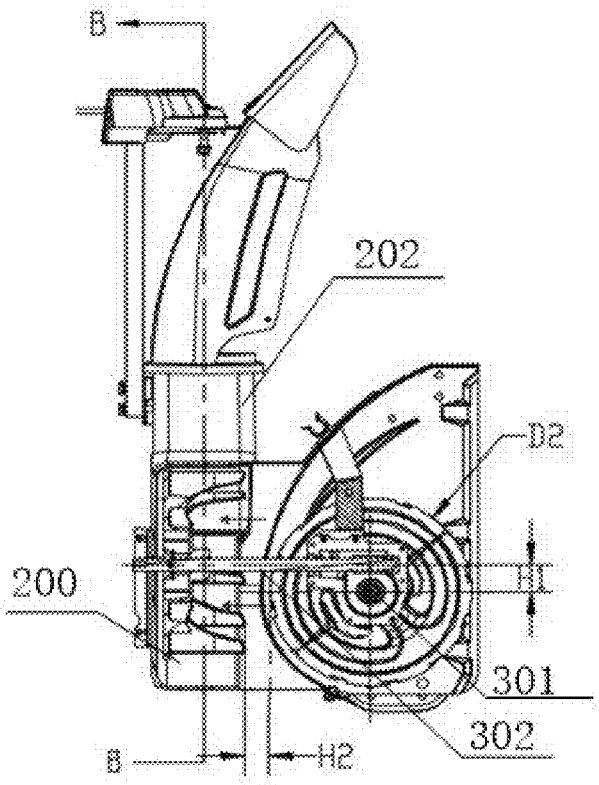
FIG. 17 is a cross-sectional perspective view of another snow throwing structure of the snow thrower in a B-B plane according to an embodiment.

Please refer to FIG. 12 through FIG. 14. In another embodiment of the disclosure, the impeller housing 200 is in a shape of a volute, and is in a shape of an Archimedes' spiral volute. A periphery of the rear housing 200*a* of the impeller housing 200 is a volute curve. The periphery of the rear housing 200*a* of the impeller housing 200 is an Archimedes' spiral. A starting end A of the volute curve is a side of the opening 200*c* of the impeller housing 200, along the middle housing 200*b* of the impeller housing 200, and ends at the other side of the opening 200*c* of the impeller housing 200.

Please refer to FIG. 14 through FIG. 19. In another embodiment of the disclosure, a distance between an axis of the second rotation shaft 302 and an end of the impeller blade 201*a* away from the center of the impeller base 201*b* is defined as L1. A distance between a point on a side wall of the impeller housing 200 and the center of the impeller base 201*b* is defined as L2. The L1 and the L2 partially overlap. A movement gap between the impeller blade 201*a* and an inner side wall of the impeller housing 200 is L0. L0=L2−L1. If a radius of the impeller blade 201*a* is x, and an angle between a line connecting any point on the volute curve to the center of the impeller base 201*b* and the vertical direction is 6, then an expression of a shape of the volute curve at an outer periphery of the middle housing 200*b* in the impeller housing 200 and the rear housing 200*a* of the impeller housing 200 is: $y=f(x, \theta)$. With the snow throwing structure of the snow thrower provided by the embodiment, the impeller housing 200 is set as a volute structure with the rear housing 200*a* in the shape of the Archimedes' spiral, so that a fast and strong airflow passage is defined in the impeller housing 200, which realizes an increase of wind energy turbocharging and improves a snow throwing efficiency. And since the volute curve is from the starting end A to a final end B, which means that along a rotation direction of the impeller 201, the movement gap between an outer end of the impeller blade 201*a* and the inner side wall of the corresponding impeller housing 200 is gradually increased. Therefore, the volute snow throwing air passage may improve a phenomenon of housing blocking due to thick snow, thereby preventing the impeller 201 and the auger 101 from being overloaded.

Please refer to FIG. 18 and FIG. 20. In another embodiment of the disclosure, a through hole is arranged in a center of the impeller housing 200, which is located at a center of the rear housing 200*a* of the impeller housing 200. The second rotation shaft 302 passes through the through hole from a side of the rear housing 200*a* of the impeller housing 200 to the other side of the rear housing 200*a* of the impeller housing 200, is used to fix the impeller 201, drives the impeller 201 to rotate, and throws the snow. An end of the second rotation shaft 302 is coupled to the first rotation shaft 301 for driving the auger 101 to rotate. The other end of the second rotation shaft 302 is coupled to an output end of the power assembly 30 through a chain or belt transmission. When the snow thrower 1 is working, the motor in the power assembly 30 works, and drives the second rotation shaft 302 to rotate, thereby driving the auger 101 to rotate. In this embodiment, a rotation direction of the second rotation shaft 302 is from the starting end A of the volute curve, along the middle housing 200*b* of the impeller housing 200, to the final end B of the volute curve. In this embodiment, when looking from an end of the second rotation shaft 302 connected with the first rotation shaft 301 to the other end, the auger 101 rotates in a counterclockwise direction.

Please refer to FIG. 18 through FIG. 22. In another embodiment of the disclosure, the impeller 201 is connected on the second rotation shaft 302. The impeller 201 rotates to throw the snow from the chute base 202. The impeller 201 includes a plurality of impeller blades 201*a* and a impeller base 201*b*, the plurality of impeller blades 201*a* are connected with the impeller base 201*b*, and the number of the blades 201*a* is equal to or greater than, for example, three. A central through hole is arranged in the center of the impeller base 201*b*, the second rotation shaft 302 penetrates through the central through hole, and the second rotation shaft 302 is connected with the impeller base 201*b*. The impeller 201 is made of hard material. In this embodiment, a material of the impeller 201 is, for example, metal. In other embodiments, the material of the impeller 201 is, for example, plastic. In this embodiment, the blades 201*a* and the impeller base 201*b* are connected by welding or other means. In other embodiments, the blades 201*a* and the impeller base 201*b* are integrally formed.

Please refer to FIG. 12 through FIG. 22. In another embodiment of the disclosure, the impeller base 201*b* is circular, and a radius of the impeller base 201*b* is much less than a distance from the center of the rear housing 200*a* of the impeller housing 200 to the middle housing 200*b* of the impeller housing 200. A plurality of impeller blades 201*a* are connected with the impeller base 201*b*, and the number of the impeller blades 201*a* is, for example, three. The plurality of impeller blades 201*a* are centrally symmetric with respect to a center of the impeller base 201*b*, which means centrally symmetric with respect to the second rotation shaft 302.

Please refer to FIG. 12 through FIG. 22. In another embodiment of the disclosure, the impeller blades 201*a* are in a shape of an open groove. Further, the impeller blades 201*a* are in a shape of a U-shaped open groove. An end of the plurality of impeller blades 201*a* is fixed on the impeller base 201*b* and has a predetermined distance from the center of the impeller base 201*b*. The other end of the plurality of impeller blades 201*a* extends along a direction of the radius of the impeller base 201*b* and extends out of the impeller base 201*b*, and notches of the blades 201*a* are perpendicular to a bottom surface where the impeller base 201*b* is located. In this embodiment, a material of the plurality of impeller blades 201*a* is metal.

Please refer to FIG. 12 through FIG. 22. In another embodiment of the disclosure, the impeller 201 further includes a plurality of supporting parts 203. The number of the supporting parts 203 is the same as the number of the impeller blades 201*a*. The supporting parts 203 are arranged on the edge of the impeller base 201*b* and are perpendicular to the protruding part of the impeller base 201*b*. The supporting parts 203 are in contact with the back surfaces of the impeller blades 201*a* to be engaged with the impeller blades 201*a*. When the impeller blades 201*a* rotate and throw snow, the supporting parts 203 provide a supporting force for the blades 201*a*.

Please refer to FIG. 12 through FIG. 22. In another embodiment of the disclosure, the impeller base 201*b* is circular, and the radius of the impeller base 201*b* is slightly less than the distance from the starting end A of the volute curve to the center of the impeller housing 200. The plurality of impeller blades 201*a* are connected with the impeller base 201*b*, and the number of the impeller blades 201*a* is greater than three. For example, the number of the impeller blades 201*a* is 12. The plurality of impeller blades 201*a* are centrally symmetric with respect to a center of the impeller base 201*b*, which means centrally symmetric with respect to the second rotation shaft 302.

Please refer to FIG. 12 through FIG. 22. In another embodiment of the disclosure, the impeller blades 201*a* are arranged perpendicular to the impeller base 201*b*. An end of the plurality of impeller blades 201*a* is fixed on the impeller base 201*b* and has a predetermined distance from the center of the impeller base 201*b*. The other end of the plurality of impeller blades 201*a* extends along the direction of the radius of the impeller base 201*b*, and extends to the edge of the impeller base 201*b*. When the impeller blades 201*a* are rotating, the other end of the impeller blades 201*a* is close to the middle housing 200*b* of the impeller housing 200 at the starting end A of the volute curve. In this embodiment, a height of the impeller blades 201*a* close to the middle housing 200*b* is higher than a height of the impeller blades 201*a* at the center of the impeller base 201*b*. On a side close to the impeller base 201*b*, the height of the impeller blade 201*a* is equal to or lower than the height of the center of the impeller base 201*b*, and the material of the impeller blade 201*a* is plastic.

Please refer to FIG. 18 through FIG. 22. In another embodiment of the disclosure, the impeller blade 201*a* has the predetermined distance from the center of the impeller base 201*b*, and the impeller blade 201*a* on the side close to the center of the impeller base 201*b* has the lower height, so that the center of the impeller base 201*b* defines a concave area. When the impeller 201 rotates at a high speed, the concave area defines a vacuum low pressure area, and defines a pressure difference with a pressure of an external high pressure area, which can actively suck the external snow into the impeller housing 200 more and faster and enhances the kinetic energy of the snow throwing structure of the snow thrower, so that the snow in the first accommodating space close to the inlet of the impeller housing 200 is sucked into the impeller housing 200. Compared with simply utilizing the auger 101 to squeeze the snow into the impeller housing 200, the snow thrower of the disclosure can also suck the snow into the impeller housing 200 through the impeller 201, which improves a performance of snow blowing and throwing and a whole efficiency of the snow thrower.

Please refer to FIG. 18 and FIG. 20. In another embodiment of the disclosure, the chute base 202 is arranged on the middle housing 200*b* of the impeller housing 200 and is connected with the opening 200*c* on the middle housing 200*b* of the impeller housing 200. The chute base 202 is mounted on a tangent direction of the final end of the volute curve. In this embodiment, the chute base 202 and the impeller housing 200 are integrally formed, and are a metal component or a plastic component. In other embodiments, the chute base 202 and the impeller housing 200 may be connected by welding. The chute base 202 and the impeller housing 200 may be metal components or plastic components.

Please refer to FIG. 18 and FIG. 20. In another embodiment of the disclosure, an area of the inlet of the chute base 202 is larger than an area of the outlet, and the chute base 202 is, for example, in an inverted funnel shape. After the snow is thrown from the impeller housing 200, it is smoothly thrown along an inner wall of the inverted funnel-shaped chute base 202. The inverted funnel-shaped chute base 202 may quickly gather the snow and throw it at a high speed. The disclosure does not limit a shape of the inlet and outlet of the chute base 202. In this embodiment, the inlet and outlet of the chute base 202 are, for example, circular. In other embodiments, the inlet and outlet of the chute base 202 are shaped such as polygons, a combination of arcs and straight lines, and the like.

Please refer to FIG. 14 through FIG. 17. In another embodiment of the disclosure, a circle defined by ends of the impeller 201 away from the center of the impeller base 201*b* when the impeller 201 is rotating is defined as a first circle. A circle defined by the farthest points on the auger 101 away from the first rotation shaft 301 when the auger 101 is rotating is defined as a second circle. A diameter of the first circle is, for example, D1, and a diameter of the second circle is, for example, D2. A ratio of the diameter D2 of the second circle to the diameter D1 of the first circle ranges from 0.9 to 1.5. In this embodiment, a minimum distance between a plane the first circle located and a plane the second circle located is, for example, H2. A range of H2 is, for example, from 5 mm to 60 mm.

Please refer to FIG. 14 through FIG. 17. In another embodiment of the disclosure, the first rotation shaft 301 and the second rotation shaft 302 are substantially perpendicular to each other, and the first rotation shaft 301 is located below the second rotation shaft 302. In the vertical direction, a distance between the first rotation shaft 301 and the second rotation shaft 302 is, for example, H1. A range of H1 is, for example, from 25 mm to 60 mm. A gearbox assembly is further arranged between the second rotation shaft 302 and the first rotation shaft 301 for adjusting a rotation speed between the impeller 201 and the auger 101. A range of a reduction ratio of the gearbox assembly is, for example, from 8 to 12.

Please refer to FIG. 23 through FIG. 34. In an embodiment of the disclosure, the power assembly includes a first motor 300, the first rotation shaft 301 and the second rotation shaft 302. Wherein, the first motor 300 is connected with the impeller housing 200. In some embodiments, the first motor 300 is mounted on an upper portion of the impeller housing 200, which means that the first motor 300 is mounted on the impeller housing 200 and is located on a side of the chute base 202.

Please refer to FIG. 23 through FIG. 34. In an embodiment of the disclosure, the power assembly may include the first motor 300, the first rotation shaft 301 and the second rotation shaft 302. The first motor 300 may be connected with the impeller housing 200. The first motor 300 is arranged on an upper portion of the impeller housing 200. The first motor 300 may be arranged on the impeller housing 200 through a fixed base 306. After the first motor 300 is mounted on an upper portion of the impeller housing 200, the first motor 300 is located at a top of the impeller housing 200, and the first motor 300 is located on a side of the chute base 202, and the first motor 300 is located forward of the battery assembly 40. Further, an output shaft of the first motor 300 may be oriented facing the rear of the snow thrower, which means the output shaft of the first motor 300 extends in a direction away from the auger housing 100, which means that the output shaft of the first motor 300 extends in a direction of a side the chassis 80 located. After the first motor 300 is connected with the impeller housing 200, the output end of the first motor 300 is located above a connection position between the impeller housing 200 and the chassis 80. The first motor 300 is mounted on the impeller housing 200 through the fixed base 306. The impeller housing 200 is further provided with a bracket 305. A side of the bracket 305 is arranged in an arc shape matched with an outer side wall of the impeller housing 200. The bracket 305 is connected with the impeller housing 200 by welding. The fixed seat 306 is connected with the bracket 305, for example, by bolts, so as to facilitate a disassembly and assembly of the first motor 300. A first transmission wheel 309 is arranged on the output shaft of the first motor 300, so the first motor 300 may drive the first transmission wheel 309 to rotate. A second transmission wheel 308 is arranged below the first transmission wheel 309, and the second transmission wheel 308 is arranged on an end of the second rotation shaft 302 and outside the impeller housing 200, which means that the second transmission wheel 308 is located on the same side of the impeller housing 200 as the first transmission wheel 309. The first transmission wheel 309 and the second transmission wheel 308 may be connected by a belt or a chain, so that the first transmission wheel 309 may drive the second transmission wheel 308 to rotate.

Please refer to FIG. 1, FIG. 23 through FIG. 34. The first motor 300 is placed on the impeller housing 200, so that there is a lot of space above the chassis 80 to place the battery assembly 40. In addition, the first motor 300, the impeller housing 200, the first transmission wheel 309, the second transmission wheel 308, and the belt or the chain may define a module. During assembly, the first motor 300, the impeller housing 200, the first transmission wheel 309, the second transmission wheel 308, and the belt or the chain may be assembled together, and then the assembled part may be connected with the snow thrower 1, which has a simple structure and convenient to assemble. In addition, a structure of the disclosure enables the first motor 300, the first transmission wheel 309 and the second transmission wheel 308 to be assembled on the same side, which further improves the convenience of assembly.

Please refer to FIG. 26 through FIG. 34 and FIG. 44. A fan 900 is also arranged on the second rotation shaft 302. The fan 900 and the second transmission wheel 308 are located at the same end of the second rotation shaft 302, and the fan 900 is located outside the second transmission wheel 308. A diameter of the fan 900 may be less than a diameter of the second transmission wheel 308. Since the second transmission wheel 308 and the fan 900 are both arranged on the second rotation shaft 302, the second transmission wheel 308 and the fan 900 may rotate coaxially or synchronously. In this embodiment, the fan 900 and the second transmission wheel 308 are both arranged on an outside of the impeller housing 200, which means on a side of the impeller housing 200 away from the auger housing 100. Both the fan 900 and the second transmission wheel 308 are arranged in the chassis 80. A first notch 802*b* is further arranged on a side of a top surface of the chassis 80 close to the impeller housing 200. The first notch 802*b* is used to provide a passage for the belt or chain to connect the second transmission wheel 308 with the first transmission wheel 309, which means that a connecting surface 803 further exists between the second transmission wheel 308 and the impeller housing 200, that is to say, the second transmission wheel 308 is located in the chassis 80. In this embodiment, the fan 900 is arranged in the chassis 80 for heat dissipation of the components in the chassis 80, and for heat dissipation of the belt to improve a duration life of the belt. In addition, the fan 900 is connected with the second rotation shaft 302, and a rotation of the second rotation shaft 302 may drive the fan 900 to rotate without additional power transmission, which gives a compact structure and a good heat dissipation of the belt and the second transmission wheel 308.

Figure 2:
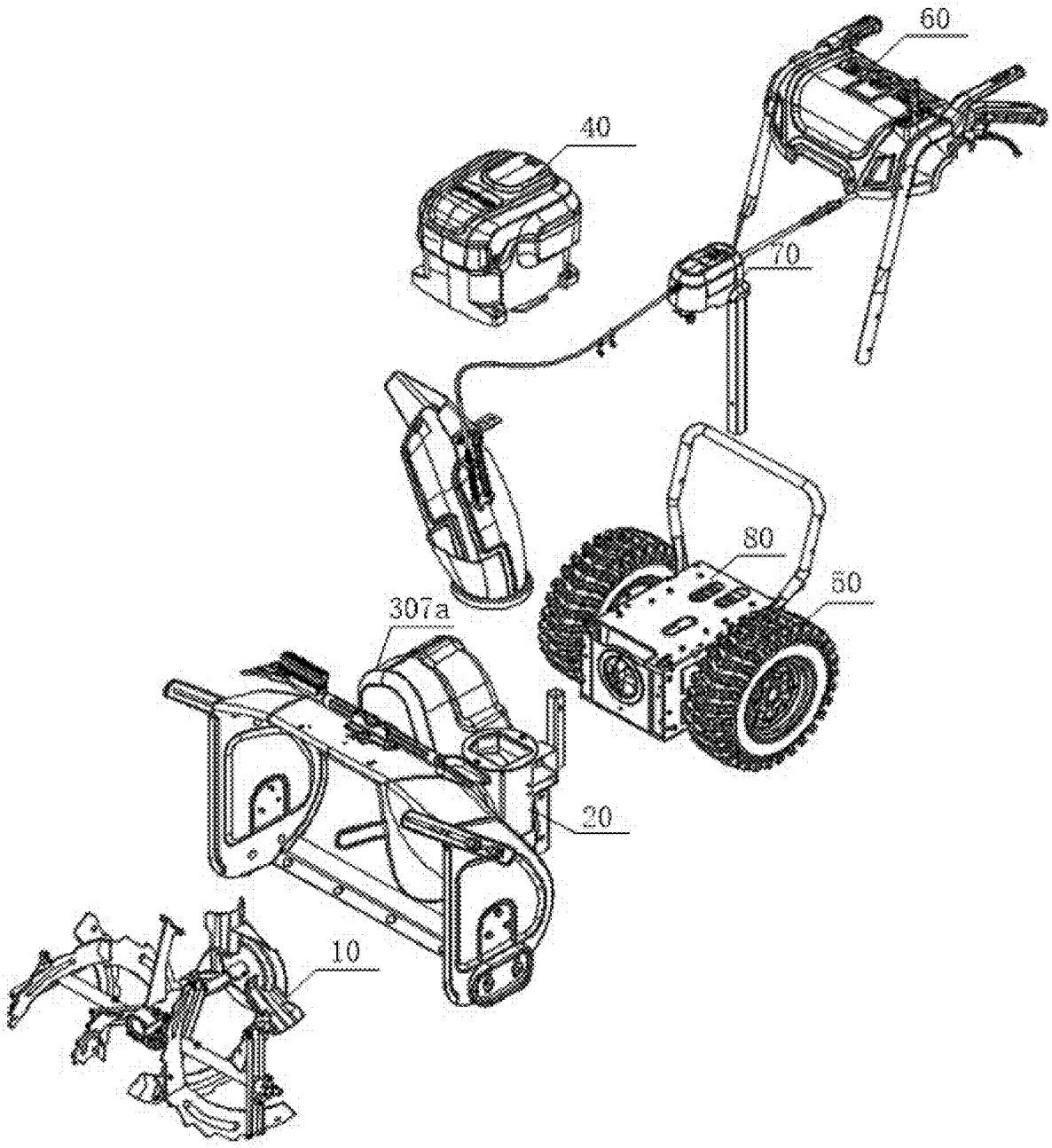
FIG. 2 is an exploded view of the snow thrower according to an embodiment.

Please refer to FIG. 23 through FIG. 34. A heat dissipation fan 307*b* is connected with an end of the first motor 300 away from the output shaft. The end of the first motor 300 provided with the heat dissipation fan 307*b* is connected with a volute 307. The volute 307 covers on a periphery of the heat dissipation fan 307*b*, which can guide and gather heat dissipation airflow, improve a smoothness of the heat dissipation airflow, and enable a heat dissipation effect to be better. In addition, an outside of the first motor 300 is further covered with a motor cover 307*a* (as shown in FIG. 2) to prevent water, dust, etc. from entering the first motor 300, so as to protect the first motor 300. In addition, the motor cover may gather the airflow, so that the heat dissipation airflow can dissipate heat for the first motor 300 more concentratedly and quickly, thereby further improving the heat dissipation effect.

Please refer to FIG. 26 through FIG. 34. In this embodiment, the belt is used to connect the first transmission wheel 309 with the second transmission wheel 308, a tensioning structure 313 is further arranged on the mounting plate. The mounting plate may be fixed on the impeller housing 200, and the belt may be tensioned through the tensioning structure 313 to become more reliable. By using the belt or chain to connect the first transmission wheel 309 with the second transmission wheel 308, a wear between the parts may be reduced, and a replacement of the parts may be facilitated.

Figure 25:
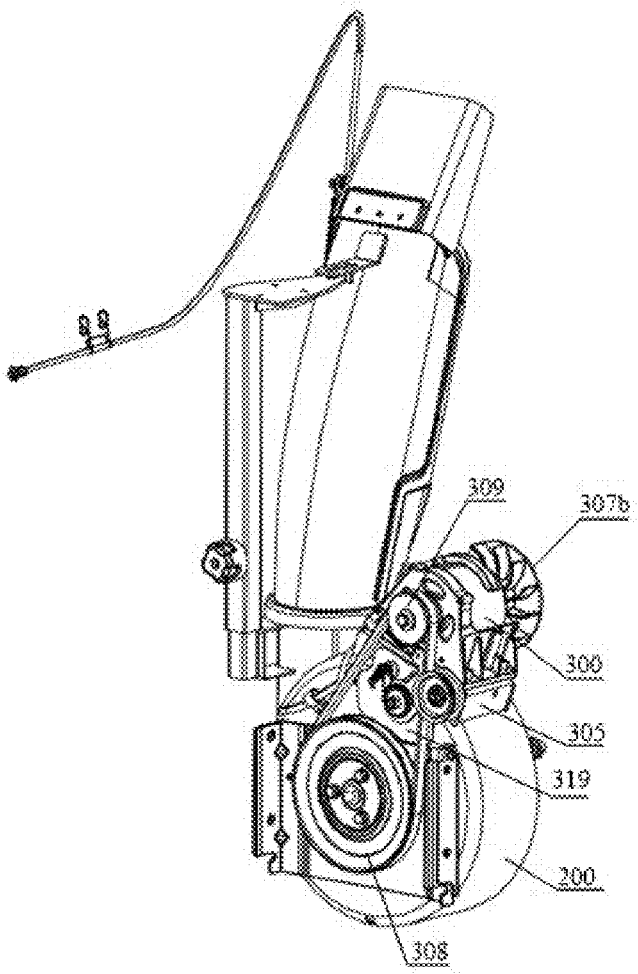
FIG. 25 is a perspective view of a heat dissipation fan according to an embodiment.
Figure 26:
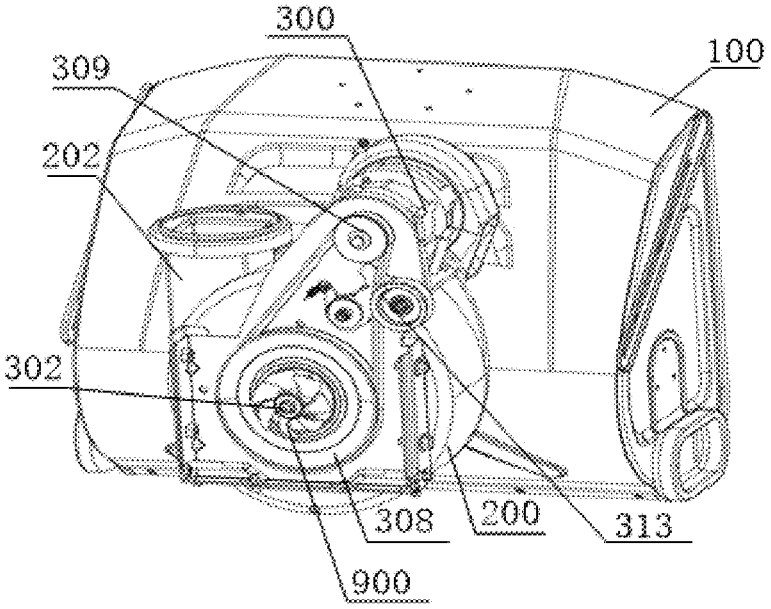
FIG. 26 is a perspective view of a transmission assembly according to an embodiment.
Figure 27:
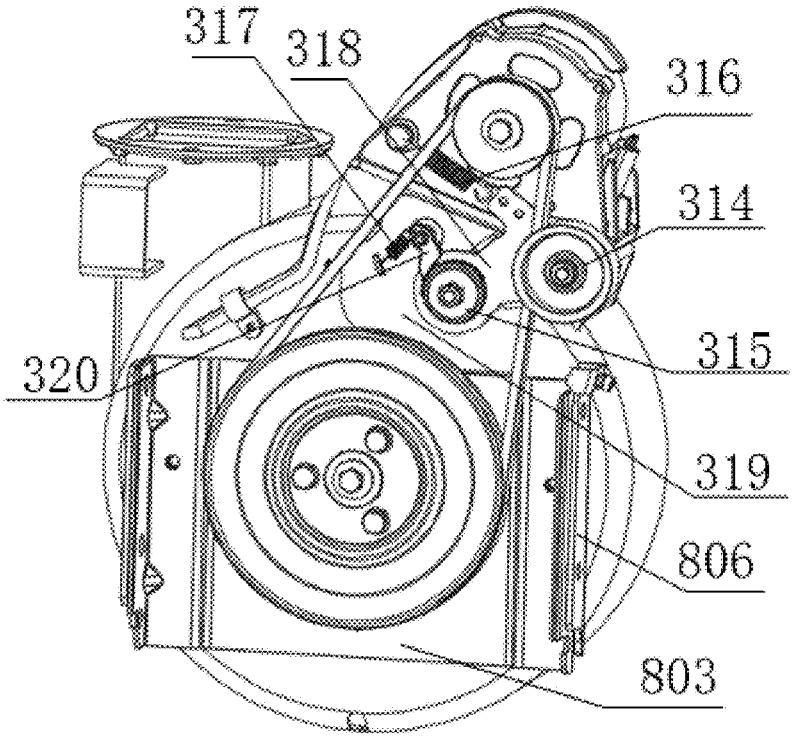
FIG. 27 is a top view of a tensioning structure according to an embodiment.
Figure 28:
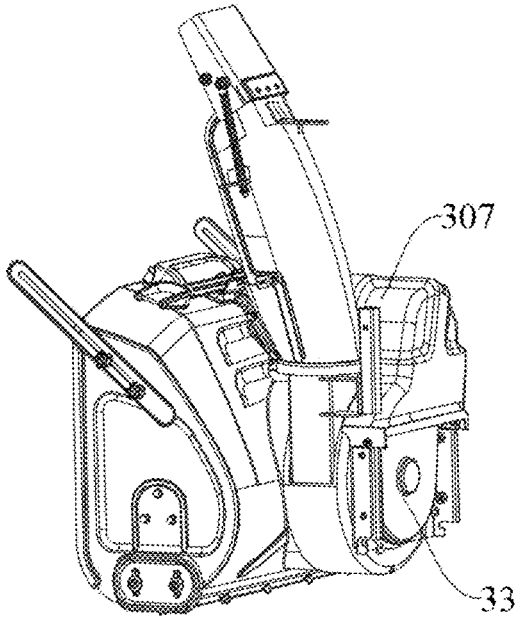
FIG. 28 is a partial schematic perspective view of the snow thrower according to an embodiment.
Figure 29:
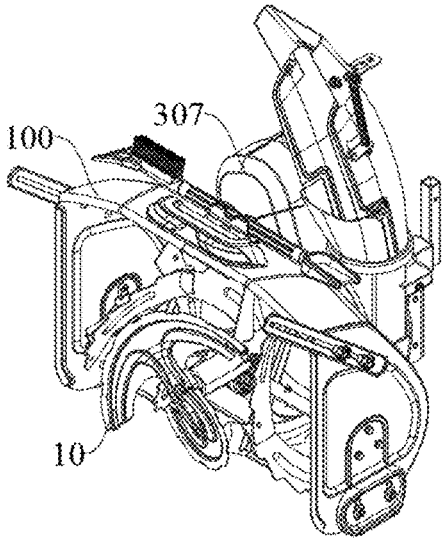
FIG. 29 is a schematic perspective view of the snow thrower from another angle according to an embodiment.
Figure 30:
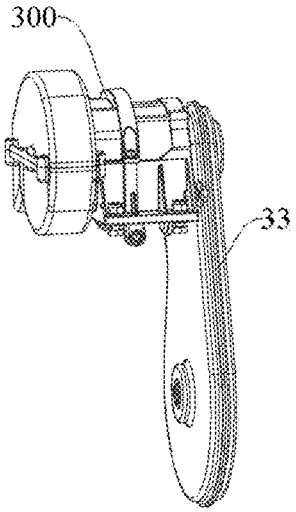
FIG. 30 is an assembling schematic view of the transmission assembly with a power assembly in the snow thrower according to an embodiment.
Figure 31:
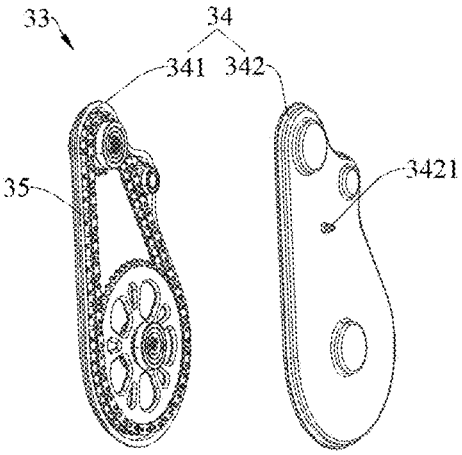
FIG. 31 is a schematic perspective view of the transmission assembly according to an embodiment.
Figure 32:
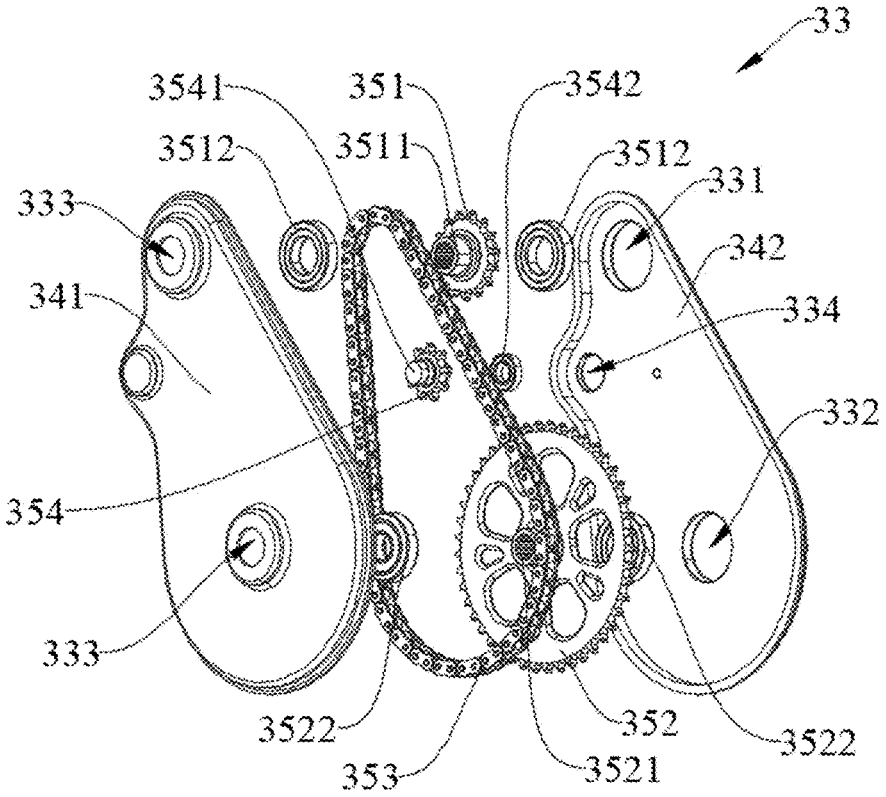
FIG. 32 is a schematic exploded view of the transmission assembly according to an embodiment.
Figure 33:
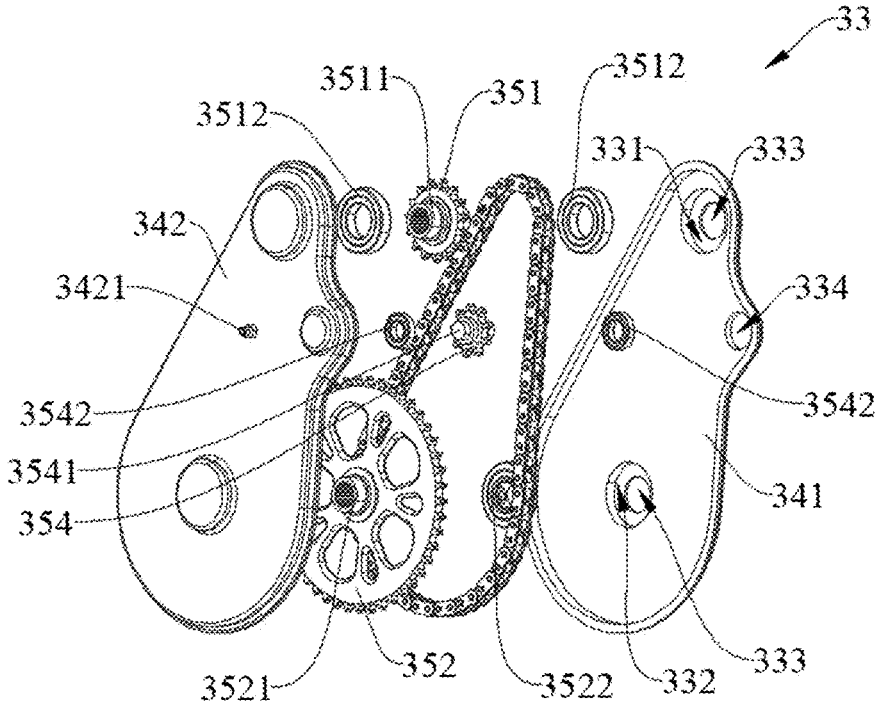
FIG. 33 is a schematic exploded view of the transmission assembly from another angle according to an embodiment.

Please refer to FIG. 25 through FIG. 27. The tensioning structure 313 includes, for example, a tensioning plate 318, a tensioning wheel 314, a first tensioning spring 316 and the mounting plate 319. The mounting plate 319 is connected with the impeller housing 200, and the mounting plate 319 is further connected with the above-mentioned bracket 305 to strengthen a connection between the bracket 305 and the impeller housing 200. In this embodiment, the mounting plate 319 is connected with the impeller housing 200 and the bracket 305 by welding, and this arrangement may strengthen a strength of the impeller housing 200 and a fixation of the first motor 300, and prevent unexpected situations such as overturning of the first motor 300. The tensioning plate 318 is rotatably connected with the mounting plate 319. The tensioning wheel 314 is mounted on the tensioning plate 318. An end of the first tensioning spring 316 is connected with the tensioning plate 318, and the other end of the first tensioning spring 316 is connected with the fixed base 306 of the first motor 300. The first tensioning spring 316 pulls the tensioning plate 318, so that the tensioning wheel 314 is tightly pressed on the belt, thereby realizing a tensioning of the belt. In addition, the tensioning structure 313 of this embodiment is further provided with a ratchet wheel 315, a ratchet pawl 320 and a second tensioning spring 317. The ratchet wheel 315 is connected on the tensioning plate 318. The ratchet pawl 320 in connected on the mounting plate 319. The ratchet wheel 315 is connected with the tensioning plate 318. A rotation of the ratchet wheel 315 may drive the tensioning plate 318 to rotate. An end of the ratchet pawl 320 is matched with the ratchet wheel 315, and the other end of the ratchet pawl 320 is connected with the second tensioning spring 317. Under an action of the second tensioning spring 317, the ratchet pawl 320 is engaged with the ratchet wheel 315, which can prevent the ratchet wheel 315 from rotating in an opposite direction and prevent the tensioning plate 318 from rotating, thereby causing the tensioning wheel 314 to be disengaged from the belt. An arrangement of the ratchet pawl 320 and the ratchet wheel 315 in this embodiment can avoid a failure of the tensioning structure 313 of the belt, and can enable the belt tensioning to be more reliable. In addition, a tensioning force of the tensioning wheel 314 on the belt may also be adjusted by manually adjusting a matching between the ratchet pawl 320 and the ratchet wheel 315. When the snow thrower is working, the output end of the first motor 300 rotates, and the second rotation shaft 302 rotates accordingly, which drives the impeller 201 connected with the second rotation shaft 302 and the first rotation shaft 301 to rotate, and then drives the auger 101 fixed on the first rotation shaft 301 to rotate. A use of the belt or chain transmission may reduce the wear between the components, and the components are easy to replace. At the same time, there is no transmission gap, and the cost is low.

Please refer to FIG. 28, FIG. 30 through FIG. 33. In another embodiment of the disclosure, a chain is used to drive the first rotation shaft 301 and the second rotation shaft 302 to rotate. When a chain transmission is adopted, it mainly includes a transmission assembly 33 arranged between the first motor 300 and the second rotation shaft 302, the first motor 300 is connected with a driving sprocket 351, and the second rotation shaft 302 is connected with a driven sprocket 352. In this embodiment, the transmission assembly 33 includes a transmission housing 34 and a sprocket assembly 35. The sprocket assembly 35 is mounted in the transmission housing 34. The sprocket assembly 35 includes the driving sprocket 351, the driven sprocket 352 and a chain 353. The driving sprocket 351 and the driven sprocket 352 are rotatably mounted on both ends inside the transmission housing 34. The chain 353 is mounted around an outside of the driving sprocket 351 and the driven sprocket 352 and meshed with the driving sprocket 351 and the driven sprocket 352. The driving sprocket 351 and the driven sprocket 352 are in a transmission connection through the chain 353, and a transmission ratio between the driving sprocket 351 and the driven sprocket 352 is set, for example, between from 2 to 10. In the disclosure, the driving sprocket 351, the driven sprocket 352 and the chain 353 are all mounted in the transmission housing 34, so that the transmission assembly is a whole assembly, which enables a mounting to be quick and convenient.

Please refer to FIG. 28, FIG. 30 through FIG. 33. In another embodiment of the disclosure, two ends inside the transmission housing 34 are respectively provided with a driving sprocket mounting groove 331 and a driven sprocket mounting groove 332. The transmission housing 34 includes a first transmission housing 341 and a second transmission housing 342. The first transmission housing 341 and the second transmission housing 342 are connected with each other and define a closed housing cavity. The sprocket assembly 35 is mounted in the housing cavity. The first transmission housing 341 and the second transmission housing 342 are both provided with the driving sprocket mounting groove 331 and the driven sprocket mounting groove 332, and the driving sprocket mounting groove 331 and the driven sprocket mounting groove 332 correspond to each other. Both the driving sprocket mounting groove 331 and the driven sprocket mounting groove 332 are provided with mounting grooves, so as to facilitate a mounting of the driving sprocket 351 and the driven sprocket 352. Further, the mounting groove is a circular mounting groove. It should be noted that bottoms of the driving sprocket mounting groove 331 and the driven sprocket mounting groove 332 on the first transmission housing 341 are provided with through holes 333. The through hole 333 and the driving sprocket mounting groove 331 or the driven sprocket mounting groove 332 are coaxially arranged, so as to facilitate a connection between the power assembly, the auger 10 and the transmission assembly. It should also be noted that a sealing gasket is arranged between the first transmission housing 341 and the second transmission housing 342 to improve its sealing performance and prevent dust and the like from entering an interior of the transmission assembly, thereby affecting a duration life of the chain.

Please refer to FIG. 28, FIG. 30 through FIG. 33. In another embodiment of the disclosure, the second transmission housing 342 is further provided with an oil injection nozzle 3421, so as to inject lubricant into the transmission assembly. The lubricant may prevent a decrease of a transmission life of the chain due to an excessive temperature during transmission, and reduce noise during chain transmission.

Please refer to FIG. 28, FIG. 30 through FIG. 33. In another embodiment of the disclosure, the driving sprocket 351 is mounted in the driving sprocket mounting groove 331 on an inner side of the transmission housing 34. Two sides of a center of the driving sprocket 351 protrude outward to define a first rotating shaft 3511. First bearings 3512 are mounted on both sides of the driving sprocket 351. The first bearing 3512 is sleeved on the first rotating shaft 3511. The first bearings 3512 on both sides of the driving sprocket 351 are respectively mounted in the driving sprocket mounting grooves 331 of the first transmission housing 341 and the second transmission housing 342, which means that the driving sprocket mounting grooves 331 on the first transmission housing 341 and the second transmission housing 342 are equivalent to a bearing seat, so as to facilitate a mounting of the first bearing 3512 and thus facilitate a mounting of the driving sprocket 351. It should also be noted that the center of the driving sprocket 351 is a through hole, so as to facilitate a connection with the power assembly, which means that the power assembly is connected with the driving sprocket 351 through the through hole at a bottom of the driving sprocket mounting groove 331 on the first transmission housing 341. In addition, it should be noted that sealing structures are arranged at a connection position between the power assembly and the driving sprocket 351 and a connection position between the first bearing 3512 and the driving sprocket mounting groove 331 on the first transmission housing 341 to prevent the dust and the like entering the interior of the transmission assembly, thereby affecting the duration life of the chain, and at the same time avoiding a leakage of lubricant.

Please refer to FIG. 28, FIG. 30 through FIG. 33. In another embodiment of the disclosure, the driven sprocket 352 is mounted in the driven sprocket mounting groove 332 on the other side inside the transmission housing 34. Two sides of a center of the driven sprocket 352 protrude outward to define a second rotating shaft 3521. Second bearings 3522 are mounted on both sides of the driven sprocket 352. The second bearing 3522 is sleeved on the second rotating shaft 3521. The second bearings 3522 on both sides of the driven sprocket 352 are mounted in the driven sprocket mounting grooves 332 of the first transmission housing 341 and the second transmission housing 342 respectively, which means that the driven sprocket mounting grooves 332 on the the first transmission housing 341 and the second transmission housing 342 are equivalent to a bearing seat, so as to facilitate a mounting of the second bearing 3522 and thus facilitate a mounting of the driven sprocket 352. It should also be noted that a center of the driven sprocket 352 is a through hole, so as to facilitate a connection with the second rotation shaft 302, which means that the second rotation shaft 302 is connected with the driven sprocket 352 through the through hole at a bottom of the driven sprocket mounting groove 332 on the first transmission housing 341. In addition, it should be noted that sealing structures are arranged at a connection position between the second rotation shaft 302 and the driven sprocket 352 and a connection position between the second bearing 3512 and the driven sprocket mounting groove 332 on the first transmission housing 341 to prevent the dust and the like entering the interior of the transmission assembly, thereby affecting the duration life of the chain, and at the same time avoiding a leakage of lubricant.

Please refer to FIG. 28, FIG. 30 through FIG. 33. In another embodiment of the disclosure, the transmission assembly also includes a tensioning sprocket 354. The tensioning sprocket 354 is mounted inside the transmission housing 34, located between the driving sprocket 351 and the driven sprocket 352 and meshed with the chain 353. The tensioning sprocket 354 is rotatably connected with the first transmission housing 341 and the second transmission housing 342 through a rotation shaft 3541, and the tensioning sprocket 354 is meshed with the chain 353. The first transmission housing 341 and the second transmission housing 342 are further correspondingly provided with tensioning sprocket mounting grooves 334. Third bearings 3542 are mounted at both ends of the tensioning sprocket 354. The third bearing 3542 is sleeved on the rotation shaft 3541 and mounted in the tensioning sprocket mounting groove 334, which means that the tensioning sprocket mounting grooves 334 on the first transmission housing 341 and the second transmission housing 342 are equivalent to the bearing seat, so as to facilitate a mounting of the third bearing 3542 and thus facilitate a mounting of the tensioning sprocket 354.

Please refer to FIG. 4, FIG. 23 through FIG. 35. In an embodiment of the disclosure, the auger 10 is mounted on the first rotation shaft 301. The impeller 201 is mounted on the second rotation shaft 302. The first motor 300 drives the second rotation shaft 302, the impeller 201 on the second rotation shaft 302 and the fan 900 on the second rotation shaft 302 to rotate, thereby driving the first rotation shaft 301 and the auger 101 mounted on the first rotation shaft 301 to rotate. In this embodiment, the second rotation shaft 302 is perpendicular to the first rotation shaft 301 and is parallel to the horizontal plane. Of course, in other embodiments of the disclosure, a certain angle may also be defined between the second rotation shaft 302 and the first rotation shaft 301, for example, from 1 degree to 4 degrees. In addition, a certain angle may also be defined between the second rotation shaft 302 and the horizontal plane, and a certain angle may also be defined between the first rotation shaft 301 and the horizontal plane. An end of the second rotation shaft 302 is in a transmission connection with the first rotation shaft 301, and the other end of the second rotation shaft 302 extends along a horizontal direction, from a side where the impeller housing 200 is connected with the auger housing 100 to the other side, and then is connected with the output end of the first motor 300 through the belt or chain. When the second rotation shaft 302 rotates, the impeller 201 rotates accordingly. And the gearbox assembly may further be arranged between the second rotation shaft 302 and the first rotation shaft 301 to adjust the rotation speed of the impeller 201 and the auger 101. The reduction ratio of the gearbox assembly is in a range of, for example, from 8 to 12.

Figure 34:
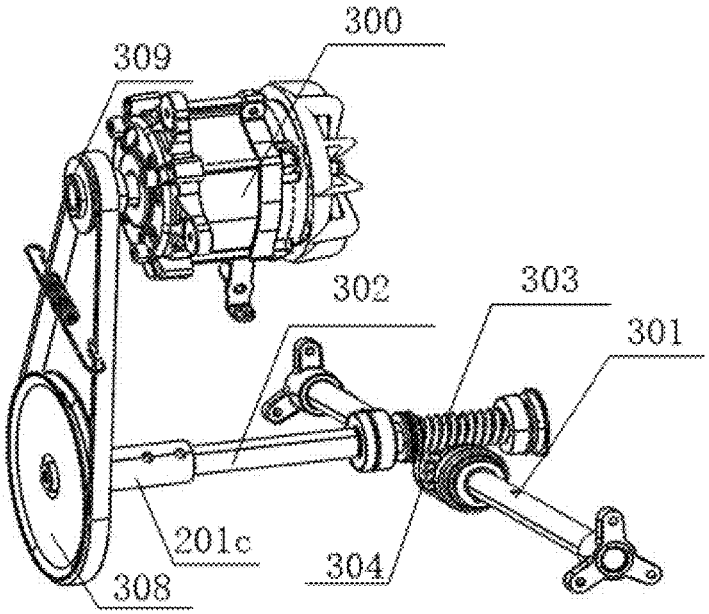
FIG. 34 is a perspective view of a connection between a first rotation shaft and a second rotation shaft according to an embodiment.

Please refer to FIG. 34, in other embodiments, the output end of the first motor 300 and the second rotation shaft 302 are connected through a coupling or other shaft connecting components, which may realize a direct transmission between the first motor 300 and the second rotation shaft 302 and improve a transmission efficiency.

Please refer to FIG. 34. In an embodiment of the disclosure, the first rotation shaft 301 and the second rotation shaft 302 are connected by a worm. A worm 303 is arranged at an end of the second rotation shaft 302 connected with the first rotation shaft 301, and a worm gear 304 is arranged in a middle part of the first rotation shaft 301. The worm 303 and the worm gear 304 are meshed with each other. When the second rotation shaft 302 rotates, the first rotation shaft 301 is driven to rotate. In this embodiment, the second rotation shaft 302 and the worm 303 are in an integral structure. Of course, in other embodiments, the second rotation shaft 302 and the worm 303 may also be two separate components, and the second rotation shaft 302 and the worm 303 are connected by a fastener such as pins, which are not limited in this disclosure.

Figure 35:
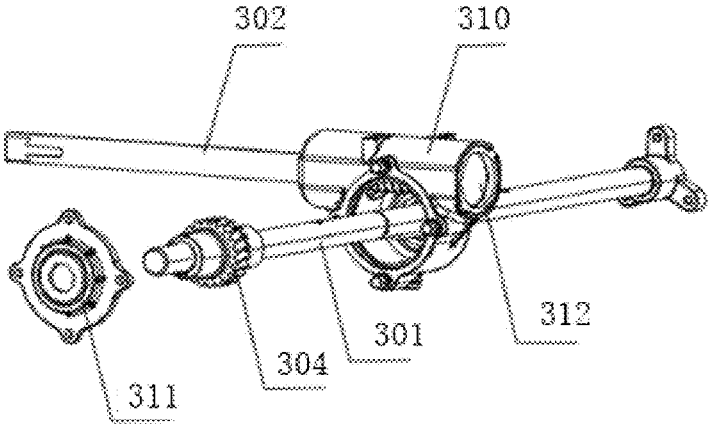
FIG. 35 is an exploded view of the connection between the first rotation shaft and the second rotation shaft according to an embodiment.
Figure 36:
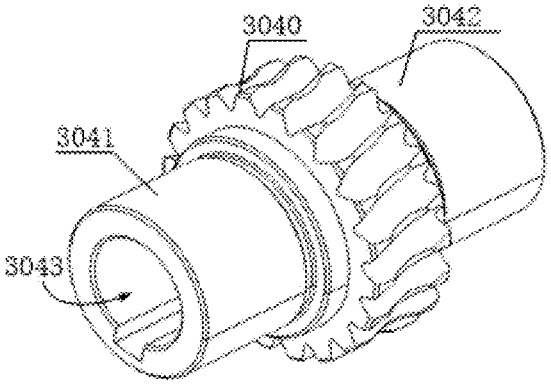
FIG. 36 is a perspective view of a worm gear of the disclosure according to an embodiment.
Figure 37:
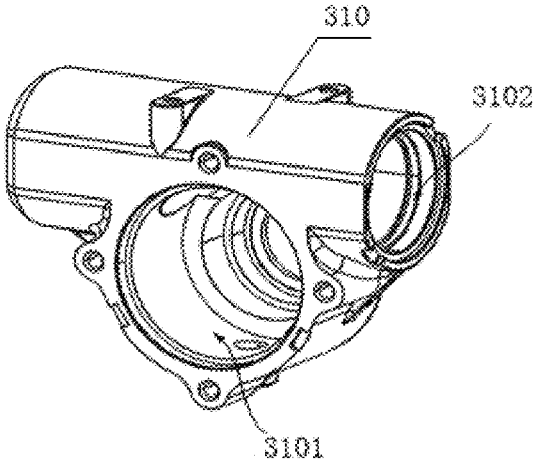
FIG. 37 is a perspective view of a worm gear housing of the disclosure according to an embodiment.
Figure 38:
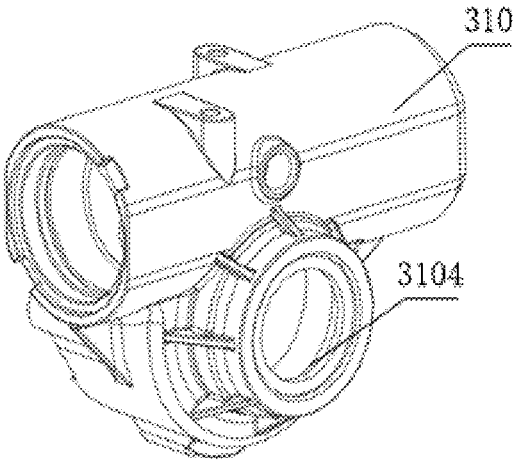
FIG. 38 is a perspective view of the worm gear housing with a second opening angle according to an embodiment.
Figure 39:
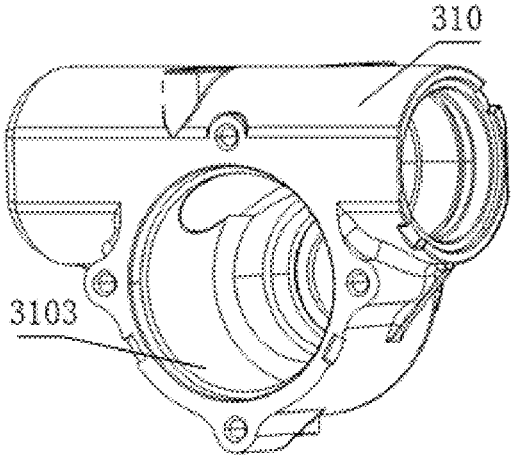
FIG. 39 is a perspective view of the worm gear housing with a first opening angle according to an embodiment.
Figure 40:
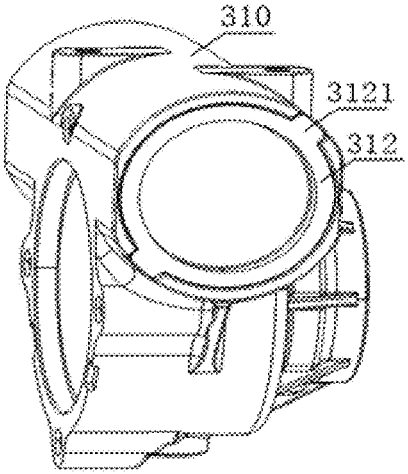
FIG. 40 is a perspective view of the worm gear housing with a second sealing end cover according to an embodiment.

Please refer to FIG. 5, FIG. 34 and FIG. 35. A worm gear housing 310 is further arranged on the first rotation shaft 301 and the second rotation shaft 302, which covers a connection part between the first rotation shaft 301 and the second rotation shaft 302. The worm gear housing 310 is connected with a fixed device 107, an end of the fixed device 107 is fixed on the worm gear housing 310 and the other end of the fixed device 107 is fixed on the auger housing 100. The fixed device 107 acts simultaneously with the worm gear housing 310 to reinforce the first rotation shaft 301 and the second rotation shaft 302, as well as strengthening the auger 101 on the first rotation shaft 301 and the impeller 201 on the second rotation shaft 302. A plurality of washers and gaskets are further arranged on both sides of the worm gear 304 and the worm 303 for fixing the worm gear 304 and the worm 303.

Please refer to FIG. 34 through FIG. 42. In an embodiment of the disclosure, the worm gear housing 310 is an integrally formed housing, an end surface of the worm gear housing 310 is provided with a second penetrating hole 3102 and a first penetrating hole 3101, and the second penetrating hole 3102 and the first penetrating hole 3101 communicate with each other. In some embodiments, the second penetrating hole 3102 and the first penetrating hole 3101 are perpendicular to each other. Both ends of the first penetrating hole 3101 are sealed with a first sealing end cover 311, and the second penetrating hole 3102 is sealed with a second sealing end cover 312. An end of the second rotation shaft 302 is connected with, for example, the first motor 300 in the power assembly 30, and the other end of the second rotation shaft 302 is provided with the worm 303 and is sleeved in the second penetrating hole 3102. The second rotation shaft 302 rotates under an action of the power device 30. The worm gear 304 is sleeved in the first penetrating hole 3101, and is meshed with the worm 303 of the second rotation shaft 302 to define a worm transmission. The worm gear 304 is connected with the first rotation shaft 301 to drive the first rotation shaft 301 to move. In this embodiment, the worm gear 304 is sleeved on the first rotation shaft 301. The worm gear 304 is connected with the first rotation shaft 301 through a key in an embodiment. The first rotation shaft 301 passes through the worm gear 304. The first rotation shaft 301 and the second rotation shaft 302 are respectively arranged along an X-axis (transverse) and the Y-axis (longitudinal) of the horizontal plane, which means that the second rotation shaft 302 and the worm gear 304 are arranged vertically. The first rotation shaft 301 rotates with the rotation of the second rotation shaft 302 through the worm transmission, thereby driving the auger 101 arranged on the first rotation shaft 301 to roll and shovel the snow. It should be noted that two ends of the worm gear 304 are provided with longer extension parts, which extend to the first sealing end cover 311 that closes the first penetrating hole 3101 to seal the worm gear housing 310, so that a leakage of the lubricant may be avoided when adding lubricant into a cavity between the worm gear 304 and the worm gear housing. Further, the second sealing end cover 312 at the second penetrating hole 3102 is provided with a warped edge structure 3121, so that the operator may pry the entire second sealing end cover 312 through the warped edge structure 3121, and then disassemble the entire worm gear structure for repairing and replacement. When disassembling, the second sealing end cover 312 is opened, an elastic spring (not shown) is arranged in the second sealing end cover 312, and the bearing may be moved after removing the elastic spring, so that the worm gear and worm are no longer meshed with each other, and then the entire structure may be disassembled.

Please refer to FIG. 34 through FIG. 42. In an embodiment of the disclosure, the worm gear 304 includes a worm gear body 3040 in a middle position, and extension parts at both ends of the worm gear body 3040. The extension parts at both ends of the worm gear body 3040 include a first extension part 3041 and a second extension part 3042. The worm gear body 3040, the first extension parts 3041 and the second extension parts 3042 at both ends of the worm gear body 3040 define a complete hollow cavity 3043. The first rotation shaft 301 passes through the hollow cavity 3043 of the worm gear. The worm gear body 3040 is provided with gear teeth, and the gear teeth are meshed with the worm 303. When the first rotation shaft 301 is connected with the worm gear 304 and mounted inside the first penetrating hole 3101, the first extension part 3041 extends to the first sealing end cover 311 that closes the first penetrating hole 3101.

Figure 41:
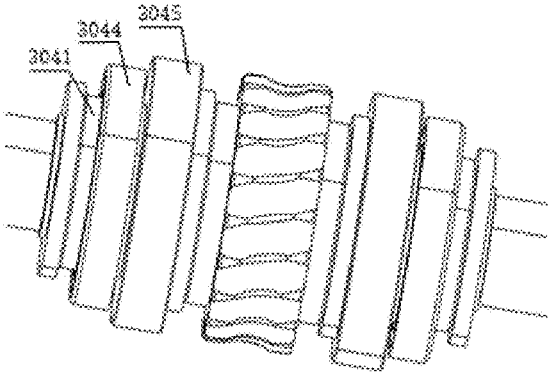
FIG. 41 is a perspective view of a mounting assembly of the first rotation shaft according to an embodiment.
Figure 42:
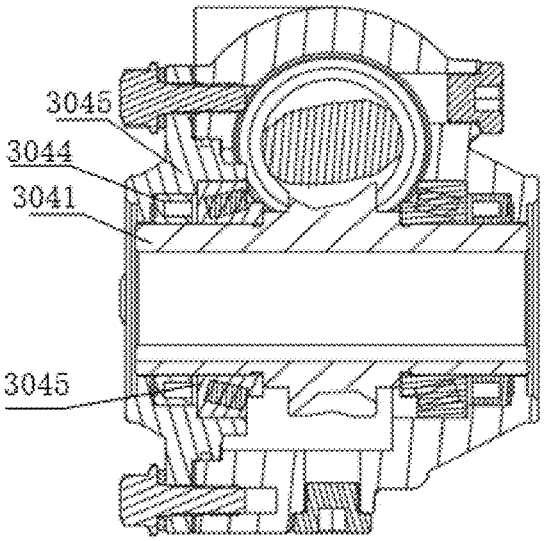
FIG. 42 is a cross-sectional view of assemblies inside the worm gear housing according to an embodiment.

Please refer to FIG. 35, FIG. 41 and FIG. 42. In an embodiment of the disclosure, the first rotation shaft 301 is supported through a bearing 3045, the bearing 3045 is located in the worm gear housing 310, and the bearing 3045 is connected with the first sealing end cover 311. The first sealing end cover 311 is provided with a through hole to allow the first rotation shaft 301 to pass through. The first extension part 3041 extends into the through hole and has a very small gap with an inner wall of the through hole, which prevents the first extension part 3041 from wearing the first sealing end cover 311. A sealing component 3044 is arranged between the first sealing end cover 311 and the bearing 3045 of the first rotation shaft 301. The sealing component 3044 is clamped with the first extension part 3041. An inner side of the sealing component 3044 is substantially completely fitted with the first rotation shaft 301, and an outer side of the sealing component 3044 is substantially completely fitted with the first sealing end cover 311, which isolates a gap between the bearing 3045 of the first rotation shaft 301 and the first sealing end cover 311. Therefore, when the liquid oil is used at the bearing 3045 of the first rotation shaft 301, an oil leakage will be avoided.

Please refer to FIG. 34 through FIG. 42. The disclosure provides the worm gear housing 310. The worm gear 304 passes through the first penetrating hole 3101 of the worm gear housing 310 and is meshed with the worm 303 of the second rotation shaft 302. In this embodiment, the first penetrating hole 3101 includes a first port 3103 and a second port 3104. A radius of the second port 3104 is adapted to a radius of the first rotation shaft 301. In some embodiments, the radius of the second port 3104 is slightly greater than the radius of the first rotation shaft 301, which allows the first rotation shaft 301 to pass through. A radius of the first port 3103 is greater than the radius of the second port 3104, which facilitates to mount the worm gear 304. At a position where the first penetrating hole 3101 communicates with the second penetrating hole 3102, a radius of the first penetrating hole 3101 is substantially the same as that of the radius of the first port 3103. Such first port 3103 and second port 3104 with different radii facilitate an assembly and positioning. During mounting, an end of the second rotation shaft 302 with the worm 303 is extended into the worm gear housing 310, and then the first rotation shaft 301 with the worm gear 304 is extended into the worm gear housing 310. There is already the second rotation shaft 302 at a communication position where the first penetrating hole 3101 communicates with the second penetrating hole 3102, and the first penetrating hole 3101 with a larger radius at the communication position may easily let the first rotation shaft 301 pass through, which is convenient for the worm gear 304 to be meshed with the worm 303. After the first rotation shaft 301 passes through the communication position where the first penetrating hole 3101 communicates with the second penetrating hole 3102, the first port 3103 with a smaller radius facilitates a positioning of the first rotation shaft 301, which enables a mounting of the first rotation shaft 301 to be more convenient.

Please refer to FIG. 43 through FIG. 46. In an embodiment of the disclosure, the chassis 80 is arranged on a side of the impeller assembly 20 opposite to the auger assembly 10. The chassis 80 is used for fixing the wheel assembly 50 and providing an accommodating space for the control board assembly. Please refer to FIG. 44, the chassis 80 includes a main housing 802, the connecting surface 803, a bottom surface 804, a fixed component 806, a hanging rod 801 and a bracket 805. The main housing 802 is in a groove structure with one end open. A notch of the main housing 802 faces downward, and an opening of the main housing 802 faces the impeller assembly 20. The notch of the main housing 802 is connected with the bottom surface 804, and the opening of the main housing 802 is connected with the connecting surface 803 to define a closed chassis 80. First through holes 802*a* are arranged on opposite sides of the main housing 802, and the first through holes 802*a* are used to connect the wheel assembly 50. On a top surface of the main housing 802, a first notch 802*b* is further arranged on a side close to the connecting surface 803. The first notch 802*b* is used to provide a passage for the belt connecting the first transmission wheel 309 and the second transmission wheel 308. A plurality of through holes are further arranged on the top surface of the main housing 802 for providing passages for an electrical connection between the battery assembly 40 and the control board assembly.

Further, please refer to FIG. 26, FIG. 27, FIG. 43 and FIG. 44. In an embodiment of the disclosure, the fixed component 806 is arranged in an L shape, and the fixed component 806 is fixed on an outer bottom wall of the impeller housing 200. Two fixed components 806 are arranged in parallel and opposite to each other, and a distance between the two fixed components 806 is greater than a width of the connecting surface 803. The connecting surface 803 is fixed, for example, on the outer bottom wall of the impeller housing 200 by bolts, and is used for connecting with the impeller assembly 20 and the chassis 80. Both sides of the connecting surface 803 are provided with first connecting components 803*b*. When the connecting surface 803 is fixed on an outer bottom wall of the impeller housing 200, there is a gap between the fixed component 806 and the first connecting component 803*b* of the connecting surface 803. The main housing 802 of the chassis 80 is clamped in the gap defined by the fixing component 806 and the first connecting component 803*b*, and is connected by bolts. A second through hole 803*a* is arranged on the connecting surface 803, and a radius of the second through hole 803*a* is less than a radius of the second transmission wheel 308. The second transmission wheel 308, the first transmission wheel 309 and the fan 900 are all located on a side of the connecting surface 803 close to the main housing 802. The second rotation shaft 302 sequentially passes through the second through hole 803*a* and the bottom wall of the impeller housing 200 into the second accommodating space.

Figure 43:
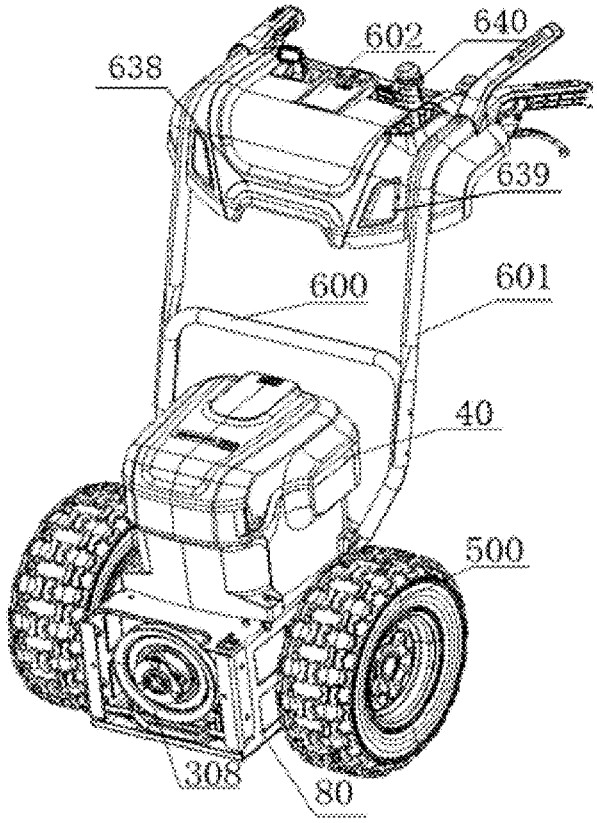
FIG. 43 is a perspective view of a part of the snow thrower according to an embodiment.
Figure 44:
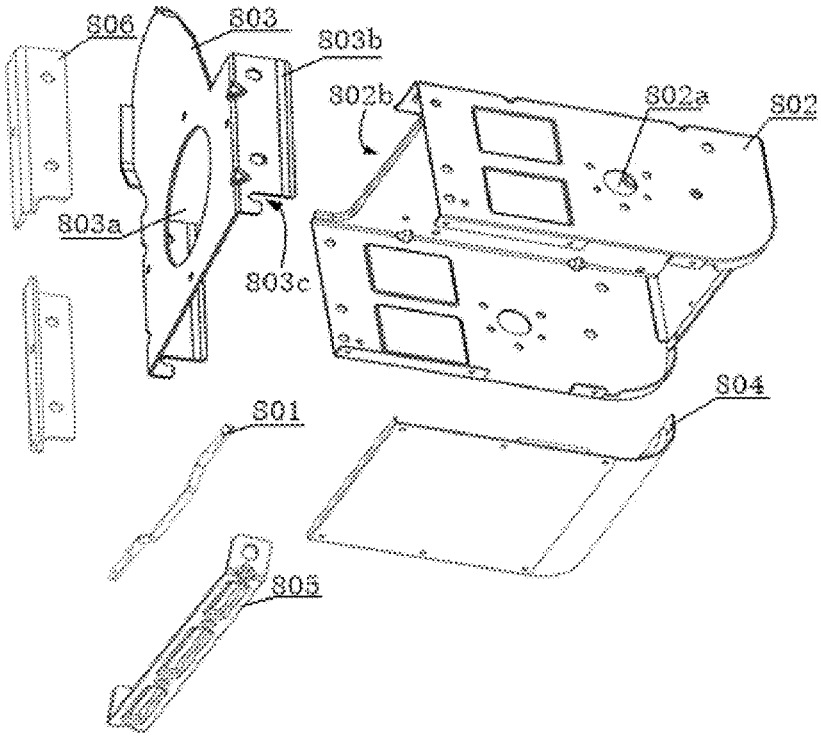
FIG. 44 is an exploded perspective view of a chassis according to an embodiment.

Further, please refer to FIG. 27, FIG. 43 and FIG. 44. In an embodiment of the disclosure, a side of the first connecting component 803*b* is provided with a first groove 803*c*. The hanging rod 801 is mounted on the main housing 802. Both ends of the hanging rod 801 are fixed on two opposite side walls of the main housing 802, and the hanging rod 801 is located on a side of the main housing 802 connected with the connecting surface 803. When the chassis 80 is connected with the impeller assembly 20, the hanging rod 801 is clamped in the first groove 803*c*, and the chassis 80 rotates around an axis of the hanging rod 801, so that a side wall of the main housing 802 is clamped in the gap defined by the fixed component 806 and the first connecting component 803*b*, and the chassis 80 and the control assembly 60 on the chassis 80 are connected with the impeller assembly 20 through connecting the main housing 802 with the fixed component 806 and the first connecting component 803*b* by bolts. An assembly and disassembly of the chassis 80 and the impeller assembly 20 in this embodiment is very convenient, which improves an assembly convenience of the snow thrower 1.

Further, please refer to FIG. 27, FIG. 43 and FIG. 44. The brackets 805 are arranged on both sides of the main housing 802, the brackets 805 are located on a side close to the bottom surface 804, and the brackets 805 are used to support the control board assembly in the chassis 80.

Please refer to FIG. 1, FIG. 3, FIG. 45 through FIG. 48. A baffle assembly is arranged between the impeller assembly 20 and the control board assembly. The baffle assembly separates the control board assembly in the chassis 80 from the fan 900 and the second transmission wheel 308 to prevent a movement interference and prevent wires connected with the control board assembly from twisting into the fan 900 and the second transmission wheel 308. The disclosure does not limit the number of baffles. In this embodiment, the baffle assembly includes a first baffle 814 and a second baffle 815. The first baffle 814 is fixed on the bracket 805, and on a side of the first baffle 814 away from the bracket 805, the first baffle 814 is provided with a second groove 816, and the second groove 816 divides the side of the first baffle 814 away from the bracket into a first clamping component 817 and a second clamping component 818. The second baffle 815 is fixed on a circuit board base 906, and the second baffle 815 and the circuit board base 906 are integrally formed. A side of the second baffle 815 away from the circuit board base 906 is clamped in the second groove 816, and the first clamping component 817 is located at a side of the second baffle 815. The second clamping component 818 is located on the other side of the second baffle 815, so that a connection between the first baffle 814 and the second baffle 815 is more reliable, and the baffle assembly will not fall over.

Please refer to FIG. 45 through FIG. 50. In an embodiment of the disclosure, a wire clip 807 is fixed on the main housing 802 and located on a side opposite to the connecting surface 803. The wire clip 807 is used to provide a circuit passage between the control board assembly arranged inside the chassis 80 and external electrical components. Wires on an operation console 602 extend to the chassis 80 along a operation handle 601, enter the chassis 80 through the wire clip 807, and are connected with the control board assembly in the chassis 80. The wire clip 807 includes a wire base 810 and a wire cover 811. The wire base 810 and the wire cover 811 are fastened together, and a wire passage 812 is defined in the wire clip 807. A circular arc rib 813 is arranged in the wire passage 812 to increase a friction between the wire and the wire passage 812. In some embodiments, the wire clip 807 is in a triangular shape. At each top corner, the wire base 810 and the wire cover 811 are fixed and pressed by bolts, so as to meet requirements of a wire pulling force test. In this embodiment, an inlet of the wire passage 812 is located on a side wall where the wire clip 807 is fixed. An outlet of the wire passage 812 is attached and fitted with the chassis 80, and a through hole is arranged at a position corresponding to the chassis 80. The wires enter through the inlet of the wire passage 812, pass through the wire passage 812, enter the chassis 80 from the outlet of the wire passage 812, and are connected with the control board assembly in the chassis 80.

Figure 45:
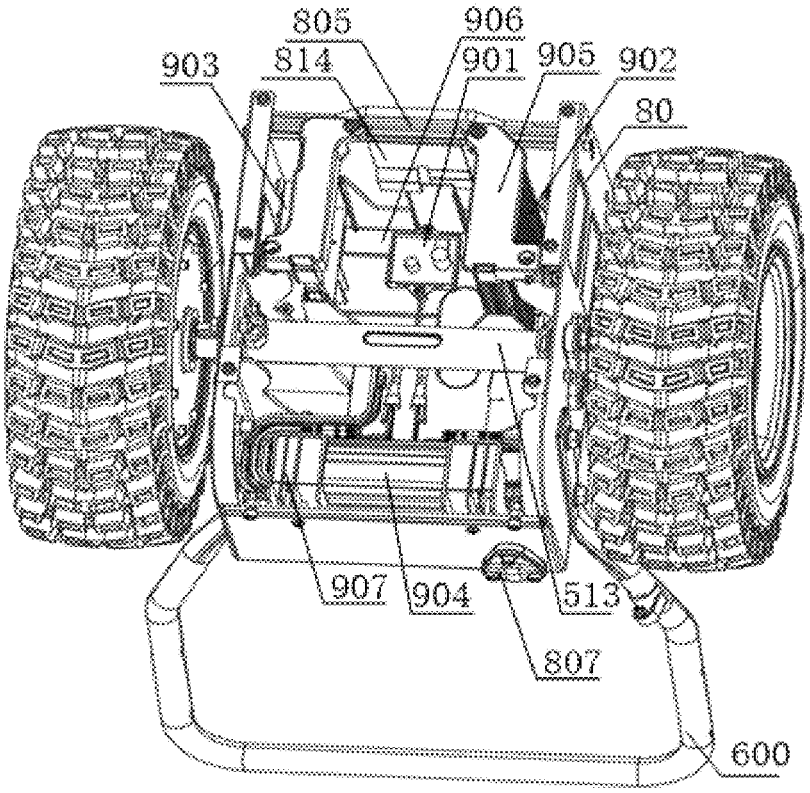
FIG. 45 is a bottom view of an interior of a chassis according to an embodiment.
Figure 46:
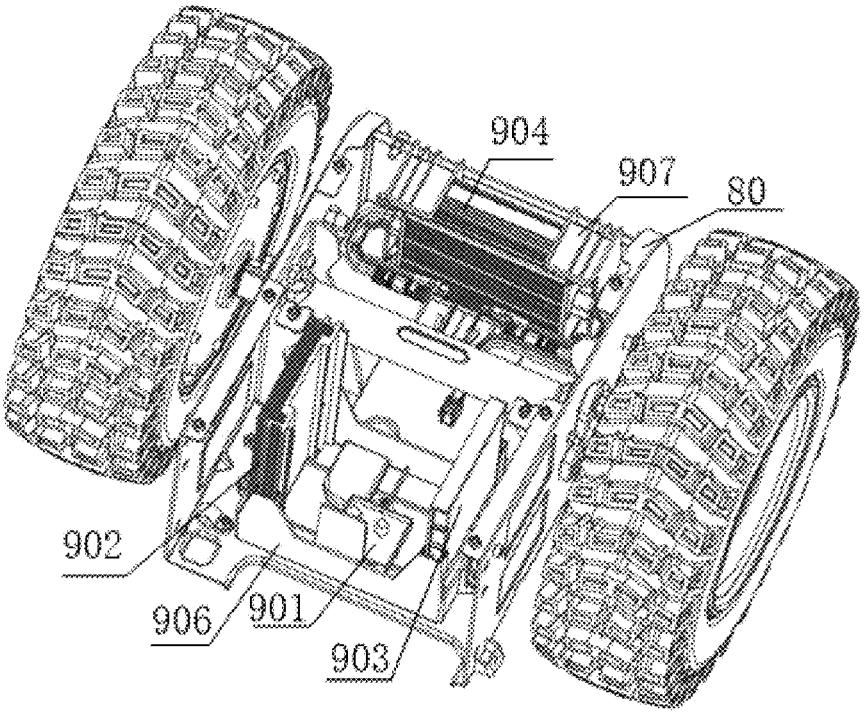
FIG. 46 is an internal perspective view of the chassis according to an embodiment.
Figure 47:
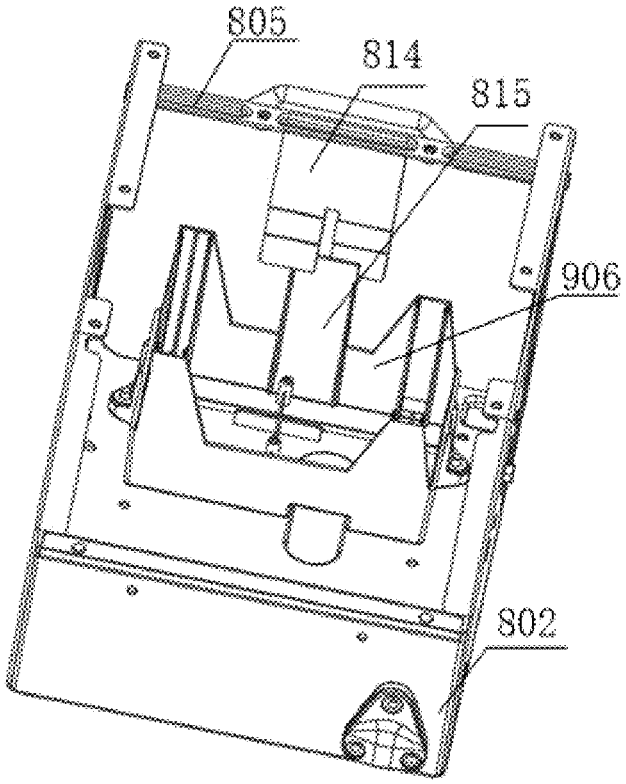
FIG. 47 is a mounting perspective view of of a baffle assembly according to an embodiment.
Figure 48:
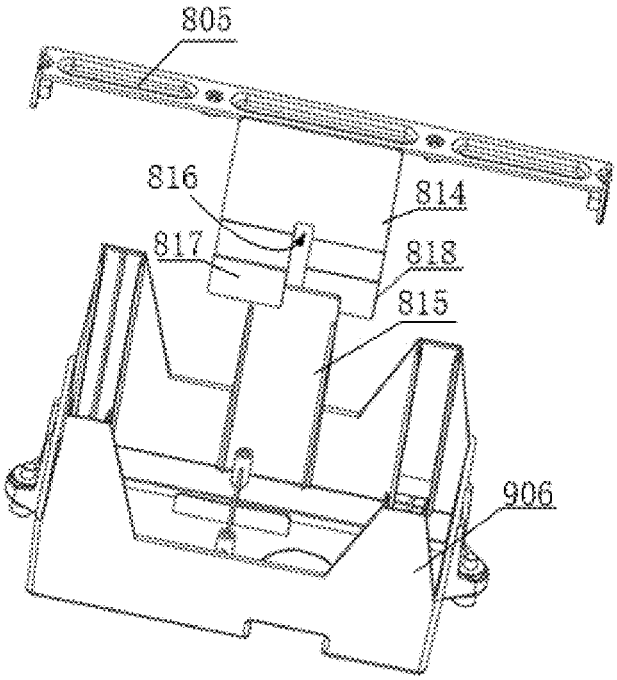
FIG. 48 is a perspective view of the baffle assembly according to an embodiment.
Figure 49:
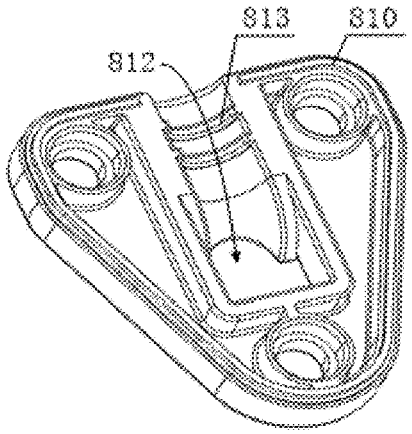
FIG. 49 is a perspective view of a wire slot according to an embodiment.
Figure 50:
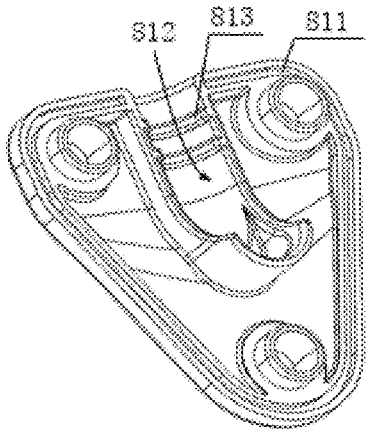
FIG. 50 is a perspective view of a wire cover according to an embodiment.

Please refer to FIG. 45 and FIG. 46. The control board assembly is, for example, a circuit board. The control board assembly is arranged inside the chassis 80. Wherein, the control board assembly includes a first control board assembly 901, a second control board assembly 902, a third control board assembly 903 and at least one fourth control board assembly 904. The first control board assembly 901 is used to control the first light 105, including controlling an on-and-off of the first light 105 on the auger housing 100. The second control board assembly 902 is used to control the first motor 300, including controlling an on-and-off and a rotation speed of the first motor 300. The third control board assembly 903 is used to control a battery 410, including controlling the charging and discharging of a battery 410. The fourth control board assembly 904 is used to control an on-and-off, rotation speed, and steering of a wheel hub motor 501 in the wheel assembly 50.

Please refer to FIG. 45 through FIG. 57. In an embodiment of the disclosure, on a top surface of an interior of the chassis 80, the circuit board base 906 is arranged on a side close to the fan 900. Two sides of the circuit board base 906 are provided with grooves 906*a*. On a side of the chassis 80 close to the bottom surface 804, a plurality of symmetrical connecting bases 905 are fixed at a position opposite to the circuit board base 906. In this embodiment, the connecting base 905 includes a left connecting base and a right connecting base. The plurality of connecting bases 905 and the circuit board base 906 work together to limit positions of the first control board assembly 901, the second control board assembly 902 and the third control board assembly 903. An end of the connecting base 905 is fixed on the bracket 805, and the other end of the connecting base 905 is fixed on the fixed part of the wheel assembly 50.

Please refer to FIG. 45 through FIG. 58. On a side wall of the chassis 80, a plurality of fixed bases 907 are fixed on a side wall opposite to the connecting surface 803. In this embodiment, the number of the fixed bases 907 is, for example, two, including a left fixed base and a right fixed base. The left fixed base and the right fixed base are fixed on the side wall of the chassis 80 in parallel, and are used for placing the fourth control board assembly 904. The fixed base 907 is further provided with a plurality of reinforcing ribs 907*a*, so that a strength of the fixed base 907 is higher and a structure is more stable. The reinforcing ribs 907*a* are higher than a plane where they are located, which increases a surface area of the fixed base 907 and increases a distance between the chassis 80 and the fixed base 907, thereby enhancing the heat dissipation effect. A second notch 907*b* is further arranged on the fixed base 907, and the second notch 907*b* is arc-shaped. When the fourth control board assembly 904 is placed on the fixed base 907, it needs to be connected with the wheel hub motor 501 through wiring, and the second notch 907*b* provides a passage for the wiring between the fourth control board assembly 904 and the wheel hub motor 501, which keeps the wiring clean and organized.

Please refer to FIG. 45 through FIG. 57. In an embodiment of the disclosure, the first control board assembly 901 is fixed on the circuit board base 906 on the top surface of the chassis 80. The first control board assembly 901 includes a first control board 901*a* and a first housing 901*b*. The first control board 901*a* is arranged on the first housing 901*b*. The first control board 901*a* is connected with the first light 105 and a button on the operation console 602. When the button on the operation console 602 is pressed, the on-and-off of the first light 105 may be adjusted. The first housing 901*b* is used to fix the first control board 901*a*. In this embodiment, the first housing 901*b* is fixed on the circuit panel base 906, and the first housing 901*b* is, for example, a plastic component.

Please refer to FIG. 45 through FIG. 57. In an embodiment of the disclosure, a second control board assembly 902 is fixed between the circuit board base 906 and the connecting base 905 and is close to the side wall of the chassis 80. The second control board assembly 902 is close to a side wall of the main housing 802 connected with the connecting surface 803. The second control board assembly 902 includes a second control board 902*a* and a first heat dissipation piece 902*b*. The first heat dissipation piece 902*b* is located between the circuit board base 906 and the connecting base 905, and is inserted into the grooves 906*a*. The second control board 902*a* is fixed on the first heat dissipation piece 902*b*. The second control board 902*a* is fixed on the first heat dissipation piece 902*b*, for example, by fasteners or glue. The second control board 902*a* is connected with the first motor 300 and the button on the console 602. When the button on the operation console 602 is pressed, the rotation speed of the first motor 300 and the like may be adjusted. A surface of the first heat dissipation piece 902*b* away from the second control board 902*a* includes dense concave grooves for expanding a heat dissipation area.

Please refer to FIG. 45 through FIG. 54. In an embodiment of the disclosure, the third control board assembly 903 is located between the circuit board base 906 and another connecting base 905 and is close to the side wall of the chassis 80. The third control board assembly 903 is close to the other side wall of the main housing 802 connected with the connecting surface 803, and is located on an opposite side of the second control board assembly 902. The third control board assembly 903 includes a third control board 903*a*, a second housing 903*b* and a second dissipation piece (not shown in the figure). The second housing 903*b* is located between the circuit board base 906 and another connecting base 905, and is inserted and connected in another grooves 906*a*. The third control board 903*a* is fixed on the second housing 903*b* by, for example, fasteners or glue. The third control board 903*a* is connected with the battery 410 and the button on the operation console 602. Wherein, the third control board 903*a* and the battery 410 are bidirectionally connected with each other. The battery 410 supplies power for the third control board 903*a*, and the third control board 903*a* controls a discharge of the battery 410. When the button on the operation console 602 is pressed, an output voltage, discharge mode, etc. of the battery 410 may be adjusted. In addition, a heat dissipation piece may be attached to the third control board 903*a* to dissipate heat for the third control board 903*a*.

Please refer to FIG. 45 through FIG. 54. In an embodiment of the disclosure, the fourth control board assembly 904 is fixed between two symmetrical fixed bases 907 and is close to the other side wall of the chassis 80. The fourth control board assembly 904 is separated from the first control board assembly 901, the second control board assembly 902, and the third control board assembly 903 through a connecting plate 513 in the wheel assembly 50. The fourth control board assembly 904 is close to a side wall opposite to the fan 900. The fourth control board assembly 904 includes a fourth control board 904*a* and a third heat dissipation piece 904*b*. The fourth control board 904*a* is connected with the wheel hub motor 501 and the button on the operation console 602. When the button on the operation console 602 is pressed, a rotation speed, steering, etc. of the wheel hub motor 501 may be adjusted. The third heat dissipation piece 904*b* is fixed between the two symmetrical fixed bases 907 and is close to the other side wall of the chassis 80. The third heat dissipation piece 904*b* is a hollow housing. The fourth control board 904*a* is placed inside the third heat dissipation piece 904*b*. A surface of the third heat dissipation piece 904*b* is provided with a plurality of concave grooves, which may expand the heat dissipation area. Openings are arranged at both ends of the third heat dissipation piece 904*b* for providing a connection passage for the fourth control board 904*a* and the outside.

Figure 51:
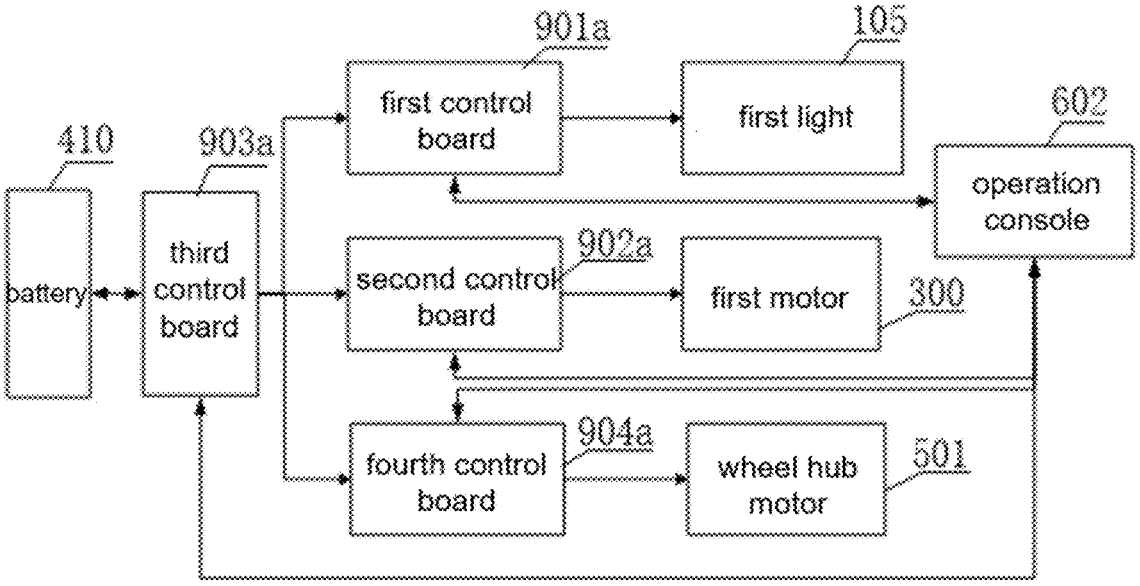
FIG. 51 is a block diagram of electrical connections of the snow thrower according to an embodiment.
Figure 52:
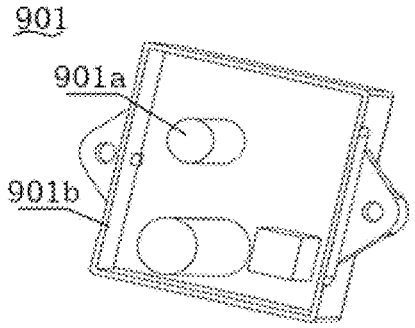
FIG. 52 is a perspective view of a first control board assembly according to an embodiment.
Figure 53:
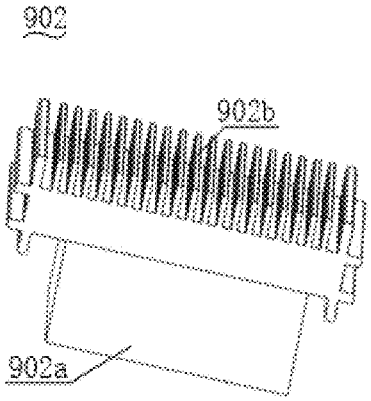
FIG. 53 is a perspective view of a second control board assembly according to an embodiment.
Figure 54:
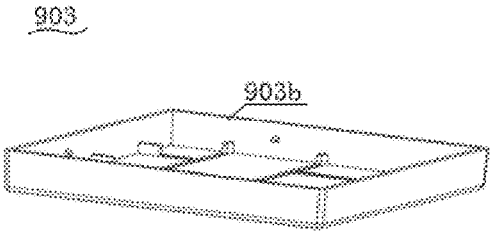
FIG. 54 is a perspective view of a second housing according to an embodiment.
Figure 55:
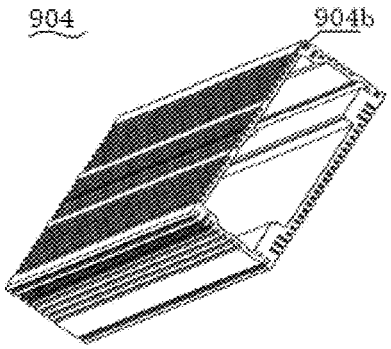
FIG. 55 is a perspective view of a second heat dissipation piece according to an embodiment.
Figure 56:
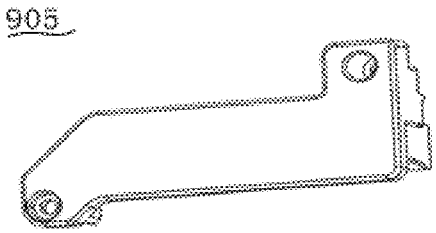
FIG. 56 is a perspective view of a circuit board base according to an embodiment.
Figure 57:
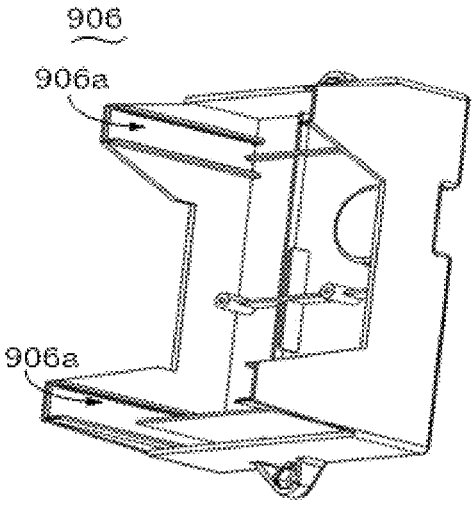
FIG. 57 is a perspective view of a connecting base according to an embodiment.
Figure 58:
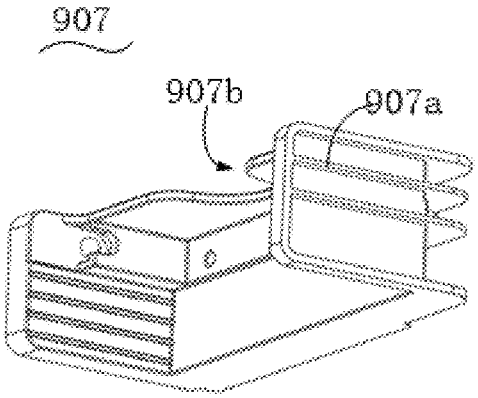
FIG. 58 is a perspective view of a fixed base according to an embodiment.

Please refer to FIG. 1 and FIG. 51. the first control board 901*a*, second control board 902*a* and fourth control board 904*a* are all connected with the third control board 903*a* to realize a connection of the battery assembly 40 with the power assembly 30, the wheel assembly 50 and the control assembly 60, which enables the battery assembly 40 to supply power for the power assembly 30, the wheel assembly 50 and the control assembly 60.

Please refer to FIG. 43 through FIG. 58. In this embodiment, the control board assembly is arranged in the closed chassis 80 which is dust-proof and waterproof. A plurality of control boards are respectively placed close to different side walls of the chassis 80, instead of on a side wall of the fan 900, so as to fully and reasonably utilize a space in the chassis 80. Moreover, a plurality of the control boards are arranged below the battery 410, which facilitates a connection between the battery 410 and the control boards, and enables a circuit arrangement to be simple and orderly. The control board assembly is arranged in the chassis 80, and the wheel hub motor 501 is located in a wheel 500, so that the fourth control board 904*a* is conveniently connected with the wheel hub motor 501. The chassis 80 is located in a middle of the snow thrower 1, and the control board assembly is arranged in the chassis 80, so that an arrangement of the overall circuit wires is shorter, which saves materials and reduces costs. The fan 900 is arranged at an end of the second rotation shaft 302 and is located in the chassis 80 to dissipate heat for the control board in the chassis 80, which reduces a loss of the control board and a maintenance cost. In addition, the fan 900 can further dissipate heat from the pulley and the belt, thereby reducing a loss of the belt and prolonging the duration life of the belt.

Figure 59:
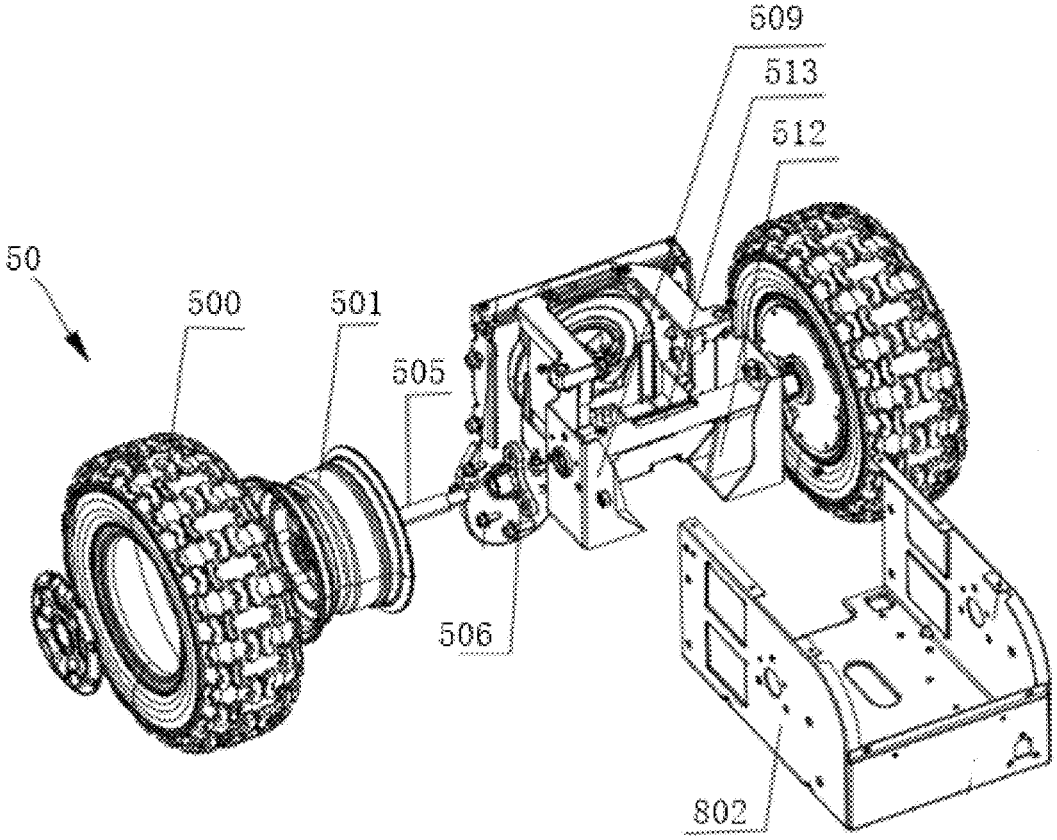
FIG. 59 is a perspective view of a wheel assembly according to an embodiment.
Figure 60:
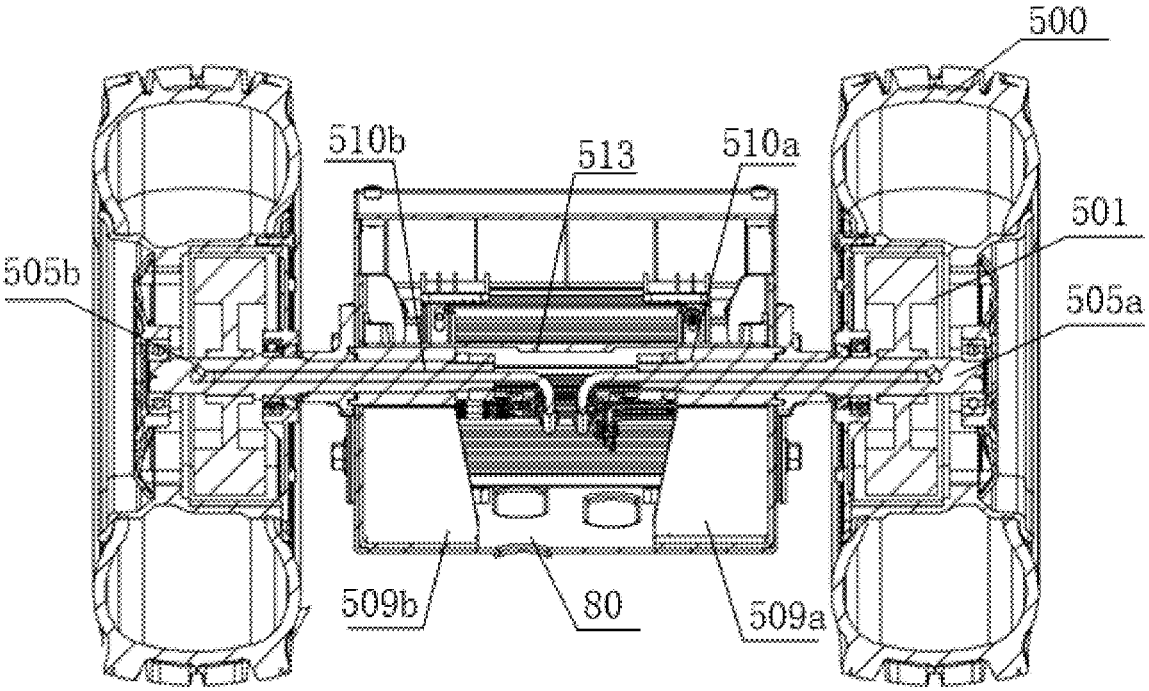
FIG. 60 is a sectional view of the wheel assembly according to an embodiment.

Please refer to FIG. 59 and FIG. 60. In an embodiment of the disclosure, the wheel assembly 50 includes the wheel 500, the wheel hub motor 501 and the fixed part. An output shaft 505 of the wheel hub motor 501 is connected with the chassis 80, and the wheel hub motor 501 is connected with the control assembly 60 and the control board assembly, in order to control the wheel hub motor 501 to work through the control assembly 60 and the control board assembly. The wheel hub motor 501 is connected with the fourth control board 904*a*, so as to adjust the on-and-off, rotation speed, etc. of the wheel hub motor 501. The wheel 500 is connected with the wheel hub motor 501, which allows the wheel hub motor 501 to drive the wheel 500 to rotate. The fixed part is connected with the output shaft 505 on the chassis 80, which greatly ensures a stability of the hand push outdoor tool during traveling, steering and speed adjustion. The wheel hub motor 501 is provided at least two, such as two, four, etc. A plurality of wheel hub motors 501 are evenly arranged on two opposite sides of the chassis 80, and the plurality of wheel hub motors 501 are independently controlled. In this embodiment, wheel hub motors 501 are respectively coupled to two opposite sides of the chassis 80, and a wheel 500 is coupled to each wheel hub motor 501. Each wheel hub motor 501 is independently controlled. A forward, backward and steering of the snow thrower 1 is realized through independently controlling the rotation speed of each wheel hub motor 501.

Please refer to FIG. 44, FIG. 59 and FIG. 60. In an embodiment of the disclosure, wheel hub motors 501 are respectively coupled to both sides of the chassis 80. The wheel 500 is coupled to each wheel hub motor 501, and the wheel hub motor 501 is allowed to drive the wheel 500 to rotate. In this embodiment, the output shaft 505 of the wheel hub motor 501 passes through the first through hole 802*a* on the main housing 802 and is connected on the main housing 802, and the wheel 500 is sleeved on the wheel hub motor 501 and is connected with the wheel hub motor 501. There is a certain gap between the wheel 500 and an outer side wall of the main housing 802. A distance range of the gap is, for example, from 1 mm to 15 mm, so as to ensure that when the wheel 500 rotates at a high speed, the wheel 500 is prevented from being worn, which ensures a stability and avoid a subversion and overturn. A central through hole is further arranged inside the output shaft 505, and an electric wire passes through the central through hole to connect the wheel hub motor 501 with the control assembly 60, the control board assembly and the battery assembly 40. In this embodiment, the two wheel hub motors 501 are driven independently. The output shaft 505 includes a first output shaft 505*a* and a second output shaft 505*b*. The first output shaft 505*a* is connected with the wheel hub motor 501, the second output shaft 505*b* is connected with another wheel hub motor 501, and the first output shaft 505*a* and the second output shaft 505*b* are coaxially arranged.

Figure 61:
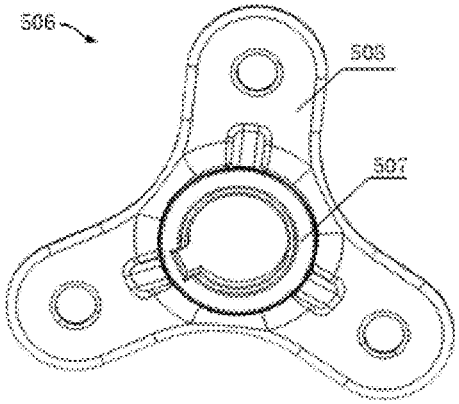
FIG. 61 is a perspective view of an axle fixed base according to an embodiment.

Please refer to FIG. 59 through FIG. 61. In an embodiment of the disclosure, the fixed part includes an axle fixed base 506 arranged between the wheel 500 and the outer side wall of the main housing 802. Each axle fixed base 506 includes a first fixed component 507 and a plurality of third connecting components 508. The first fixed component 507 is provided with a through hole with a certain diameter and depth. The through hole with the certain diameter and depth on the first fixed component 507 is sleeved on the output shaft 505. The third connecting components 508 are arranged on a periphery of the first fixed component 507. In this embodiment, the plurality of the third connecting components 508 are evenly distributed around the first fixed component 507, and the third connecting components 508 are connected with the main housing 802 through bolts, thereby connecting the wheel 500 with the chassis 80. The number of the third connecting components 508 is three.

Please refer to FIG. 59 through FIG. 63. In an embodiment of the disclosure, the fixed part includes a supporting base 509 arranged in the chassis 80 and a shaft sleeve 510 arranged on the supporting base 509. The supporting base 509 includes a first supporting base 509*a* and a second supporting base 509*b*. A first shaft sleeve 510*a* is connected with the first supporting base 509*a*, and a second shaft sleeve 510*b* is connected with the second supporting base 509*b*. In this embodiment, the first output shaft 505*a* and the second output shaft 505*b* pass through the first through hole 802*a* into the chassis 80, the first output shaft 505*a* protrudes into the first shaft sleeve 510*a*, and the second output shaft 505*b* protrudes into the second shaft sleeve 510*b*. The first shaft sleeve 510*a* is sleeved on the first output shaft 505*a*, and the first output shaft 505*a* is connected with the first shaft sleeve 510*a*. The second shaft sleeve 510*b* is sleeved on the second output shaft 505*b*, and the second output shaft 505*b* is connected with the second shaft sleeve 510*b*. The shaft sleeve 510 and the axle fixed base 506 effectively ensure that the first output shaft 505*a* and the second output shaft 505*b* are arranged coaxially, thereby ensuring that the wheel hub motors 501 in the two wheels 500 are arranged coaxially and the two independent wheel hub motors 501 coaxially rotates. In addition, the two shaft sleeves 510 play a role of supporting and fixing the output shaft 505 of the wheel hub motor 501, which can prevent the output shaft 505 from swinging.

Figure 62:
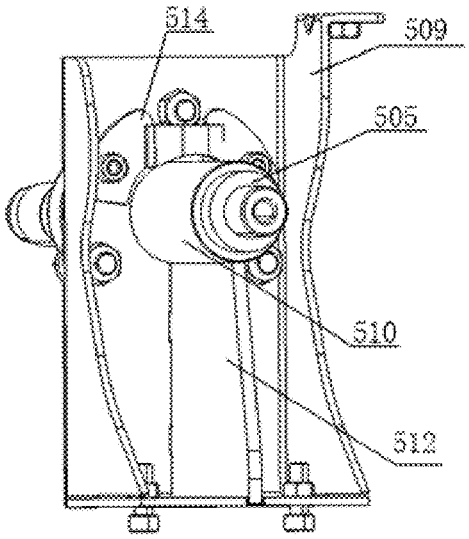
FIG. 62 is a perspective view of a part of the fixed part according to an embodiment.
Figure 63:
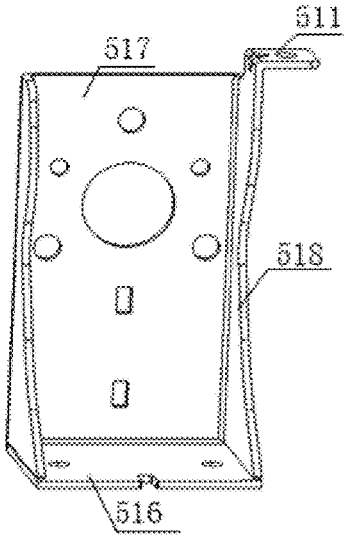
FIG. 63 is a perspective view of a supporting base according to an embodiment.
Figure 64:
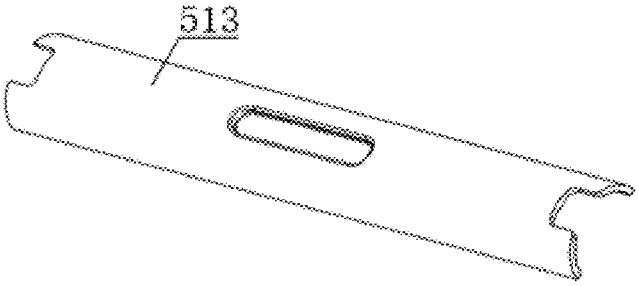
FIG. 64 is a view of a connecting plate mechanism according to an embodiment.
Figure 65:
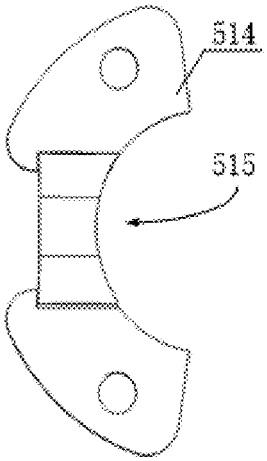
FIG. 65 is a perspective view of a third fixed component according to an embodiment.

Specifically, please refer to FIG. 59 and FIG. 62. In an embodiment of the disclosure, the supporting base 509 includes a first plane 516 and a second plane 517. The first plane 516 is attached a bottom wall of the main housing 802, and the first plane 516 is fixed on the bottom wall of the main housing 802 by bolts. The second plane 517 is connected with the first plane 516, the second plane 517 is attached to the side wall of the main housing 802, and the second plane 517 is fixed on the side wall of the main housing 802 by bolts. The shaft sleeve 510 is fixed on the second plane 517, and the shaft sleeve 510 is parallel to the first plane 516 and perpendicular to the second plane 517. The supporting base 509 is further provided with two third planes 518. The third planes 518 are connected with the first plane 516 and the second plane 517 and are used for supporting the first plane 516 and the second plane 517. The third plane 518 is triangular to enable the supporting base 509 to be more stable. In an embodiment, the first plane 516, the second plane 517 and the two third planes 518 are integrally formed.

Please refer to FIG. 59 through FIG. 63. In an embodiment of the disclosure, a second fixed component 511 is further arranged on the supporting base 509. The second fixed component 511 is arranged on the third plane 518. The second fixed component 511 may be integrally formed with the third plane 518. The second fixed component 511 is connected with the connecting base 905, and the second fixed component 511 is used for fixing the connecting base 905. When the whole machine is working, a force on the connecting base 509 may be transmitted to other components along the fixed connecting base 905 through the second fixed component 511.

Please refer to FIG. 59 through FIG. 63. In an embodiment of the disclosure, a supporting plate 512 is arranged on the supporting base 509. The supporting plate 512 is parallel to the third plane 518 and is connected with the first plane 516 and the shaft sleeve 510. In this embodiment, the supporting plate 512 is connected with the first plane 516, the second plane 517 and the first shaft sleeve 510*a* or the second shaft sleeve 510*b*. The supporting plate 512 is arranged between the first plane 516 and the shaft sleeve 510 to support the shaft sleeve 510, so the supporting plate 512 may prevent the output shaft 505 in the shaft sleeve 510 from swinging toward a direction of the first plane 516, which further strengthens a supporting and fixation of the output shaft 505. Of course, in other embodiments, the supporting plate 512 may directly support between the shaft sleeve 510 and the chassis 80, which means that an end of the supporting plate 512 is connected with the shaft sleeve 510 and the other end of the supporting plate 512 is directly connected with the chassis 80.

Please refer to FIG. 59 through FIG. 65. In an embodiment of the disclosure, the connecting plate 513 is further arranged on a side of the shaft sleeve 510 opposite to the supporting plate 512, and a shape of the connecting plate 513 is adapted to the shaft sleeve 510. Across section of the connecting plate 513 is semicircular. The connecting plate 513 covers a side of the first shaft sleeve 510*a* and the second shaft sleeve 510*b* opposite to the supporting plate 512, and an inner wall of the connecting plate 513 is fitted with the shaft sleeve 510. Both ends of the connecting plate 513 are close to an inner side wall of the main housing 802, and the two ends of the connecting plate 513 are fixed through the third fixed component 514. Two third fixed components 514 are further arranged on the two opposite inner side walls of the main housing 802, and the connecting plate 513 is pressed onto the shaft sleeve 510 by the third fixed components 514. In this embodiment, both ends of the third fixed component 514 are fixed on the main housing 802 by bolts, and the third fixed component 514 is provided with a circular arc end 515 which is compatible with the connecting plate 513, which means that the circular arc end 515 of the third fixed component 514 is attached to the connecting plate 513. The connecting plate 513 is clamped between the third fixed component 514 and the shaft sleeve 510, and the circular arc end 515 presses the connecting plate 513 towards the first shaft sleeve 510*a* and the second shaft sleeve 510*b* more effectively. By arranging the third fixed component 514 on an opposite side of the first plane 516 and pressing the connecting plate 513 on the shaft sleeve 510 through the third fixed component 514, the output shaft 505 in the shaft sleeve 510 may be prevented from moving towards the opposite side of the first plane 516. In addition, the first supporting base 509*a*, the connecting plate 513, the second supporting base 509*b* and the main housing 802 define a closed frame structure on a section where the output shaft 505 is located, which effectively ensures a force strength of the wheel hub motors 501 on both sides, and can prevent the two output shafts 505 of the wheel hub motors 501 from swinging up and down. This greatly improves a running stability of the wheel hub motors 501, and avoids a phenomenon that the chassis 80 is pulled due to the swinging of the output shafts 505 and avoid a deformation of the chassis 80.

Figure 66:
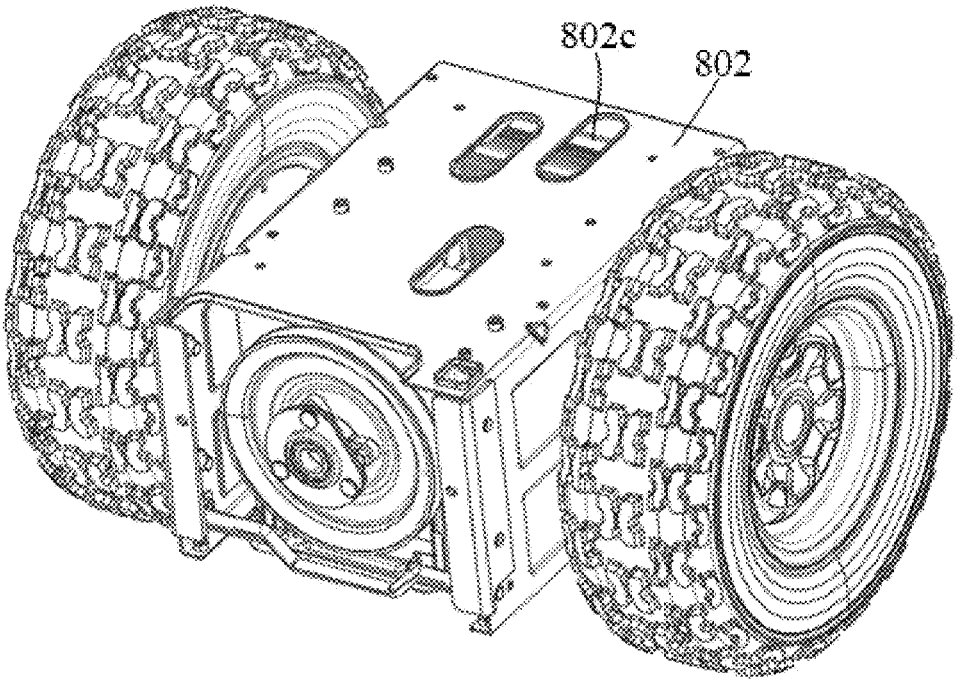
FIG. 66 is a perspective view of a circuit hole according to an embodiment.
Figure 67:
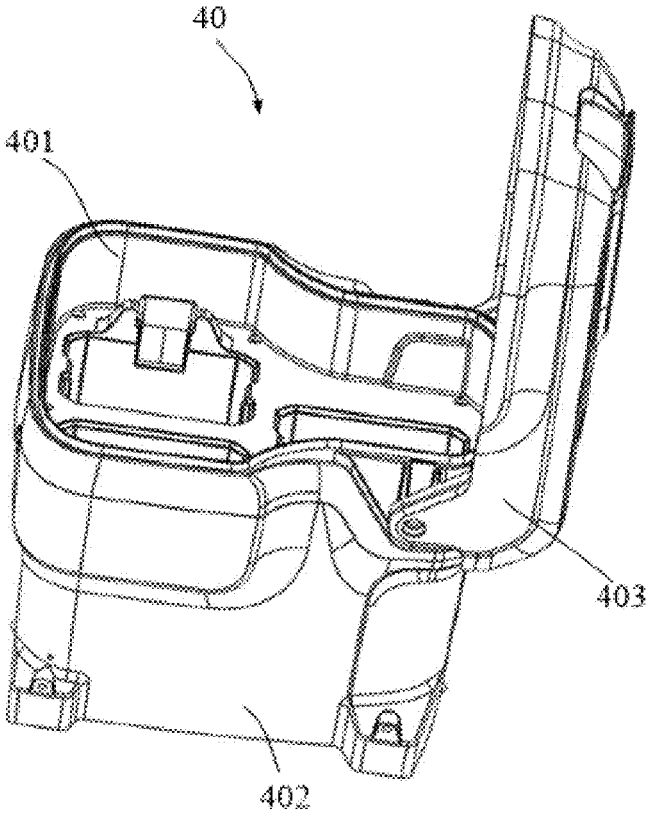
FIG. 67 is a perspective view of a battery assembly according to an embodiment.
Figure 68:
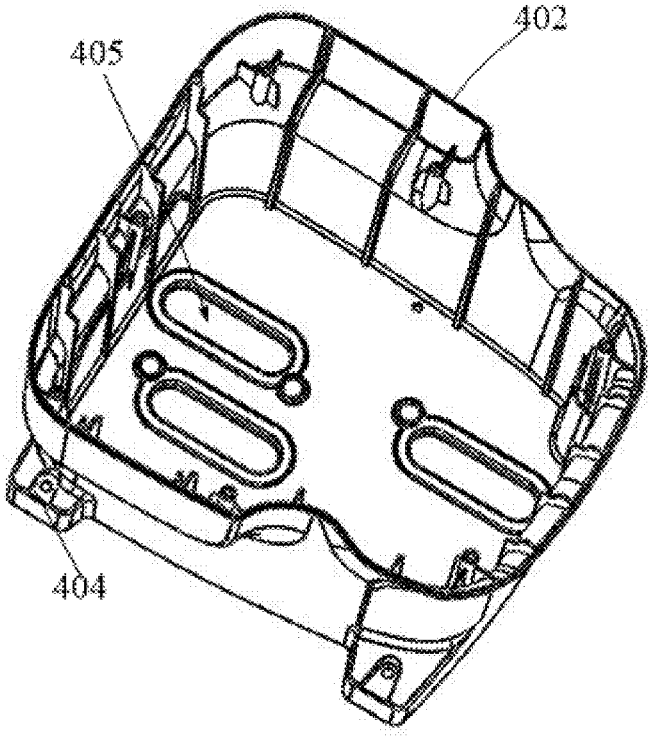
FIG. 68 is a perspective view of a base according to an embodiment.
Figure 69:
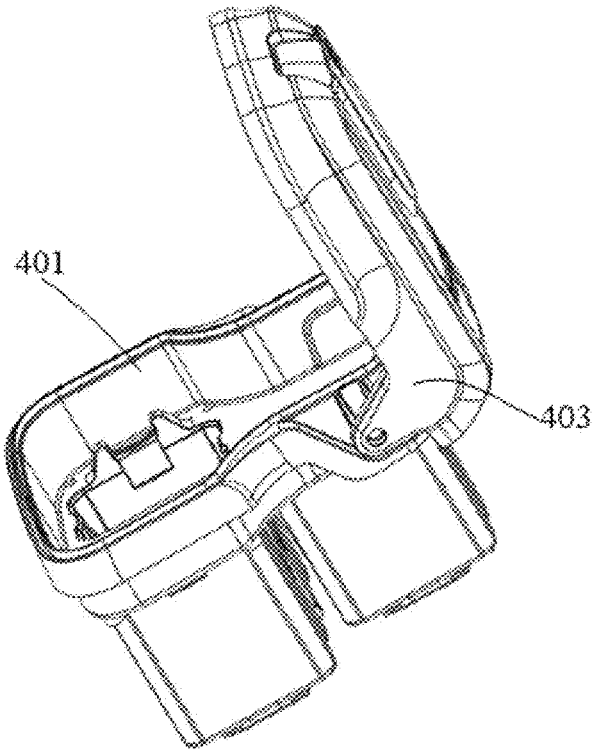
FIG. 69 is a perspective view of a battery housing and a cover according to an embodiment.

Please refer to FIG. 66. In this embodiment, a top of the main housing 802 is further provided with a plurality of circuit holes 802*c*, and control components in the chassis 80 are connected with the battery assembly 40 through the circuit holes 802*c*. In this embodiment, three circuit holes 802*c* are arranged on the top of the main housing 802, of course, more circuit holes 802*c* may also be arranged.

Please refer to FIG. 67 through FIG. 71. In this embodiment, the battery assembly 40 may include a battery 410, a base 402, a battery housing 401 and a cover 403. The battery 410 may be a single battery 410 or multiple batteries 410. The battery housing 401 is located in the base 402. The battery housing 401 protrudes from the base 402, and the cover 403 is arranged on the battery housing 401.

Please refer to FIG. 67 through FIG. 71. In this embodiment, a bottom of the base 402 is provided with a plurality of first fixed parts 404. The first fixed part 404 is provided with fixed holes, which means that the base 402 is fixed on the main housing 802 through the first fixed parts 404, for example, bolts are arranged on the fixed holes, so that the base 402 is fixed on the main housing 802. A plurality of connecting holes 405 are further arranged on a bottom of the base 402. The connection holes 405 may correspond to the circuit holes 802*c* on the main housing 802, that is to say, the number of the connection holes 405 may be equal to the number of the circuit holes 802*c*, so that the battery is connected with the control components in the chassis 80.

Please refer to FIG. 67 through FIG. 71. In this embodiment, the cover 403 is rotably arranged on the battery housing 401, so the cover 403 may cover a top of the battery housing 401. A waterproof structure (ie, a step on the battery housing 401) is defined between the cover 403 and the battery housing 401. The battery housing 401 and the cover 403 are further provided with mutually matched magnetic components, so that the cover 403 may be attracted to the battery housing 401. Three battery cavities 406 are arranged in the battery housing 401, and the three battery cavities 406 have the same structure. The battery cavity 406 is provided with a bounce structure 408 and a terminal 409. The bounce structure 408 is located on a side of the terminal 409. In this embodiment, an inlet gap is defined between the terminal 409 and the battery cavity 406, and the inlet gap communicates with the connecting holes 405 and the circuit holes 802*c*. A fixed button 407 is arranged on a top of the battery cavity 406. When the battery is placed in the battery cavity 406, a connecting terminal of the battery 410 are connected with the terminal 409. When the fixed button 407 is pressed, the battery 410 is lifted up by the bounce structure 408, so that the battery 410 can be taken out.

Please refer to FIG. 67 through FIG. 71. In this embodiment, when the battery 410 is placed in the battery housing 401, the connecting terminals on the battery 410 are connected with the terminals 409, and the connecting holes 405 and the circuit holes 802*c* enable the battery to be connected with control components in the chassis 80 through the terminal 409. Therefore, when the snow thrower 1 is in a working state, cold air generated by the fan 900 in the chassis 80 may enter the battery cavity 406 through the circuit holes 802*c*, the connecting holes 405 and the inlet gap of the battery cavity 406, so as to dissipate heat for the battery 410.

Please refer to FIG. 67 through FIG. 71. The battery assembly 40 is provided with, for example, three batteries 410, and the three batteries 410 are arranged in the battery housing 401. A battery 410 is shown in FIG. 26 as an embodiment. Three battery cavities 406 are correspondingly arranged in the battery housing 401, which means that each battery cavity 406 is provided with one battery 410. With an arrangement position of the battery 410 and the battery cavities 406, when the battery 410 is placed in the battery cavity 406, a center of gravity of the battery housing 401 may be located on a central axis of a forward direction of the snow thrower, which means that a center of gravity of the battery assembly 40 is located on the central axis in the forward direction of the snow thrower, so a stability of the snow thrower may be improved.

Figure 70:
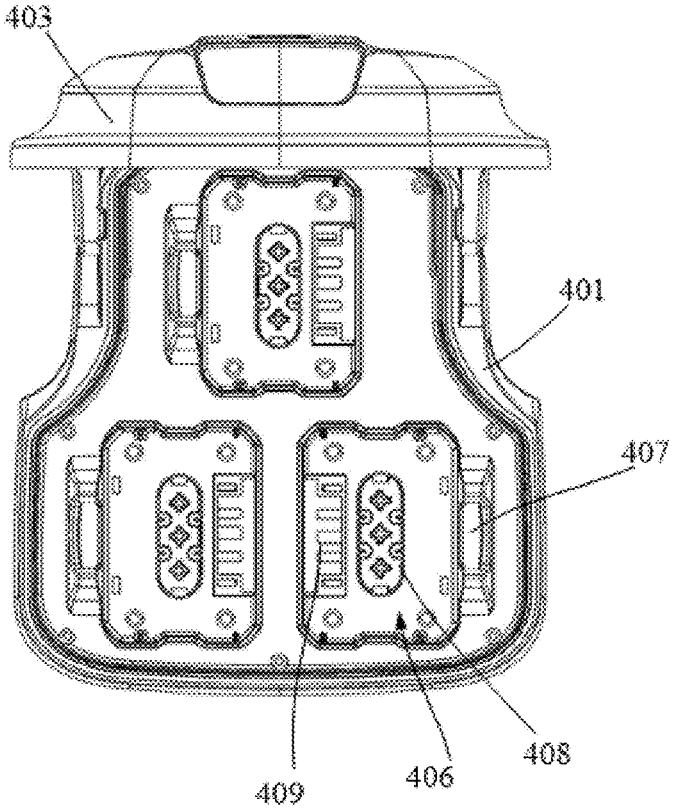
FIG. 70 is a top view of the battery assembly according to an embodiment.
Figure 71:
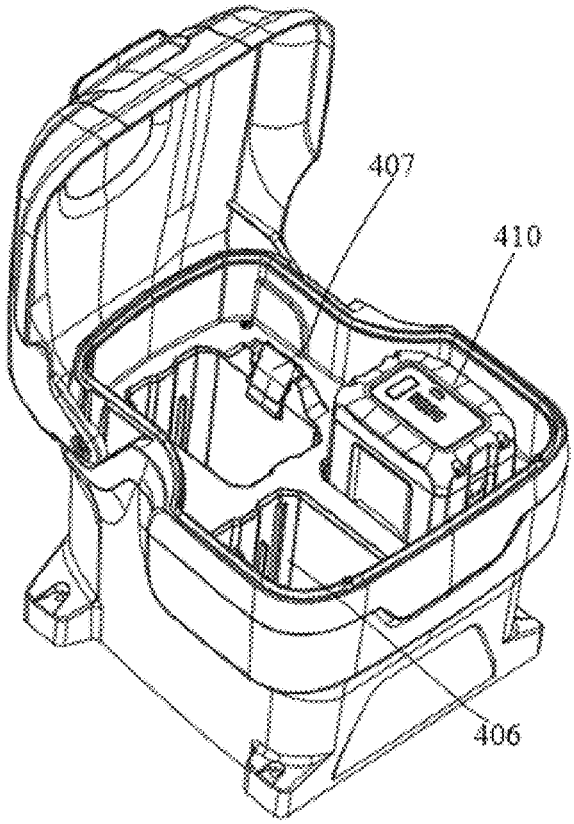
FIG. 71 is a schematic view of a battery according to an embodiment.

Please refer to FIG. 67 through FIG. 71. Three battery cavities 406 are shown in FIG. 70, which means that three batteries may be arranged in the battery housing 401. The three battery cavities 406 are arranged in two rows, for example. With this arrangement, a structure of the battery housing 401 may be more compact, and the center of gravity of the battery housing 401 may be located on the central axis in the forward direction of the snow thrower.

Figure 72:
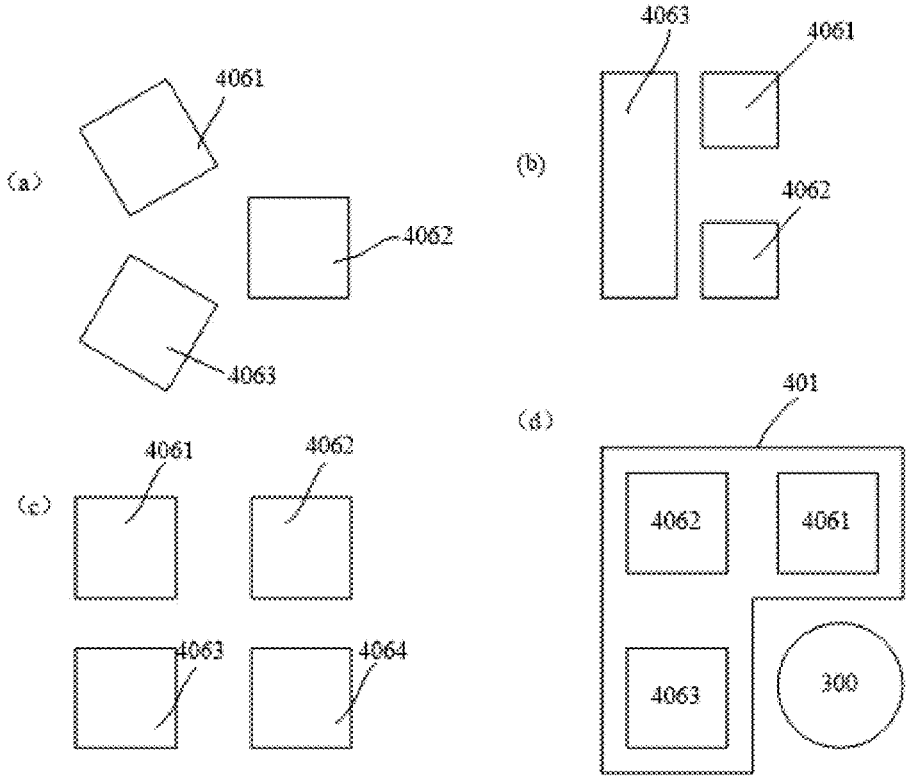
FIG. 72 is a top view of a battery set according to an embodiment.

Please refer to FIG. 72. FIG. 72 shows a top view of the battery. FIG. 72(*a*) shows an arrangement of a first battery 4061, a second battery 4062, and a third battery 4063. The first battery 4061, the second battery 4062 and the third battery 4063 may be arranged at an angle, for example, the angles among the first battery 4061, the second battery 4062 and the third battery 4063 are 120°. The first battery 4061 and the third battery 4063 may be defined as a first battery set, the second battery 4062 may be defined as a second battery set. The center of gravity of the first battery set and the center of gravity of the second battery set may be located on the central axis in the forward direction of the snow thrower. FIG. 72(*b*) shows another arrangement of the first battery 4061, the second battery 4062 and the third battery 4063. Volumes of the first battery 4061 and the second battery 4062 are the same, and the volume of the first battery 4061 is smaller than a volume of the third battery 4062. The first battery 4061 and the second battery 4062 may be the first battery set, the third battery 4063 may be the second battery set. The center of gravity of the first battery set and the center of gravity of the second battery set may be located on the central axis in the forward direction of the snow thrower. FIG. 72(*c*) shows an arrangement of the first battery 4061, the second battery 4062, the third battery 4063 and a fourth battery 4064. The first battery 4061, the second battery 4062, the third battery 4063 and the fourth battery 4064 may be arranged in a matrix. The first battery 4061 and the third battery 4063 may be the first battery set, the second battery 4062 and the fourth battery 4064 may be the second battery set. The center of gravity of the first battery set and the center of gravity of the second battery set may be located on the central axis in the forward direction of the snow thrower. FIG. 72(*d*) shows an arrangement of the first battery 4061, the second battery 4062 and the third battery 4063. The first battery 4061, the second battery 4062 and the third battery 4063 may be arranged step-shaped, and the first motor 300 may also be arranged on the step. The first battery 4061 and the first motor 300 may be a first battery set, and the second battery 4062 and the third battery 4063 may be a second battery set. The center of gravity of the first battery set and the center of gravity of the second battery set may be located on the central axis in the forward direction of the snow thrower. Through the above arrangement, a center of gravity of the battery assembly may be located on the central axis in the forward direction of the snow thrower. It should be noted that the arrangement of the batteries in FIG. 72 is only an embodiment and not a limitation of the disclosure. In some embodiments, a plurality of batteries may also be arranged in a stack, or only one battery may be arranged in the battery housing.

Please refer to FIG. 1 through FIG. 43. In this embodiment, when the battery assembly 40 is mounted on the chassis 80, the battery assembly 40 is arranged outside the chassis 80, so it is easier to replace the battery. Wheel assemblies 50 are further provided on both sides of the chassis 80, and the wheel assemblies 50 may include wheel hub motors and wheels 500 arranged on the wheel hub motors. When the battery assembly 40 is arranged on the chassis 80, the center of gravity of the battery assembly 40 can be located on the central axis in the forward direction of the snow thrower, and the battery assembly 40 is located at an upper position of the wheel assembly 50. Therefore, a balance of a center of gravity of the entire snow thrower 1 may be increased, the snow thrower 1 will not be misplaced or deflected in a process of traveling, and the battery assembly 40 may increase a friction between the wheel 500 and the ground, and it is not easy to slip.

Figure 73:
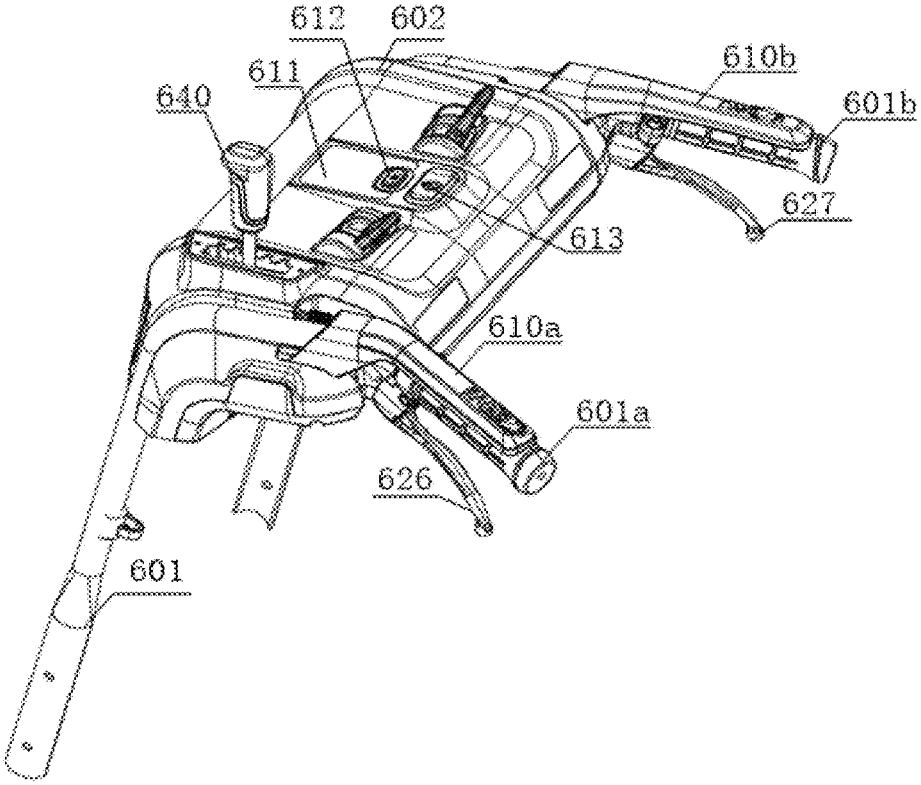
FIG. 73 is a perspective view of a control assembly according to an embodiment.

Please refer to FIG. 1, FIG. 43 and FIG. 73. In an embodiment of the disclosure, the control assembly 60 includes the operation handle 601, the operation console 602 and a plurality of operating components on the operation console 602. A second connecting component 600 is fixedly connected on a side of the chassis 80 away from the working assembly. One end of the operation handle 601 is connected with the second connecting component 600, the other end of the operation handle 601 extends away along an obliquely upper direction of the chassis 80, and a height of the other end of the operation handle 601 is adapted to a height of a human's elbow. In this embodiment, the number of the operation handles 601 is, for example, two, and the two operation handles 601 are arranged in parallel.

Further, please refer to FIG. 73. The operation console 602 is arranged at an end of the operation handle 601 away from the chassis 80. In some embodiments, the operation console 602 is arranged between the two operation handles 601, and the operating components on the operation console 602 are connected with the control board assembly and the battery 410. The operation console 602 is further provided with a plurality of operating components for adjusting a working state of the snow thrower 1. In an embodiment of the disclosure, the operation console 602 and the operating components on it are used to control an on-and-off of the snow thrower 1, the first motor 300 and the wheel hub motor 501, adjust a steering speed and steering direction of the first motor 300 and the wheel hub motor 501, and show a power of the battery and so on.

Figure 74:
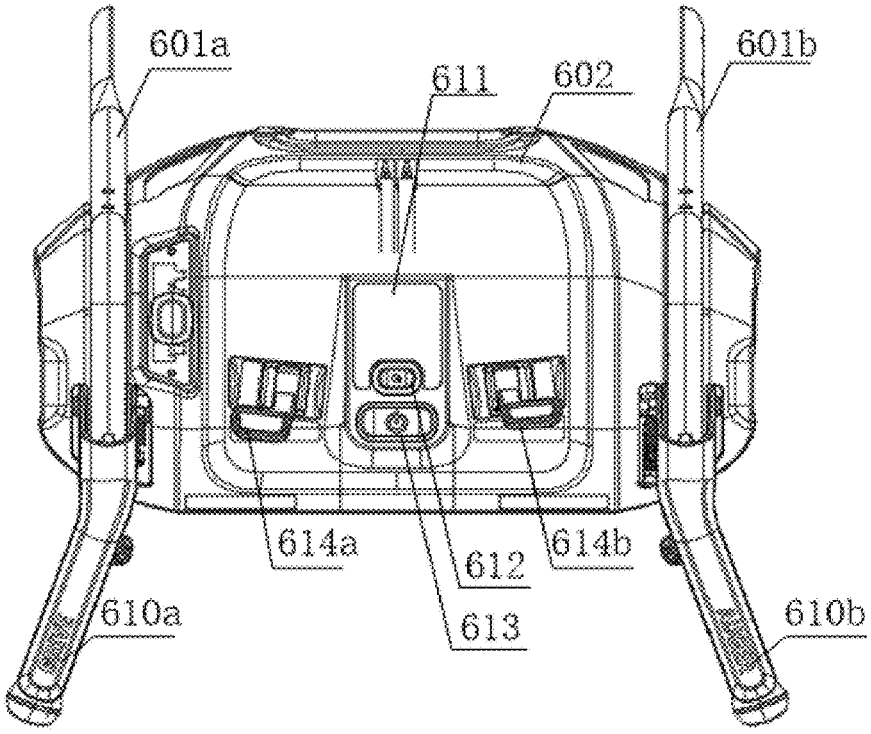
FIG. 74 is a top view of the control assembly according to an embodiment.
Figure 75:
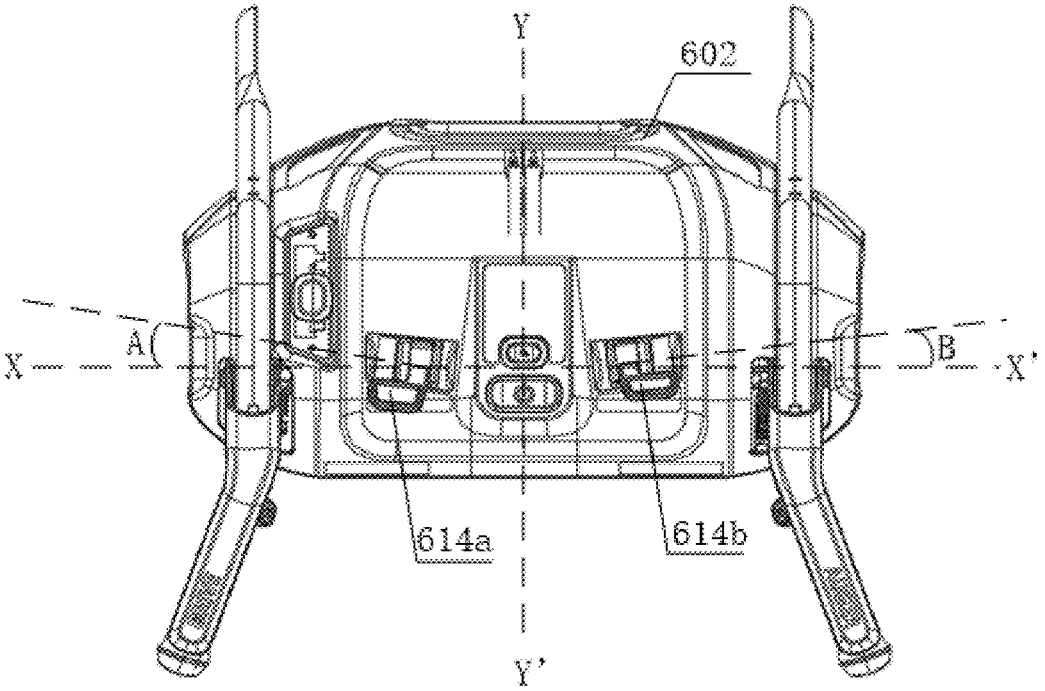
FIG. 75 is an identification view of a first angle and a second angle according to an embodiment.

Please refer to FIG. 43, FIG. 73 and FIG. 74, in an embodiment of the disclosure, the operation handle 601 includes a first operation handle 601*a* and a second operation handle 601*b*. An end of the first operation handle 601*a* is fixed on the chassis 80 through the second connecting component 600, and the other end of the first operation handle 60 extends toward a side of the chassis 80 opposite to a working end of the snow thrower. An end of the second operation handle 601*b* is also fixed on the chassis 80 through the second connecting component 600, and the other end of the second operation handle 601*b* extends toward the side of the chassis 80 opposite to the working end of the snow thrower. In some embodiments, the first operation handle 601*a* and the second operation handle 601*b* are symmetrically arranged with respect to a central axis of the operation console 602. The end of the first operation handle 601*a* and the second operation handle 601*b* close to the operation console 602 is a lifting part of the snow thrower. The operation console 602 is fixed on the operation handle 601 and is located on a side of the operation handle 601 away from the chassis 80. In some embodiments, the operation console 602 is located between the first operation handle 601*a* and the second operation handle 601*b*, and two sides of the operation console 602 are respectively connected with the first operation handle 601*a* and the second operation handle 601*b*.

Please refer to FIG. 73 through FIG. 76. In an embodiment of the disclosure, the first operation handle 601*a* and the second operation handle 601*b* are respectively provided with a first trigger 610*a* and a second trigger 610*b*, and pressing the first trigger 610*a* and the second trigger 610*b* may trigger an on-and-off of the first motor 300 and the wheel hub motor 501 respectively. The first trigger 610*a* is arranged at an end of the first operation handle 601*a* away from the second connecting component 600. An end of the first trigger 610*a* is located above the operation console 602, and the other end of the first trigger 610*a* passes through the operation console 602 and is rotatably connected with the operation console 602 through a linkage shaft 620. The second trigger 610*b* is arranged above the second operation handle 601*b*, an end of the second trigger 610*b* is located above the operation console 602, and the other end of the second trigger 610*b* is rotatably connected with the operation console 602 through the linkage shaft 620. The linkage shaft 620 is arranged at a bottom of the operation console 602, and an end of the linkage shaft 620 is connected with the first trigger 610*a*, which allows the first trigger 610*a* to drive the linkage shaft 620 to rotate. The other end of the linkage shaft 620 is rotatably connected with the second trigger 610*b*. Tensioning devices (not shown in the figure) are further arranged on the first trigger 610*a* and the second trigger 610*b*. When no force is exerted on the first trigger 610*a* and the second trigger 610*b*, an end of the first trigger 610*a* is away from a lifting part of the first operation handle 601*a*, and an end of the second trigger 610*b* is away from the lifting part of the first operation handle 601*a*.

Figure 78:
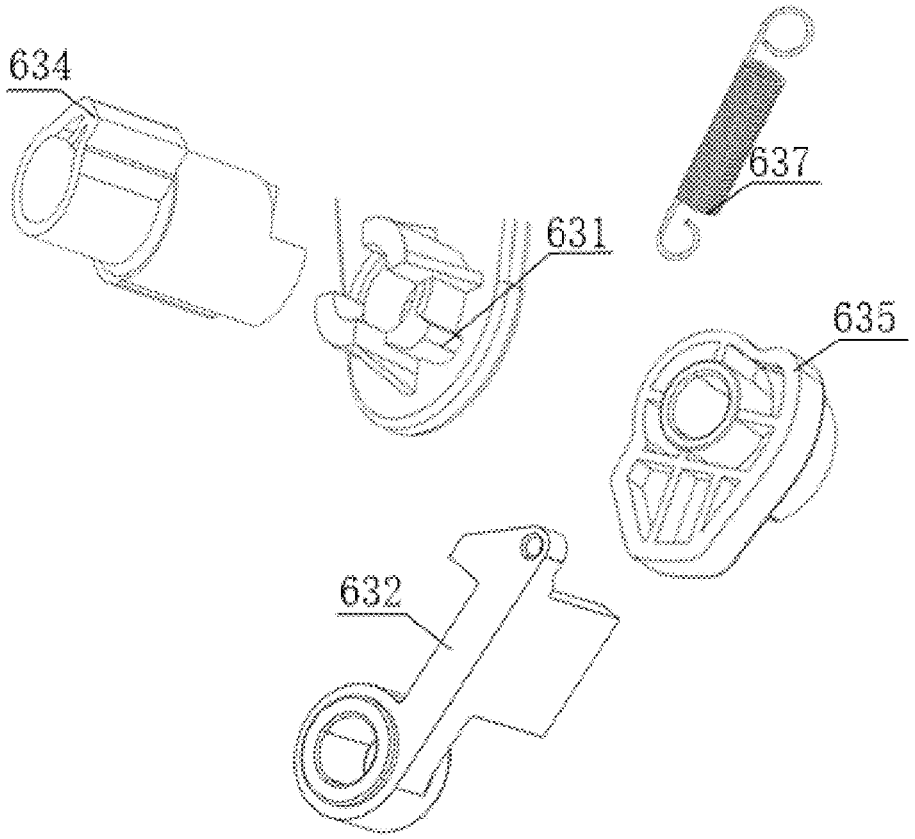
FIG. 78 is an exploded view of the interlocking structure according to an embodiment.
Figure 79:
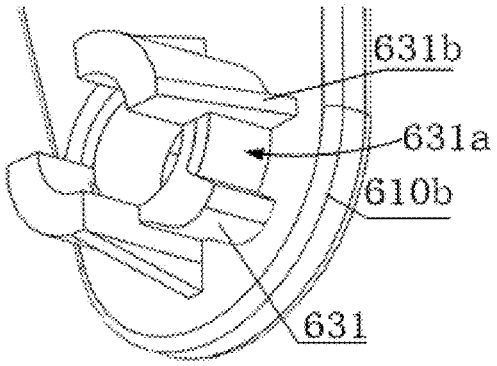
FIG. 79 is a perspective view of a partial second trigger according to an embodiment.
Figure 80:
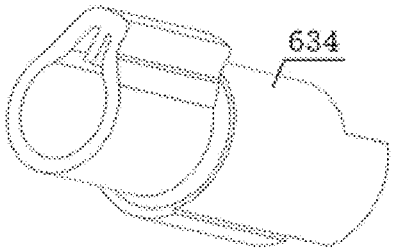
FIG. 80 is a perspective view of a rotation sleeve according to an embodiment.
Figure 81:
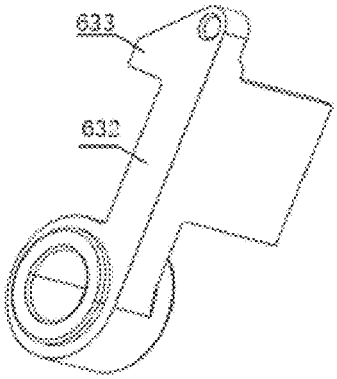
FIG. 81 is a perspective view of a rotation block according to an embodiment.
Figure 82:
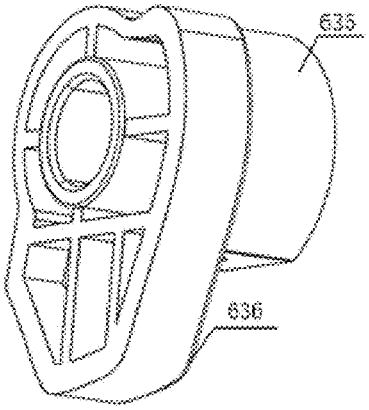
FIG. 82 is a perspective view of a cam according to an embodiment.

Please refer to FIG. 73 through FIG. 77. In an embodiment of the disclosure, at least two triggering devices are connected with the linkage shaft 620, and the two triggering devices include a first triggering device 621 and a second triggering device 622. The first triggering device 621 is connected with the linkage shaft 620. When the linkage shaft 620 rotates, the first triggering device 621 rotates with the linkage shaft 620. The second triggering device 622 is fixed on a connecting sleeve 634, and the connecting sleeve 634 is rotatably connected with the linkage shaft 620. An end of the connecting sleeve 634 is clamped with the second trigger 610*b*, which allows the second trigger 610*b* to drive the connecting sleeve 634 to rotate on the linkage shaft 620, thereby driving the second triggering device 622 to rotate. When only the linkage shaft 620 rotates without pressing the second trigger 610*b*, the second triggering device 622 does not work. As shown in FIG. 78 and FIG. 79, an end of the connecting sleeve 634 is clamped with a clamping component 631*b* on the second trigger 610*b*.

Please refer to FIG. 73 through FIG. 77. In an embodiment of the disclosure, corresponding to the triggering device, a plurality of switches, including a first switch 623 and a second switch 624, are fixed on the operation console 602. The first switch 623 is fixed on the bottom of the operation console 602 and is close to the first triggering device 621. The second switch 624 is fixed on the bottom of the operation console 602 and is close to the second triggering device 622. When the first trigger 610*a* rotates, the linkage shaft 620 is driven to rotate. The first triggering device 621 arranged on the linkage shaft 620 triggers the first switch 623. When the second trigger 610*b* rotates, the connecting sleeve 634 is driven to rotate. The second triggering device 622 connected on the connecting sleeve 634 triggers the second switch 624. Wherein, the first switch 623 is a switch of the wheel hub motor 501 and is used to control an on-and-off of the wheel hub motor 501. The second switch 624 is a switch of the first motor 300 for controlling an on-and-off of the first motor 300.

Please refer to FIG. 73 through FIG. 82. In an embodiment of the disclosure, an interlocking structure 630 is further arranged on the linkage shaft 620, so that a single handle may control a state of the first trigger 610*a* and the second trigger 610*b* at the same time. The interlocking structure 630 provided in the disclosure includes a clamping block 631, a rotation block 632 and a cam 635. The clamping block 631 is arranged at a connection end of the second trigger 610*b* connected with the linkage shaft 620. The clamping block 631 extends out of a plane the second trigger 610*b* located, and defines a first concave part 631*a* with the clamping component 631*b* on the second trigger 610*b*. The clamping block 631 rotates with a rotation of the linkage shaft 620. When the second trigger 610*b* is away from the second operation handle 601*b*, the rotation block 632 is located above the clamping block 631. When the second trigger 610*b* is pressed down until it contacts the second operation handle 601*b*, the rotation block 632 is clamped with the clamping block 631, which means that a first protruding part 633 is clamped with the first concave part 631*a*. The rotation block 632 is movably connected with the operation console 602 and is close to the clamping block 631. An end of the rotation block 632 is rotatably connected with the operation console 602, and the other end of the rotation block 632 is connected with the operation console 602 through a spring 637. The rotation block 632 is provided with the first protruding part 633, and allows the first protruding part 633 to be clamped with the clamping block 631. The cam 635 is connected with the linkage shaft 620, and the cam 635 is located at an end of the linkage shaft 620 connected with the second trigger 610*b*. A second protruding part 636 is arranged on the cam 635, and the second protruding part 636 is close to the rotation block 632. When the first trigger 610*a* is away from the first operation handle 601*a*, the second protruding part 636 on the cam 635 pushes the rotation block 632 away from the linkage shaft 620, so that the first protruding part 633 on the rotation block 632 is away from the clamping block 631. When the first trigger 610*a* is pressed down until it contacts the first operation handle 601*a*, the second protruding part 636 on the cam 635 rotates accordingly. The second protruding part 636 keeps a certain distance from the rotation block 632, and the first protruding part 633 on the rotary pressing block 632 is close to the locking block 631.

Please refer to FIG. 73 through FIG. 82. In an embodiment of the disclosure, the first trigger 610*a* is used to control the on-and-off of the wheel hub motor 501, and the second trigger 610*b* is used to control the on-and-off of the first motor 300. When the first trigger 610*a* is away from the first operation handle 601*a* and the second trigger 610*b* is away from the second operation handle 601*b*, the first triggering device 621 on the linkage shaft 620 does not contact the first switch 623, the second triggering device 622 does not contact the second switches 624, the second protruding part 636 of the cam 635 pushes the rotation block 632 away from the linkage shaft 620, and the first protruding part 633 on the rotation block 632 is located above the locking block 631 and is not clamped with the clamping block 631. When the first trigger 610*a* and the second trigger 610*b* are pressed down, the first triggering device 621 contacts with the first switch 623 and triggers the first switch 623, the wheel hub motor 501 is in a power-on state, the second triggering device 622 is in contact with the second switch 624 and triggers the second switch 624, and the first motor 300 is in the power-on state. The second protruding part 636 on the cam 635 rotates and does not contact the rotation block 632, and the first protruding part 633 on the rotation block 632 is clamped with the clamping block 631. Then the second trigger 610*b* is released, since the first protruding part 633 is clamped with the clamping block 631, the second trigger 610*b* is not reset, and is still in a pressed state. When the first trigger 610*a* is released, the cam 635 rotates with the linkage shaft 620, the first protruding part 633 is reset, and the rotation block 632 is pushed away from the clamping block 631, so that the first protruding part 633 is not clamped with the clamping block 631. At this time, the second trigger 610*b* is resettable.

Figure 76:
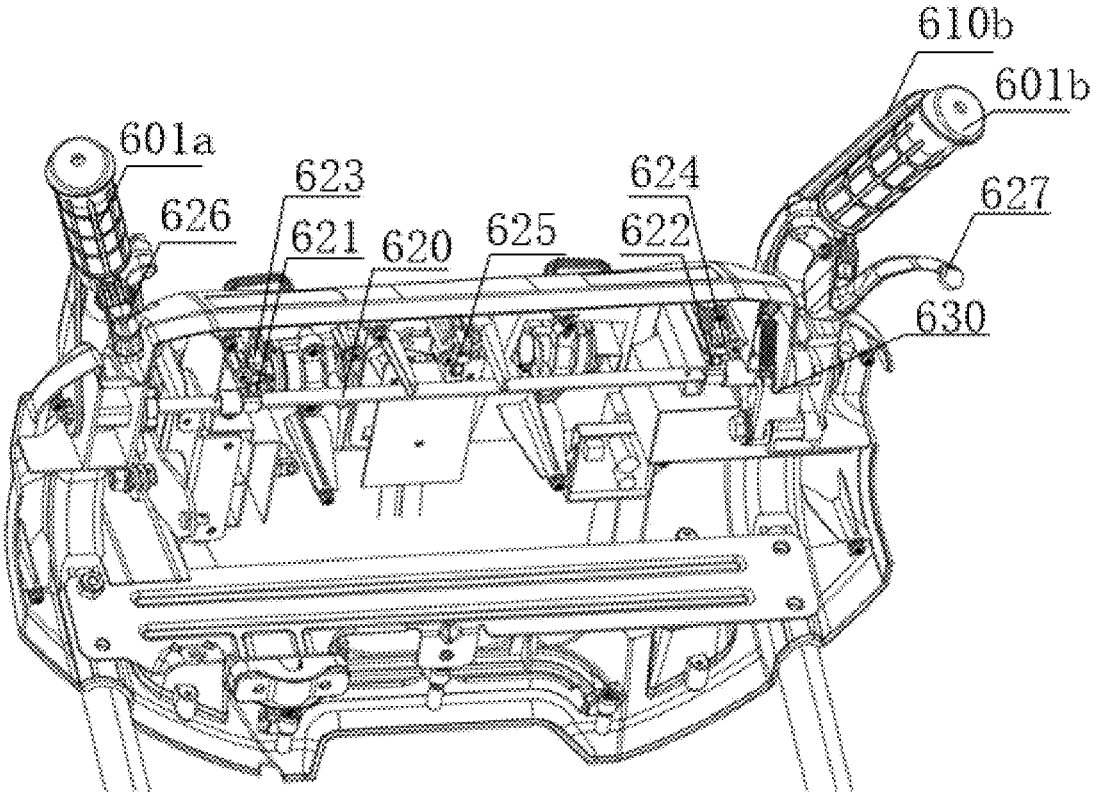
FIG. 76 is a bottom view of the control assembly according to an embodiment.
Figure 77:
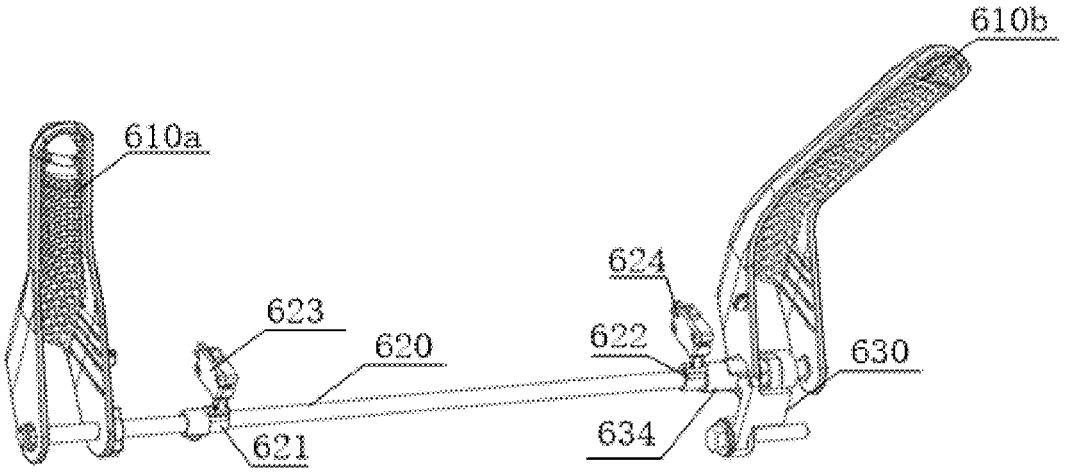
FIG. 77 is a perspective view of an interlocking structure according to an embodiment.

Please refer to FIG. 76. In an embodiment of the disclosure, a first pressing structure 626 and a second pressing structure 627 are further arranged below the first operation handle 601*a* and the second operation handle 601*b*. The first pressing structure 626 is connected with the fourth control board 904*a* to provide control signals for a steering of the wheel hub motors 501 on both sides of the chassis 80.

Please refer to FIG. 73 through FIG. 76. In an embodiment of the disclosure, a first speed adjustment lever 614*a* and a second speed adjustment lever 614*b* are arranged on the operation console 602, the first speed adjustment lever 614*a* and the second speed adjustment lever 614*b* are located between the first operation handle 601*a* and the second operation handle 614*b*. In this embodiment, a direction parallel to a rotation axis of the wheel assembly 50 is defined as a first direction XX'. In some embodiments, the first speed adjustment lever 614*a* and the second speed adjustment lever 614*b* are symmetrical with respect to the central axis of the operation console 602. The first speed adjustment lever 614*a* is arranged at a first angle A with the first direction XX', and a range of the first angle A is from 3° to 15°, the second speed adjustment lever 614*b* is arranged at a second angle B with the first direction XX', and a range of the second angle B is from 3° to 15°. The first speed adjustment lever 614*a* arranged at the first angle A and the second speed adjustment lever 614*b* arranged at the second angle B are ergonomic, so that the first speed adjustment lever 614*a* and the second speed adjustment lever 614*b* are more labor-saving when being pulled, which is more comfortable. The first speed adjustment lever 614*a* is connected with the fourth control board 904*a*, and is used to control the rotation speed, steering, etc. of the wheel hub motor 501. The second speed adjustment lever 614*b* is connected with the second control board 902*a* for controlling the rotation speed of the first motor 300. In this embodiment, the first speed adjustment lever 614*a* is arranged on a side of the operation console 602 close to the first trigger 601*a*, and the second speed adjustment lever 614*b* is arranged on a side of the operation console 602 close to the second trigger 601*b*. With this arrangement, a movement of the snow thrower 1 may be controlled on the same side, and a snow removal of the snow thrower 1 may be controlled on the same side, which is more in line with operating habits, and the user may use it more easily.

Please refer to FIG. 73 through FIG. 77. In an embodiment of the disclosure, a switch button 613 is further arranged on the operation console 602, which is located on the operation console 602 and between the first speed adjustment lever 614*a* and the second speed adjustment lever 614*b*. A third switch 625 is arranged on the other side of the operation console 602, and the third switch 625 is connected with the battery assembly 40 and is used to control an on-and-off of the whole snow thrower. A display device 611 is further arranged on the operation console 602. The display device 611 is located between the first speed adjustment lever 614*a* and the second speed adjustment lever 614*b*. The display device 611 is used to display parameters of the plurality of batteries 410 in the battery assembly 40, such as a power of the batteries 410, whether the battery 410 has low temperature or low voltage, and the like. In addition, the display device 611 can also display a status of each light, and display whether each light is off or on. In this embodiment, the display device 611 separately displays a usage status of the first light 105 and the two second lights 639. In some embodiments, the display device 611 is a thin film panel. Of course, in other embodiments, the display device 611 may also be in other structures. A button 612 is further arranged on an upper side of the display device 611. The button 612 is used to control an on-and-off of the plurality of lights in this embodiment, for example, to control the first light 105, the second lights 639 and a display light 638. In addition, in other embodiments, the button 612 may also control an on-and-off of the display device 611 and adjust a brightness of the display device 611.

Figure 3:
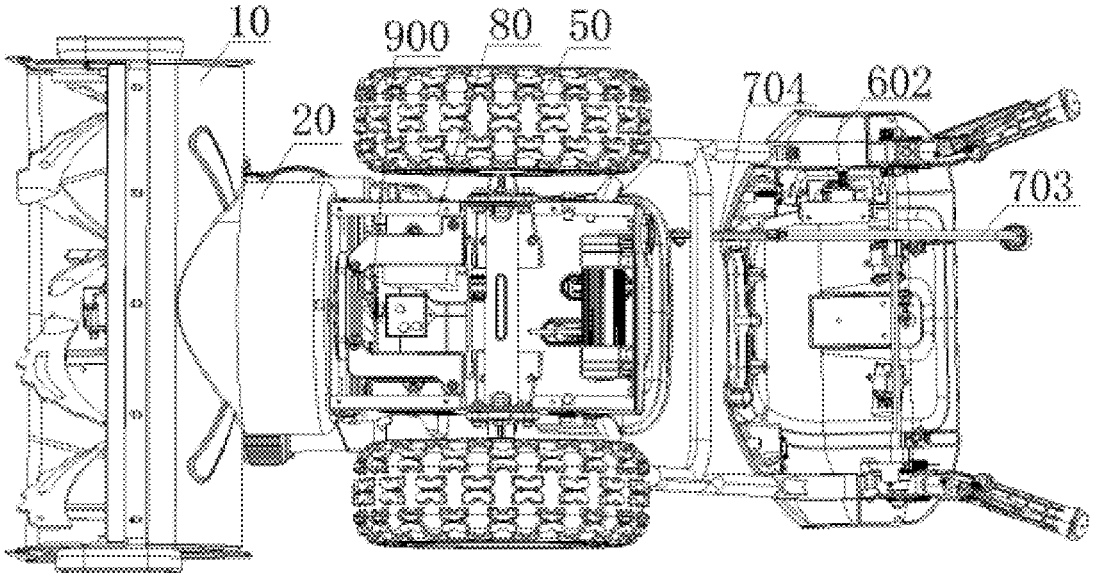
FIG. 3 is a bottom view of the snow thrower according to an embodiment.

Please refer to FIG. 3 and FIG. 73. In an embodiment of the disclosure, the operation console 602 is further provided with an adjustment rod 640. An end of the adjustment rod 640 is located on the operation console 602, and the other end of the adjustment rod 640 passes through the operation console 602 and is connected with a deflector wire 704 in the chute control assembly 70 for adjusting a position of the deflector 701.

Please refer to FIG. 43. In an embodiment of the disclosure, the display light 638 and the second light 639 are arranged on the operation console 602, and the display light 638 and the second light 639 are located on an inclined surface of the operation console 602. The display light 638 is in a shape of a strip with both ends bent, and two second lights 639 are located on both sides of the display light 638.

Figure 83:
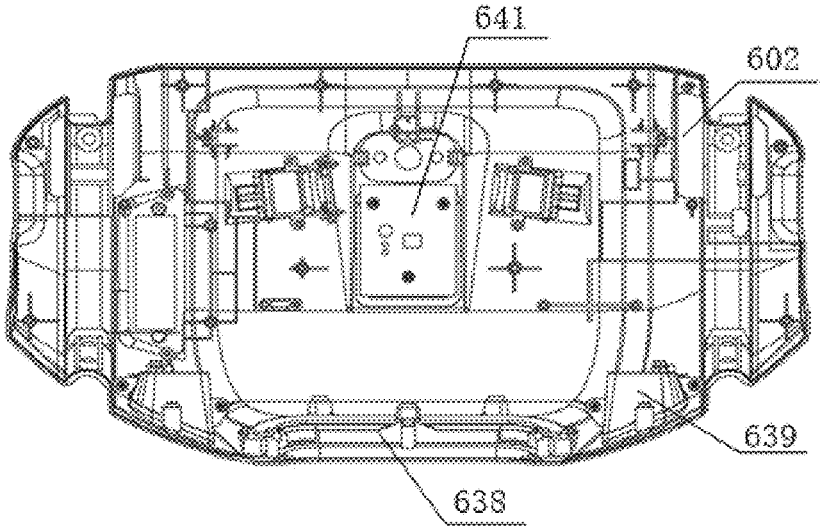
FIG. 83 is a rear perspective view of the control assembly according to an embodiment.
Figure 87:
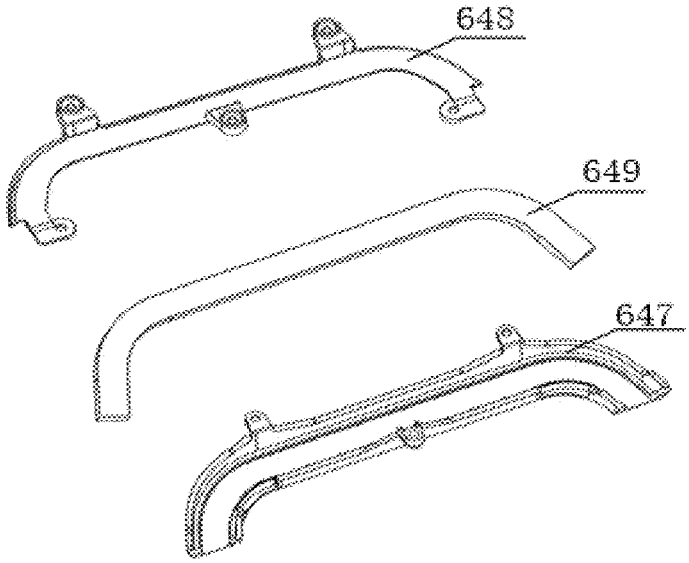
FIG. 87 is an exploded view of the display light according to an embodiment.
Figure 88:
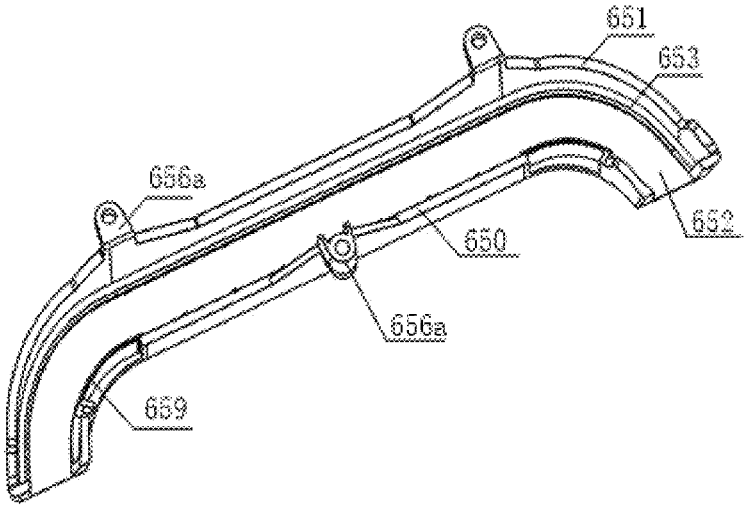
FIG. 88 is a perspective view of a first light cover according to an embodiment.
Figure 89:
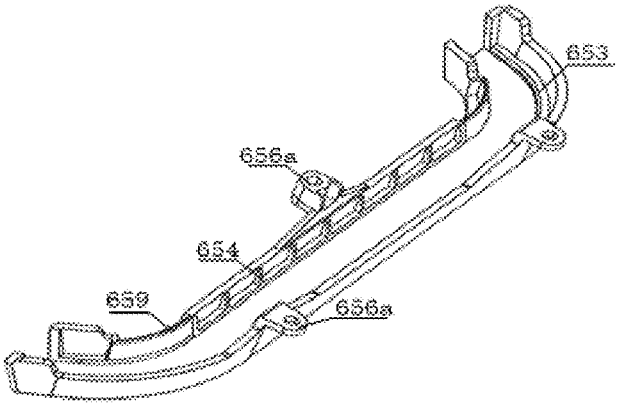
FIG. 89 is another perspective view of the first light cover according to an embodiment.
Figure 90:
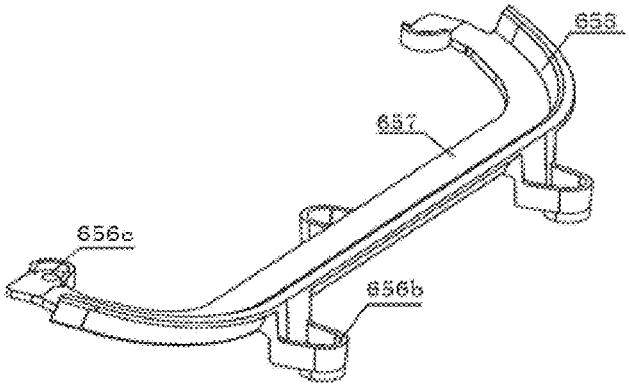
FIG. 90 is a perspective view of the first light base according to an embodiment.
Figure 91:
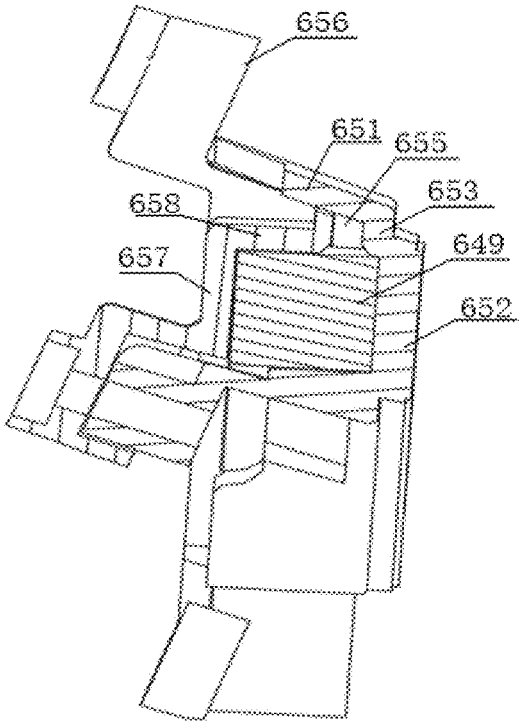
FIG. 91 is a cross-sectional view of the display light according to an embodiment.
Figure 92:
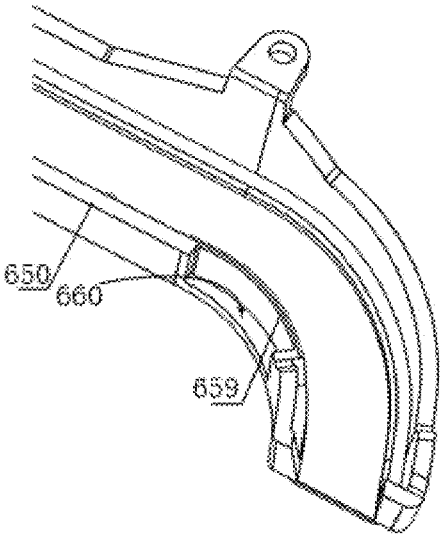
FIG. 92 is a partial perspective view of the first light cover according to an embodiment.

Please refer to FIG. 43, FIG. 83 and FIG. 87. In an embodiment of the disclosure, the display light 638 includes a first light base 648, a light bar 649 and a first light cover 647. The display light 638 is arranged in a strip shape with both ends bent, and the two ends of the display light 638 are bent to the same side. When a width of the operation console 602 is constant, the bent display light 638 may increase a display area. Wherein, the first light cover 647 is clamped with the first light base 648 to define a light bar accommodating part, and the light bar 649 is clamped in the light bar accommodating part. In the disclosure, the light bar 649 is a flexible light bar 649, and the light bar 649 may be bent according to a shape of the light bar accommodating part.

Please refer to FIG. 87 through FIG. 92. In an embodiment of the disclosure, the first light cover 647 includes a light cover bottom wall 652, and a first side wall 650 and a second side wall 651 connected with the light cover bottom wall 652. The light cover bottom wall 652 and the two side walls define a groove, and the first side wall 650 and the light cover bottom wall 652 are arranged at a first angle, and a range of the first angle is from 85° to 95°, such as 90°. The second side wall 651 and the light cover bottom wall 652 are arranged at a second angle, and a range of the second angle is from 90° to 120°, such as 100°. Wherein, both ends of the first light cover 647 are bent to the same side, and the first side wall 650 is located on the inner side of the second side wall 651. On a side connected with the second side wall 651, a step 653 is arranged on the light cover bottom wall 652. When the light bar 649 is clamped in the groove defined by the first light cover 647, a side wall of the step 653 is fitted with the light bar 649 to limit a position of the light bar 649 and ensure that the light bar 649 does not shake in the first light cover 647. On an inner side wall of the first side wall 650, a plurality of stiffeners 654 are arranged to limit the position of the light bar 649 and increase a structural strength of the first side wall 650.

Please refer to FIG. 87 through FIG. 92. In an embodiment of the disclosure, at a position where the first side wall 650 is bent, a connecting curved surface 659 is arranged on the first side wall 650. The inner side wall of the connecting curved surface 659 is substantially completely fitted with the light bar 649 to prevent the light bar 649 from warping when it is bent, which causes the light bar 649 to emit light unevenly. Compared with the stiffener 654, the area of the connecting curved surface 659 attached to the light bar 649 is larger, which can better prevent the light bar 649 from warping when it is bent, and has a stronger force. Further, the first side wall 650 is further provided with a third notch 660 at a position where the connecting curved surface 659 is arranged. The third notch 660 is arranged on a side of the first side wall 650 which is different from a side where the connecting curved surface 659 is located, and a size of the third notch 660 corresponds to a size of the connecting curved surface 659. With this arrangement, a thickness of the entire first side wall 650 may be kept uniform, so as to avoid a phenomenon such as stress concentration during a molding of the first side wall 650, which ensures the structural strength of the first side wall 650.

Please refer to FIG. 87 through FIG. 92. In an embodiment of the disclosure, the first light base 648 includes a light base bottom wall 657 and a light base side wall 658. The light base bottom wall 657 and the light base side wall 658 are arranged at a third angle, and the third angle is complementary to the first angle, and a range of the third angle is from 85° to 95°, such as 90°. When the first light base 648 is clamped with the first light cover 647, the light base bottom wall 657 covers a notch of the first light cover 647. The light base side wall 658 extends into the groove defined by the first light cover 647, and an outer side wall of the light base side wall 658 is attached with an inner side wall of the second side wall 651. There is a certain distance between the light base side wall 658 and the step 653 on the first light cover 647 to define a gap 655. When the light bar 649 is clamped in the light bar accommodating part defined by the first light base 648 and the first light cover 647, the gap 655 defines an air cavity. When the light bar 649 is used for a long time, the air cavity defined by the gap 655 defines a heat exchange with the outside to achieve a heat dissipation effect.

Please refer to FIG. 87 through FIG. 92. In an embodiment of the disclosure, the display light 638 is provided with a plurality of second fixed parts 656 for fixing the display light 638 to the operation console 602. The second fixed part 656 includes a first fixed base 656*a* provided on the first light cover 647 and a second fixed base 656*b* on the first light base 648. Positions and structures of the first fixed base 656*a* and the second fixed base 656*b* correspond to each other. The disclosure does not limit the number and shape of the first fixed base 656*a* and the second fixed base 656*b*. In the embodiment, the number of the first fixed bases 656*a* is, for example, three, wherein, two of the first fixed bases 656*a* are connected with the second side wall 651 and are close to the connecting curved surface 659, and one of the first fixed base 656*a* is connected with the first side wall 650 and is located in a middle position of the first side wall 650. The number of the second fixed bases 656*b* is the same as the number of the first fixed bases 656*a*, for example, three, and two of the second fixed bases 656*b* are connected with the light base side wall 658, one second fixed base 656*b* is connected on the light base bottom wall 657. When the first light cover 647 is clamped with the first light base 648, the first fixed base 656*a* and the second fixed base 656*b* are clamped to define the second fixed part 656. The first fixed base 656*a* and the second fixed base 656*b* are provided with through holes, and bolts pass through the through holes on the first fixed base 656*a* and the second fixed base 656*b* to fix the display light 638 on the operation console. In this embodiment, the second fixed part 656 extends toward a side of the light base bottom wall 657, and extends out of a plane where the light base bottom wall 657 is located, so that a distance between the fixed base 656 and the operation console 602 increases, which increases a working length of the bolt and enables a connection between the display light 638 and the operation console 602 to be firm and reliable. In this embodiment, both ends of the light base bottom wall 657 are further provided with third fixed bases 656*c*, and the third fixed bases 656*c* are connected with the operation console 602 by bolts, so that the connection between the display light 638 and the operation console 602 is more stable and reliable.

Please refer to FIG. 87 through FIG. 92. In an embodiment of the disclosure, the light bar 649 is clamped in the light bar accommodating part defined by the first light base 648 and the first light cover 647, and the light bar 649 is a flexible light strip that may be bent according to a shape of the light bar accommodating part. The flexible light bar 649 has a high degree of integration, which may reduce a cost of the whole machine. The flexible light bar 649 has a different shape, color, and appearance, which may realize color change and marquee functions, so as to realize functions of lighting, warning and reminder, and achieve a better human-computer interaction function. When the light bar 649 needs to be mounted, the light bar 649 is clamped into a groove defined by the first light cover 647, the first light base 648 is covered on a notch of the groove, clamped with the first light cover 647, and then the display light 638 is fixed on the operation console through the second fixed part 656.

Figure 84:
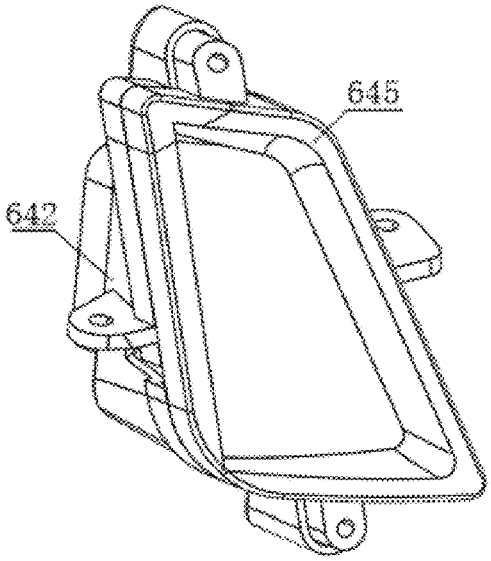
FIG. 84 is a perspective view of a second light according to an embodiment.
Figure 85:
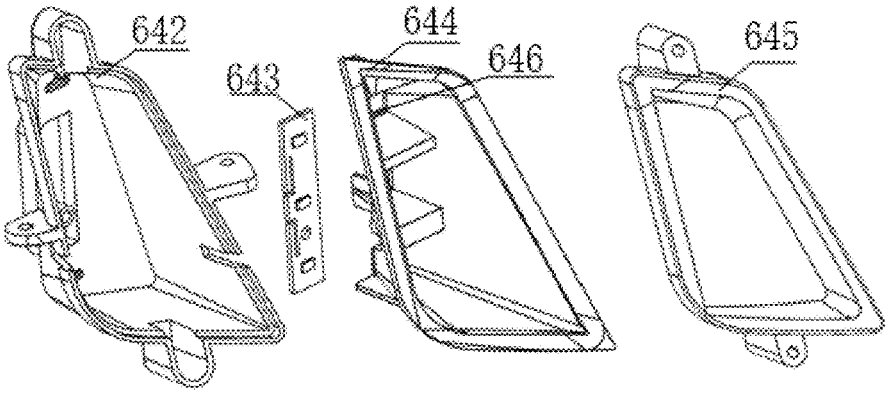
FIG. 85 is an exploded view of the second light according to an embodiment.
Figure 86:
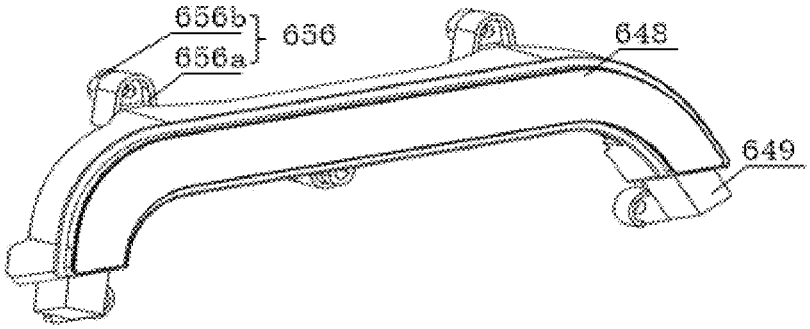
FIG. 86 is a perspective view of a display light according to an embodiment.

Please refer to FIG. 83 through FIG. 85. In an embodiment of the disclosure, the second light 639 includes a protective cover 642, a light plate 643, a second light base 644 and a second light cover 645. The protective cover 642 is fastened with the second light cover 645 to define an accommodating cavity, and is fixed together by bolts. The light plate 643 and the second light base 644 are arranged in the accommodating cavity. The light plate 643 is fixed on a bottom wall of the protective cover 642, and the second light base 644 is clamped in the protective cover 642. An outer side wall of the second light base 644 is attached to an inner side wall of the protective cover 642, and an outer bottom wall of the second light base 644 is close to the light plate 643. A plurality of light beads 646 are further mounted on the bottom wall of the second light base 644, and the light beads 646 are connected with the light plate 643.

Please refer to FIG. 74 and FIG. 83. In an embodiment of the disclosure, a fifth control board 641 is further arranged on the operation console 602, which is located below the button 612 and is connected with the button 612. The fifth control board 641 is further connected with the display light 638 and the second light 639. The fifth control board 641 is connected with a control unit of the light bar 649 and the light plate 643 and is used to adjust a color switching, flashing, constant light and dark of the display light 638 and control the on-and off of the display light 638 and the second light 639. The disclosure does not limit the number and control method of the fifth control board 641. In this embodiment, the number of the fifth control board 641 is, for example, one. In other embodiments, the number of the fifth control boards 641 is, for example, two. The fifth control board 641 may control the display light 638 and the second light 639 at the same time, or may also control them individually. The fifth control board 641 is arranged on the operation console 602 instead of the chassis 80, so that a distance between the fifth control board 641 and the display light 638 and a distance between the fifth control board 641 and the second light 639 are closer, and connection lines are more concise and orderly. The fifth control board 641 controls the display lights 638 to achieve display effects such as marquee, color switching, flashing, constant light, dark adjustment, etc. and defines a display effect of the display light 638 as each working state of the whole machine, so as to play a role of lighting, warning, and reminder and achieve a better human-computer interaction.

Figure 93:
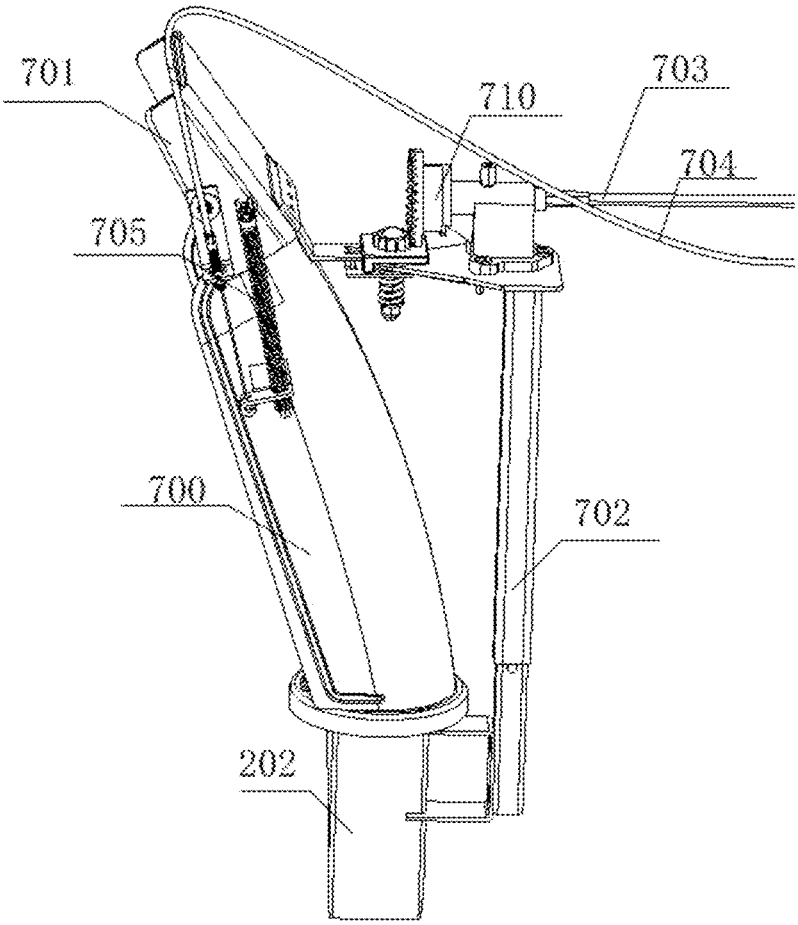
FIG. 93 is a perspective view of a chute control assembly according to an embodiment.

Please refer to FIG. 93. The disclosure provides the chute control assembly 70 to adjust the chute 700 and the deflector 701 and adjustment structures thereof.

Please refer to FIG. 1 and FIG. 93. In an embodiment of the disclosure, the chute 700 is a semi-closed passage structure.

Please refer to FIG. 8 and FIG. 93. In an embodiment of the disclosure, an end of the chute 700 is connected with the outlet of the chute base 202 and allows the chute 700 to rotate relative to the chute base 202. When the impeller 201 throws snow from the chute base 202, the snow is thrown from an unclosed side of the chute 700. When the chute 700 rotates relative to the chute base 202, a position of the unclosed side of the chute 700 changes, thereby changing a snow blowing direction of the snow thrower 1.

Please refer to FIG. 8 and FIG. 93. In an embodiment of the disclosure, a height of a side surface of the deflector 701 is lower than a height of a side surface of the chute 700.

Please refer to FIG. 8 and FIG. 93. In an embodiment of the disclosure, an end of the deflector 701 is connected with the other end of the chute 700, which means connected with an end of the chute 700 away from the chute base 200. A side of the deflector 701 is connected with a side of the chute 700, and the deflector 701 is allowed to rotate around a connection point between the deflector 701 and the chute 700. When the deflector 701 rotates, a snow blowing height and snow blowing direction of the snow thrower 1 may be adjusted.

Figure 94:
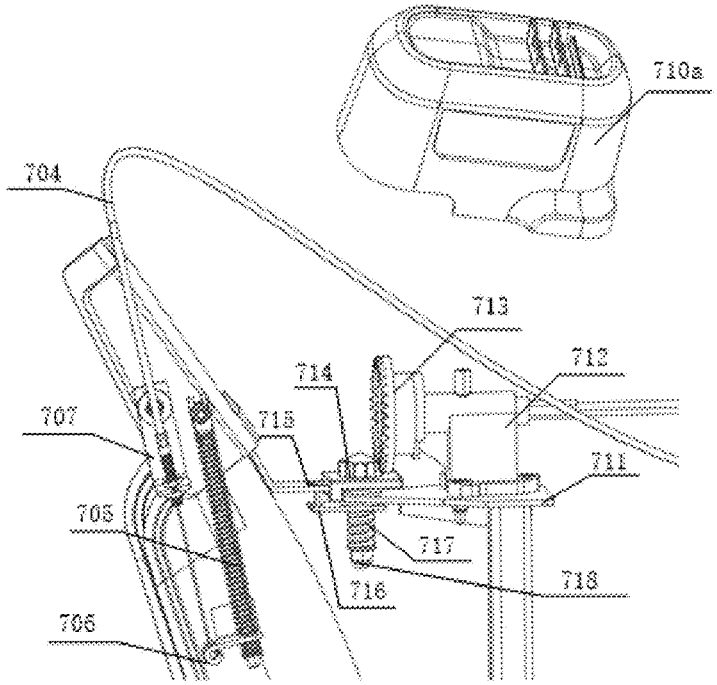
FIG. 94 is a perspective view of a partial chute control assembly according to an embodiment.
Figure 95:
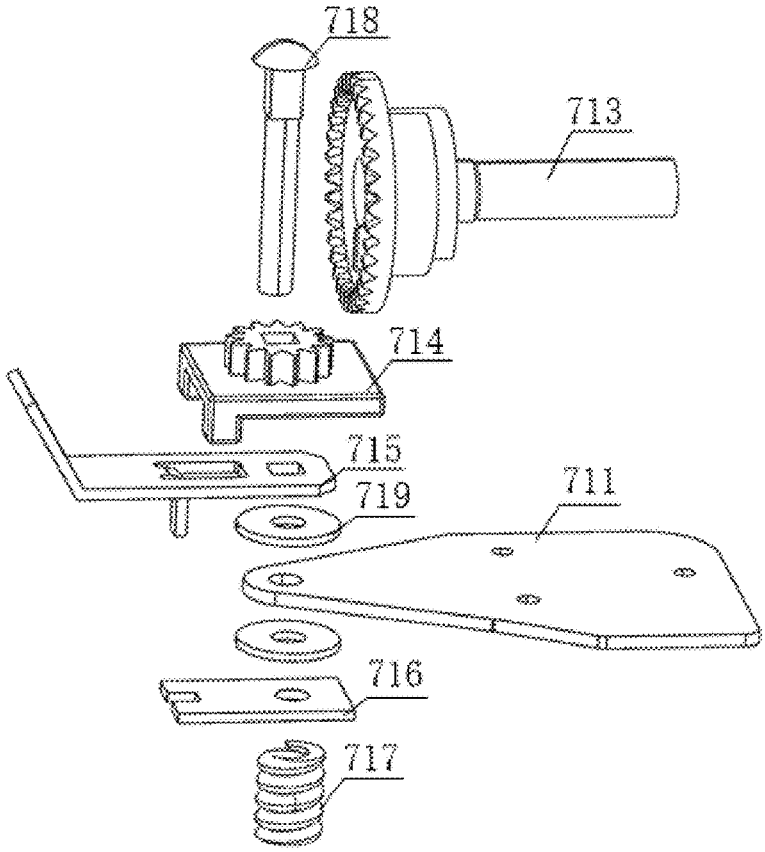
FIG. 95 is an exploded view of the transmission structure according to an embodiment.

Please refer to FIG. 3, FIG. 94 and FIG. 95. In an embodiment of the disclosure, the adjustment structure of the chute 700 mainly includes a rocking trigger 703 and a transmission structure 710. An end of the rocking trigger 703 is connected with the transmission structure 710, and the other end of the rocking trigger 703 extends to an operating end of the snow thrower 1. The other end of the rocking trigger 703 extends below the operation console 602 of the control assembly 60 and is close to a handle of the snow thrower 1. The transmission structure 710 is used to transmit a rotation of the rocking trigger 703 to a rotation of the chute 700 to change the snow blowing direction of the snow thrower 1.

Please refer to FIG. 94 and FIG. 95. In an embodiment of the disclosure, the adjustment structure of the chute 700 further includes a supporting component 702, a positioning block 711, a supporting frame 712 and a transmission structure casing 710*a*.

Please refer to FIG. 93 to FIG. 94, the supporting component 702 and the positioning block 711 provide a supporting platform for the transmission structure 710. The supporting component 702 is in a shape of a slender tube, and an end of the supporting component 702 is fixed on a side of the chute base 202 and is located on a side close to the control assembly 60, thereby fixing the transmission structure 710 between the chute base 202 and the control assembly 60. In some embodiments, the other end of the supporting component 702 extends upward along the vertical direction, and extends to a height of a connection point between the chute 700 and the deflector 701, and the transmission structure 710 is fixed at a height close to the connection point of the chute 700 and the deflector 701. In the embodiment, the supporting components 702 are sleeved together by tubular objects with different inner diameters, each tubular object is provided with a plurality of through holes, and the tubular objects with different inner diameters are fixed together by bolts. A height of the supporting component 702 may be adjusted through the bolts.

Further, please refer to FIG. 95. In this embodiment, the positioning block 711 is in a shape of a flat plate, and is fixed on the other end of the supporting component 702, which means an end of the supporting component 702 away from the chute base 202. The positioning block 710 is arranged horizontally and is used to provide a supporting platform for the transmission structure 710. The positioning block 711 is provided with a protruding part, and the protruding part is located on a side close to the chute 700.

Further, please refer to FIG. 94 through FIG. 98. The supporting frame 712 is located on the positioning block 711, and a base of the supporting frame 712 is fixed on the positioning block 711 by screws. A third through hole 712*a* is arranged above the supporting frame 712. The third through hole 712*a* is arranged along an extending direction of the rocking trigger 703 and allows the rocking trigger 703 to pass through the third through hole 712*a* for fixing the rocking trigger 703.

Further, please refer to FIG. 94 through FIG. 98. The transmission structure casing 710*a* covers the transmission structure 710 and is fixed on the supporting frame 712 by screws. The transmission structure casing 710*a* is provided with perforations for fixing the deflector wire 704.

Please refer to FIG. 95. The transmission structure 710 is located on the positioning block 711, and the transmission structure 710 includes a first gear 713, a second gear 714, a connecting shaft 718, a fourth connecting component 716 and a rotation component 715.

Figure 96:
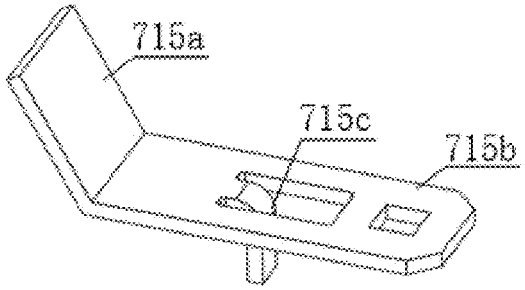
FIG. 96 is a perspective view of a rotation component according to an embodiment.

Please refer to FIG. 95 and FIG. 96. In an embodiment of the disclosure, the first gear 713 is located on the vertical plane. A shaft of the first gear 713 is perpendicular to a plane where teeth of the first gear 713 are located, and the shaft of the first gear 713 passes through the third through hole 712*a* of the supporting frame 712 and is connected with an end of the rocking trigger 703. When the rocking trigger 703 rotates, the first gear 713 rotates on the vertical plane.

Please refer to FIG. 95 and FIG. 96. In an embodiment of the disclosure, the second gear 714 is located on the protruding part of the positioning block 711, which means that the second gear 714 is located on the horizontal plane, and the second gear 714 is mashed with the first gear 713. When the first gear 713 rotates on the vertical plane, the second gear 714 rotates on the horizontal plane.

Please refer to FIG. 95 and FIG. 96. In an embodiment of the disclosure, the connecting shaft 718 is arranged in the vertical direction. An end of the connecting shaft 718 is connected with the second gear 714. The other end of the connecting shaft 718 sequentially passes through a perforation in a center of the second gear 714, a perforation on the rotation component 715, and a perforation on the protruding part of the positioning block 711, and is fixed by a nut. When the second gear 714 rotates on the horizontal plane, the connecting shaft 718 rotates on the horizontal plane. In this embodiment, at a part where the connecting shaft 718 is connected with the second gear 714 and the rotation component 715, a cross-section of the connecting shaft 718 is square, rectangular or polygonal. The perforations arranged in the center of the second gear 714 and on the rotation component 715 are also correspondingly square, rectangular or polygonal, so that the connecting shaft 718 drives the rotation component 715 to rotate more reliably.

Please refer to FIG. 95 and FIG. 96. In an embodiment of the disclosure, the rotation component 715 includes a fourth plane 715*b* and a fifth plane 715*a*. The fourth plane 715*b* and the fifth plane 715*a* are arranged at a certain angle. The angle between the fourth plane 715*b* and the fifth plane 715*a* is an angle between the bottom surface of the chute 700 and the horizontal plane.

Figure 97:
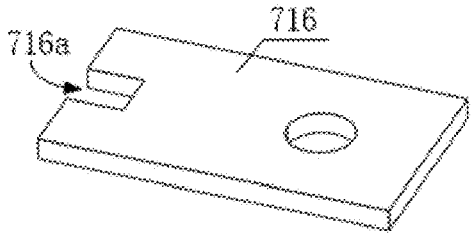
FIG. 97 is a perspective view of a fourth connecting component according to an embodiment.
Figure 98:
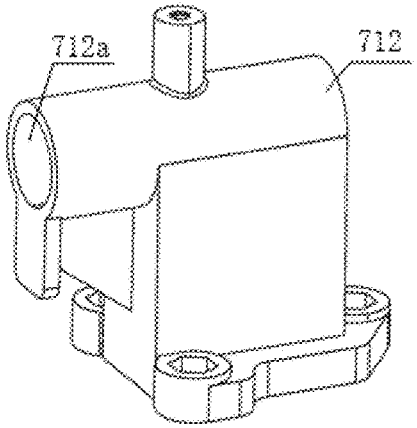
FIG. 98 is a perspective view of a supporting frame according to an embodiment.
Figure 99:
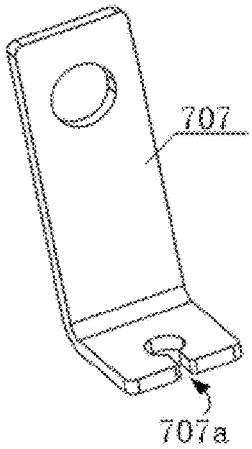
FIG. 99 is a perspective view of a sixth connecting component according to an embodiment.
Figure 100:
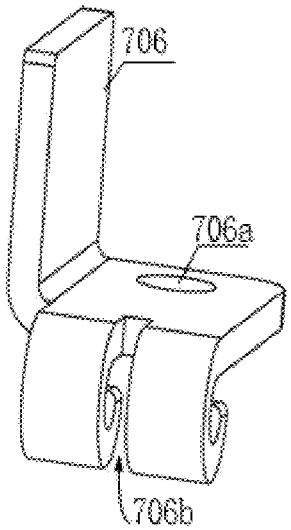
FIG. 100 is a perspective view of a fifth connecting component according to an embodiment.

Please refer to FIG. 95 through FIG. 97. In an embodiment of the disclosure, an end of the rotation component 715 is connected with the chute 700, and the other end is connected with the connecting shaft 718. The fifth plane 715*a* of the rotation component 715 is attached to the bottom surface of the chute 700. A perforation is arranged on the fourth plane 715*b* of the rotation component 715 for connecting the rotation component 715 with the connecting shaft 718. The fourth plane 715*b* of the rotation component 715 is located between the first gear 713 and the positioning block 711. When the connecting shaft 718 rotates on the horizontal plane, the rotation component 715 rotates with the connecting shaft 718 and drives the chute 700 connected with the fifth plane 715*a* to rotate, thereby changing the snow blowing direction. In this embodiment, a base of the first gear 714 is clamped with the fourth plane 715*b* of the rotation component 715, which allows the first gear 714 to drive the rotation component 715 to rotate, thereby driving the chute 700 to rotate.

Further, please refer to FIG. 96. In an embodiment of the disclosure, the fourth plane 715*b* is further provided with a first protruding block 715*c*. The first protruding block 715*c* extends from the fourth plane 715*b*, and the first protruding block 715*c* is perpendicular to the fourth plane 715*b*. The first protruding block 715*c* is used to be clamped with a groove of the fourth connecting component 716.

Please refer to FIG. 95 through FIG. 97. In an embodiment of the disclosure, below the positioning block 711, the fourth connecting component 716 is further arranged on the connecting shaft 718. The fourth connecting component 716 is arranged parallel to the fourth plane 715*b* of the rotation component 715, and a first groove 716*a* is arranged on a side of the fourth connecting component 716. The first protruding block 715*c* on the fourth plane 715*b* is clamped in the first groove 716*a*, and the fourth connecting component 716 is used to reinforce the rotation component 715.

Further, please refer to FIG. 95. Below the fourth connecting component 716, a shock absorbing spring 717 is further arranged on the connecting shaft 718 for shock absorbing. And between the fourth connecting component 716 and the positioning block 711, a gasket 719 is further arranged between the rotation component 715 and the positioning block 711 to prevent a wear of the components.

Please refer to FIG. 3, FIG. 94 through FIG. 96. When the rocking trigger 703 rotates, the first gear 713 connected with the rocking trigger 703 rotates on the vertical plane, thereby driving the second gear 714 meshed with the first gear 713 to rotate. Since the connecting shaft 718 is connected with the second gear 714, the connecting shaft 718 is driven to rotate. The rotation component 715 is connected with the connecting shaft 718, and the fifth plane 715*a* of the rotation component 715 is connected with the bottom surface of the chute 700, thereby driving the chute 700 to rotate.

Please refer to FIG. 3, FIG. 93 through FIG. 100. In an embodiment of the disclosure, the adjustment structure of the deflector 701 includes the deflector wire 704, a return spring 705, a fifth connecting component 706 and a sixth connecting component 707.

Please refer to FIG. 93 through FIG. 100. In an embodiment of the disclosure, the fifth connecting component 706 is fixed on the side of the chute 700. A second preformation hole 706*a* and a second concave groove 706*b* are arranged on a plane of the fifth connecting component 706 perpendicular to the side surface of the chute 700. The second preformation hole 706*a* is used for fixing the return spring 705, and the second concave groove 706*b* is used for fixing an end of the deflector wire 704.

Please refer to FIG. 93 through FIG. 100. In an embodiment of the disclosure, the sixth connecting component 707 is fixed on the side of the deflector 701, and the fifth connecting component 706 and the sixth connecting component 707 are arranged on the same side. A first opening notch 707*a* is arranged on a plane of the sixth connecting component 707 that is perpendicular to the side surface of the deflector 701, and the deflector wire 704 passes through the first opening notch 707*a*. At the first opening notch 707*a*, a spring tube is arranged on a periphery of the deflector wire 704 for fixing the deflector wire 704, which allows the deflector wire 704 to be pulled in the spring tube.

Please refer to FIG. 93 through FIG. 100, In an embodiment of the disclosure, the return spring 705 is fixed between the chute 700 and the deflector 701. An end of the return spring 705 is fixed on the side surface of the chute 700, and the other end of the return spring 705 is fixed on the second preformation hole 706*a* of the fifth connecting component 706. When the bottom surface of the chute 700 is smoothly connected with the deflector 701, the return spring 705 is in a natural state, and when the snow blower cap 701 rotates, the return spring 705 is in a tension or compression state.

Please refer to FIG. 43, FIG. 93 through FIG. 100. In an embodiment of the disclosure, an end of the deflector wire 704 is close to the operation console 602 and is connected with the adjustment rod 640. The adjustment rod 640 is arranged on the operation console 602, and the other end of the deflector wire 704 passes through a hole in the transmission structure casing 710*a*, the first opening notch 707*a* of the sixth connecting component 707, and the second concave groove 706*b* of the fifth connecting component 706 in sequence, and is fixed through the second concave groove 706*b*.

Please refer to FIG. 43, FIG. 73, FIG. 93 through FIG. 100. When the adjustment rod 640 is close to the first trigger 610*a*, the deflector wire 704 is in a relaxed state, and the deflector 701 is in a highest position. When the adjustment rod 640 moves forward (a side away from the first trigger 610*a*), the adjustment rod 640 pulls the end of the deflector wire 704 close to the operation console 602 to move. Since a length of the deflector wire 704 of the chute base between the chute 700 and the deflector 701 is reduced, an end of the deflector 701 away from the chute 700 rotates toward the chute 700. Then the return spring 705 is in tension or compression state and the snow may be thrown to a higher position. When the deflector wire 704 is loosened, the return spring 705 is reset, thereby driving the deflector 701 to be reset.

Please refer to FIG. 101 through FIG. 104. In an embodiment of the disclosure, an adjustment device 720 may also be used to control the snow blowing direction of the snow blowing assembly 20 instead of the rocking trigger. The adjustment device 720 may be connected on the transmission structure 710, so that the transmission structure 710 may be driven to work by the adjustment device 720, and the snow blowing direction of the impeller assembly 20 can be controlled. An end of the adjustment device 720 may pass through the control assembly 60, so that it is convenient for the user to control the adjustment device 720 to work and adjust the snow blowing direction of the snow blowing assembly 20 through the transmission structure 710. Of course, in other embodiments, the adjustment device 720 may not pass through the control assembly 60, and the adjustment device 720 may also be connected with a lower end of the control assembly 60 through a connecting device. It is only necessary to movably connect the adjustment device 720 with the control assembly 60, which is not limited here.

Figure 101:
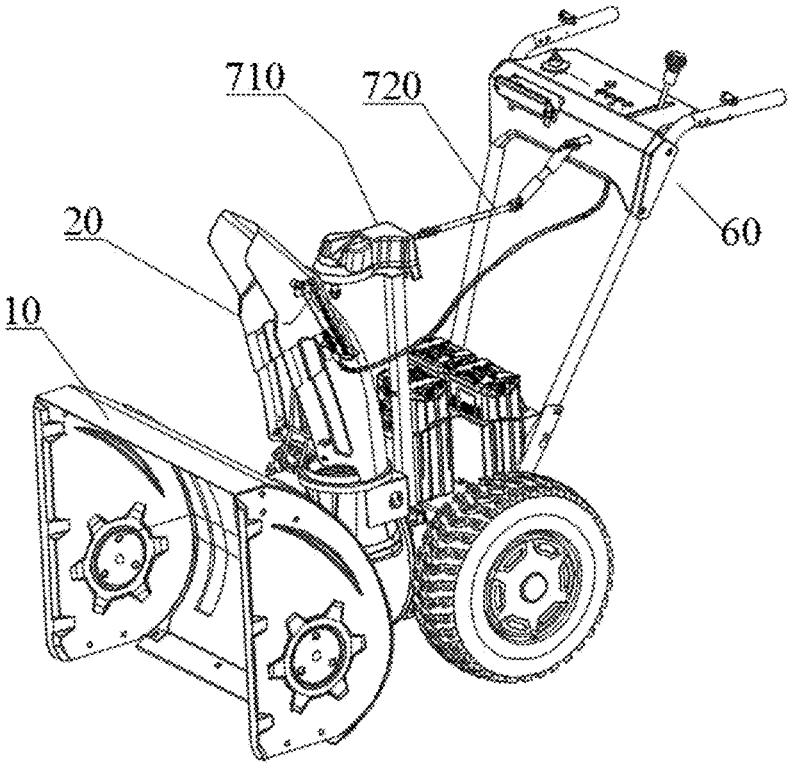
FIG. 101 is a schematic perspective view of the snow thrower according to an embodiment.
Figure 102:
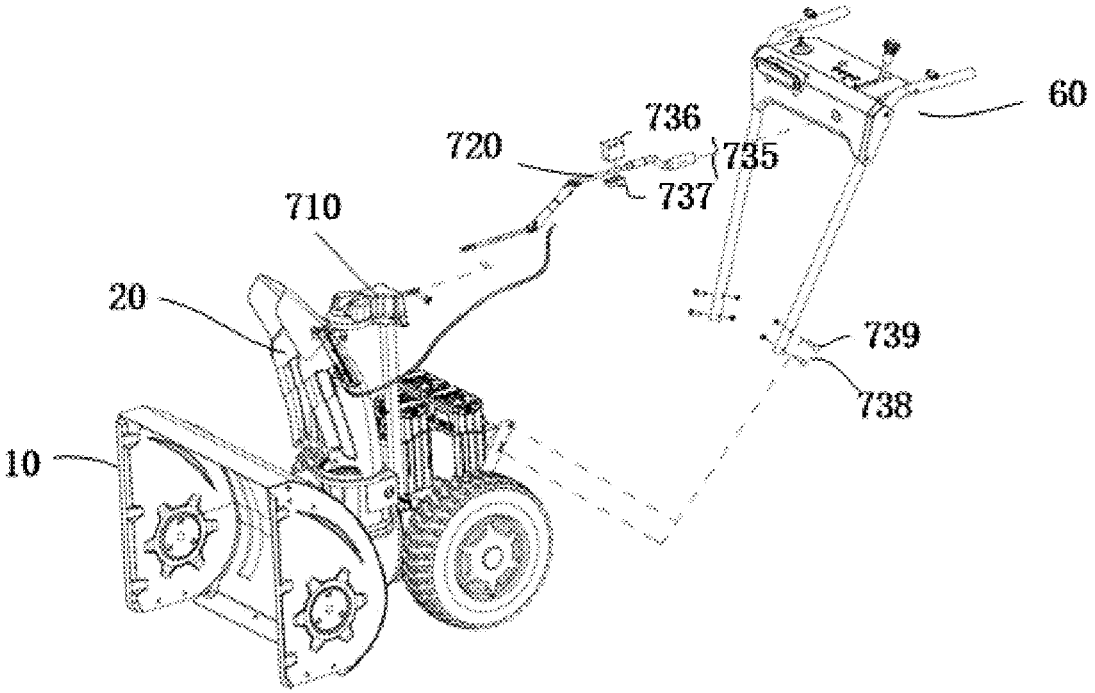
FIG. 102 is an exploded view of FIG. 101 according to an embodiment.
Figure 103:
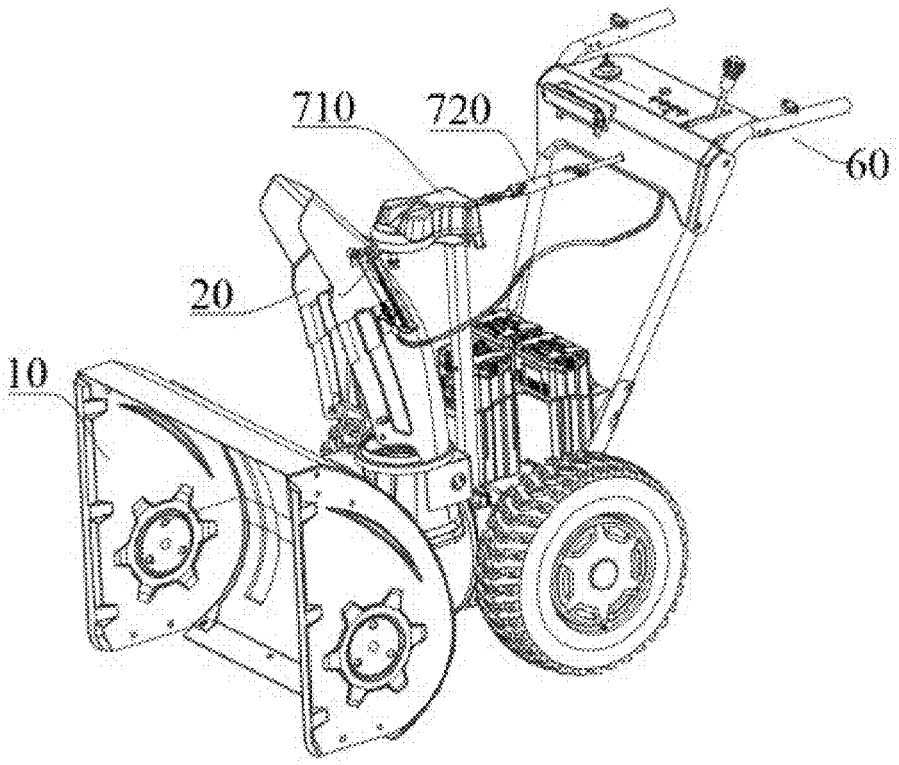
FIG. 103 is another schematic perspective view of the snow thrower according to an embodiment.
Figure 104:
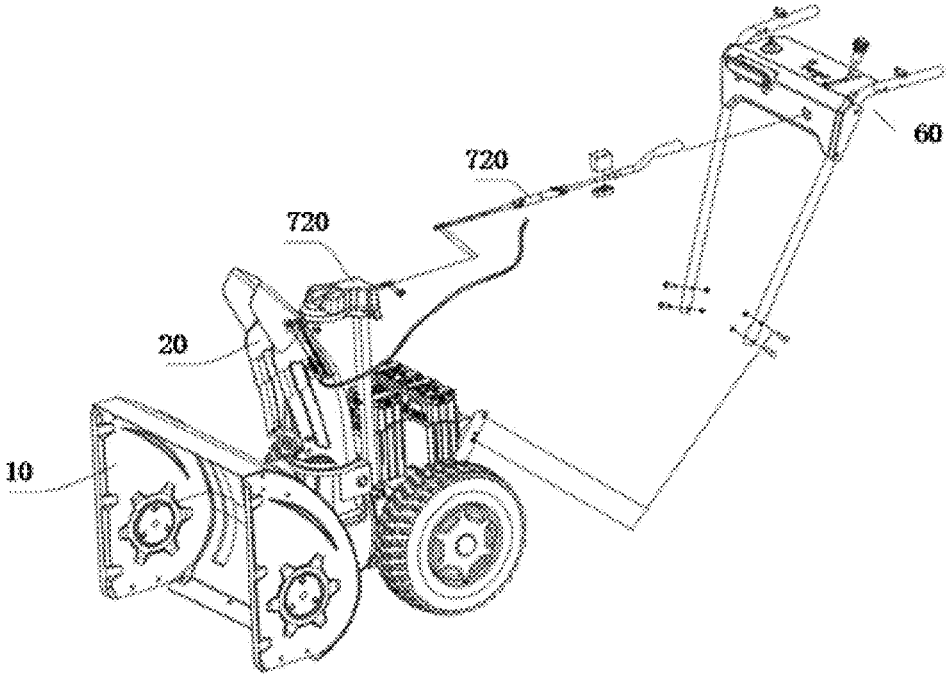
FIG. 104 is an exploded view of FIG. 103 according to an embodiment.

Please refer to FIG. 101. In an embodiment of the disclosure, in order to prevent the adjustment device 720 from falling off from the control assembly 60, the adjustment device 720 may also be rotatably arranged on the control assembly 60 through a fixed bracket 735. The fixed bracket 735 may include an upper bracket 736 and a lower bracket 737. The upper bracket 736 and the lower bracket 737 may be arranged on the control assembly 60, so that an end of the adjustment device 720 may pass through a connection position between the upper bracket 736 and the lower bracket 737 to limit the adjustment device 720. It should be noted that the adjustment device 720 in this embodiment is movably arranged between the upper bracket 736 and the lower bracket 737. The control assembly 60 may be arranged on the main body of the snow thrower through a fixed fastener 738. The control assembly 60 may be used to control an operation of the main body of the snow thrower. In this embodiment, the fixed fastener 738 may include four fixed bolts 739. The four fixed bolts 739 may be symmetrically distributed on both sides of the control assembly 60, so that the control assembly 60 may be fixed on the main body of the snow thrower through the four fixed bolts 739. A height of the control assembly 60 may be adjusted through a matching of different bolt holes with the fixed bolts 739. In other embodiments, the number of the fixed bolts 739 may also be six, eight, ten, etc. As long as the control assembly 60 may be fixed on the main body of the snow thrower, the specific number of the fixed bolts 739 is not limited.

Figure 105:
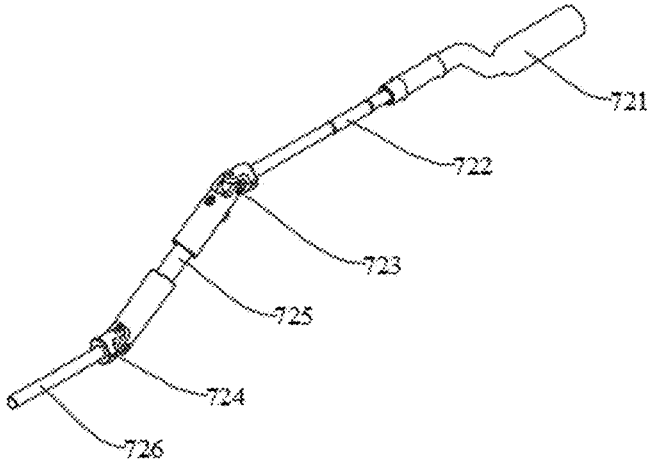
FIG. 105 is a schematic perspective view of an adjustment device according to an embodiment.
Figure 106:
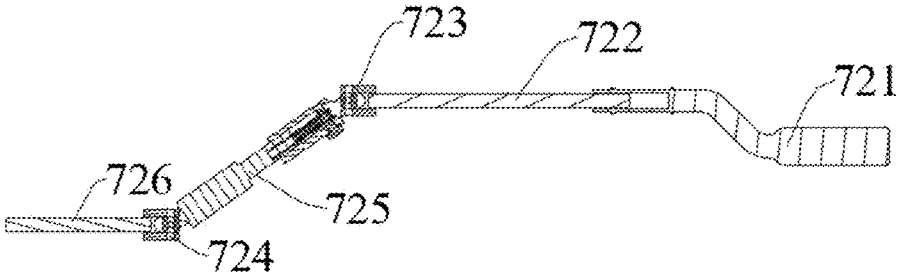
FIG. 106 is a cross-sectional view of FIG. 105 according to an embodiment.
Figure 107:
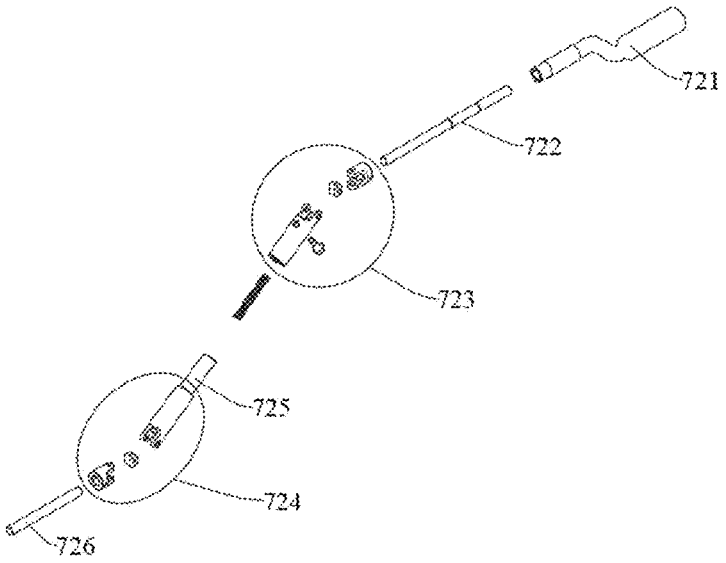
FIG. 107 is an exploded view of FIG. 105 according to an embodiment.

Please refer to FIG. 105 through FIG. 107. In an embodiment of the disclosure, the adjustment device 720 may include an operation part 721, a connecting assembly 722, a first adjustment assembly 723, a second adjustment assembly 724, a first connecting rod 725 and a second connecting rod 726. The operation part 721 may pass through the control assembly 60, so that the user may control an operation of the transmission structure 710 by driving the operation part 721 to move. The operation part 721 may be connected with an end of the connecting component 722. The other end of the connecting component 722 may be connected with an end of the first connecting rod 725 through the first adjustment assembly 723, so that a certain angle may be defined between the first connecting rod 725 and the connecting component 722. The other end of the first connecting rod 725 may be connected with the second connecting rod 726 through the second adjustment assembly 724, so that a certain angle may be defined between the first connecting rod 725 and the second connecting rod 726. The second connecting rod 726 may be connected with the transmission structure 710.

Figure 111:
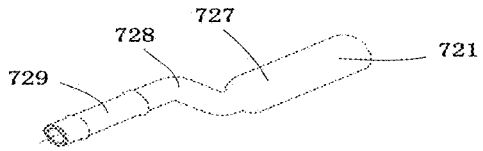
FIG. 111 is a schematic perspective view of an operation part of the adjustment device according to an embodiment.

Please refer to FIG. 105 and FIG. 111. In an embodiment of the disclosure, the operation part 721 may include a handle 727, a first bending rod 728 and a third connecting rod 729. The handle 727 may be connected with an end of the first bending rod 728, and the other end of the first bending rod 728 may be connected with the third connecting rod 729. The third connecting rod 729 may be connected with the connecting assembly 722. The third connecting rod 729 is rotatably arranged on the control assembly 60, so that the user may drive the adjustment device 720 to move as a whole by operating the handle 727. In this embodiment, the first bending rod 728 may be a Z-shaped rod. In other embodiments, the first bending rod 728 may also be a bent rod. As long as the third connecting rod 729 may be rotated by rotating the handle 727, a specific shape of the first bending rod 728 is not limited.

Figure 112:
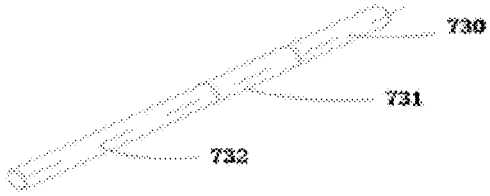
FIG. 112 is a schematic perspective view of a connecting assembly of the adjustment device according to an embodiment.

Please refer to FIG. 105 and FIG. 112. In an embodiment of the disclosure, the connection assembly 722 may include one or more connectors. The connectors may include a first connector 730, a second connector 731 and a third connector 732. The first connector 730, the second connector 731 and the third connector 732 may be connected in sequence, so that axes of the first connector 730, the second connector 731 and the third connector 732 may be the same. The first connector 730 may be connected with the third connecting rod 729, and a specific connection method between the two may not be limited. For example, an end of the first connector 730 may be embedded in the third connecting rod 729, an end of the third connecting rod 729 may also be embedded in the first connector 730, or an end of the first connector 730 and an end of the third connecting rod 729 may be connected by bolts. As long as the first connector 730 and the third connecting rod 729 may be connected, a specific connection method of an end of the first connector 730 embedded into the third connecting rod 729 is not limited. Of course, connection methods between the first connector 730 and the second connector 731 and between the second connector 731 and the third connector 732 are not limited. The first connector 730 and the second connector 731 may be connected in an internal embedding way, or may be connected by bolts. The second connector 730 and the third connector 732 may be connected in an internal embedding way, or may be connected by bolts. Of course, the first connector 730 and the second connector 731 may be integrally formed, and the second connector 730 and the third connector 732 may also be integrally formed. An end of the third connector 732 may be connected with the first connecting rod 725 through the first adjustment assembly 723.

Figure 113:
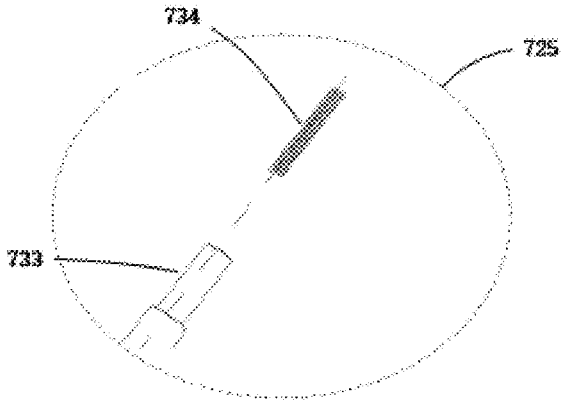
FIG. 113 is a schematic perspective exploded view of a first connecting rod of the adjustment device according to an embodiment.

Please refer to FIG. 105 and FIG. 113. In an embodiment of the disclosure, the first connecting rod 725 may include a coupling part 733 and an elastic component 734. An end of the coupling part 733 may be connected with a second link 724*a*, and the other end of the coupling part 733 may be movably arranged inside a first link 723*c*. When the user adjusts a height of the control assembly 60, the first adjustment assembly 723 and the second adjustment assembly 724 will work synchronously, so that the first connecting rod 725 will be stretched or shortened accordingly. Therefore, the elastic component 734 may further arranged between the coupling part 733 and the first link 723*c*. Of course, in other embodiments, an end of the coupling part 733 may also be connected with the first link 723*c*, and the other end of the coupling part 733 may be movably arranged inside the second link 724*a*. The elastic component 734 may also be arranged between the coupling part 733 and the second link 724*a*, and the elastic component 734 may be a spring or the like.

Figure 114:
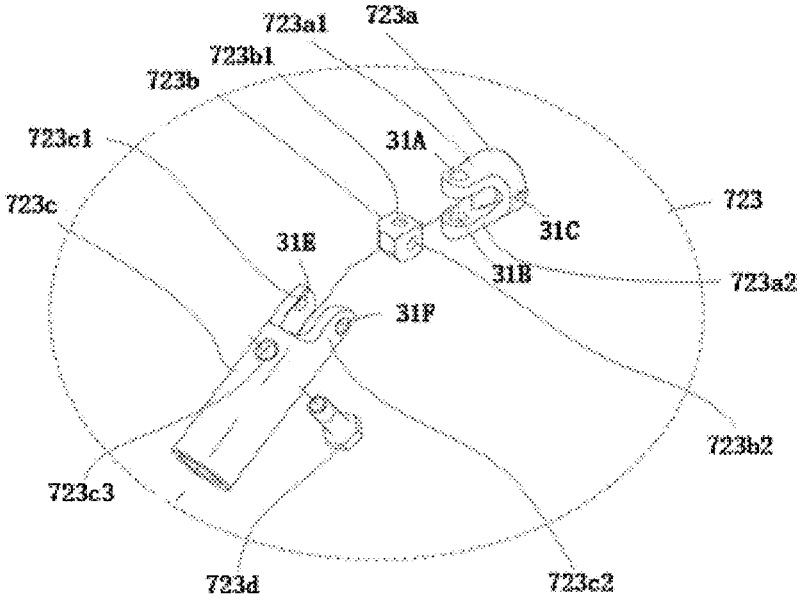
FIG. 114 is a schematic perspective exploded view of a first adapter assembly of the adjustment device according to an embodiment.

Please refer to FIG. 105 and FIG. 114. In an embodiment of the disclosure, the first adjustment assembly 723 may include a first mounting base 723*a*, a first adjustment component 723*b*, the first link 723*c*, and a limiting component 723*d*. The first mounting base 723*a* may be fixed on the third connecting component 732, and the first adjustment component 723*b* is rotatably arranged at a connection position between the first mounting base 723*a* and the first link 723*c*, so that the first mounting base 723*a* may rotate along the first adjustment component 723*b* by a certain angle, and the first link 723*c* may also rotate along the first adjustment component 723*b* by a certain angle. There is a certain angle between a plane on which a rotation direction of the first mounting base 723*a* is located and a plane on which a rotation direction of the first link 723*c* is located, and a specific size of the angle may not be limited. For example, in this embodiment, the angle may be 90 degrees, which means that the two planes are perpendicular to each other.

Please refer to FIG. 105 and FIG. 114. In an embodiment of the disclosure, the first mounting base 723*a* may be provided with a first fixed plate 723*a*1, a second fixed plate 723*a*2 and a fixed hole 31C, so that the first mounting base 723*a* may be fixed on the connecting assembly 722 through a matching of the fixed hole 31C with the fixed bolts, etc. The first fixed plate 723*a*1 and the second fixed plate 723*a*2 may be arranged opposite to an end of the first mounting base 723*a*, so that there is a gap between the first fixed plate 723*a*1 and the second fixed plate 723*a*2, and the first adjustment component 723*b* may be rotatably arranged in the gap. In order to facilitate a rotation of the first adjustment component 723*b*, the first fixed plate 723*a*1 may be provided with a first fixed hole 31A, the second fixed plate 723*a*2 may be provided with a second fixed hole 31B, and the first fixed hole 31A is arranged opposite to the second fixed hole 31B. The first adjustment component 723*b* may be symmetrically provided with first holes 723*b*1, so that the two first holes 723*b*1 may be matched with the first fixed holes 31A and the second fixed holes 31B respectively. The first fixed hole 31A may be fixed with one of the first holes 723*b*1 by a tightening screw, and the second fixed hole 31B may be fixed with the other first through hole 723*b*1 through the tightening screw, so that the first adjustment component 723*b* may be rotably arranged in the first mounting base 723*a*.

Please refer to FIG. 105 and FIG. 114. In an embodiment of the disclosure, the first link 723*c* may be provided with a third fixed plate 723*c*1, a fourth fixed plate 723*c*2, an opening hole 723*c*3 and the limiting component 301*d*. The third fixed plate 723*c*1 and the fourth fixed plate 723*c*2 may be arranged opposite to an end of the first link 723*c*, so that there is a gap between the third fixed plate 723*c*1 and the fourth fixed plate 723*c*2, and the first adjustment component 723*b* may be rotatably arranged in the gap. In order to facilitate the rotation of the first adjustment component 723*b*, the third fixed plate 723*c*1 may be provided with a third fixed hole 31E, the fourth fixed plate 723*c*2 may be provided with a fourth fixed hole 31F, and the third fixed hole 31E is arranged opposite to the fourth fixed hole 31F. Second holes 723*b*2 can be symmetrically arranged on the first adjustment component 723*b*, so that the two second holes 723*b*2 may be respectively matched with the third fixed hole 31E and the fourth fixed hole 31F. The third fixed hole 31E may be fixed with one of the second holes 723*b*2 by the tightening screw, and the fourth fixed hole 31F may be fixed with the other second hole 723*b*2 through the tightening screw, so that the first adjustment component 723*b* may be rotably arranged in the first link 723*c*. In order to be able to adjust a position of the elastic component 734 in the first link 723*c* to meet requirements of different conditions, the opening hole 723*c*3 may be arranged on the first link 723*c*. At least one opening hole 723*c*3 is arranged, and the opening hole 723*c*3 may be matched with the limiting component 301*d* to limit a specific position of the elastic component 734. The limiting component 301*d* may be a bolt or the like.

Please refer to FIG. 105 and FIG. 114. In an embodiment of the disclosure, the second adjustment assembly 724 may include the second link 724*a*, a second adjustment component 724*b*, and a second mounting base 724*c*. The second mounting base 724*c* may be fixed on the second connecting rod 726. The second adjustment component 724*b* is rotatably arranged at a connection position between the second mounting base 724*c* and the second link 724*a*, so that the second mounting base 724*c* may rotate along the second adjustment component 724*b* by a certain angle, and the second link 724*a* may rotate along the second adjustment component 724*b* by a certain angle. There is a certain angle between a plane on which a rotation direction of the second link 724*a* is located and a plane on which a rotation direction of the second mounting base 724*c* is located, and a specific size of the angle may not be limited. For example, in this embodiment, the angle may be 90 degrees, which means that the two planes are perpendicular to each other.

Figure 115:
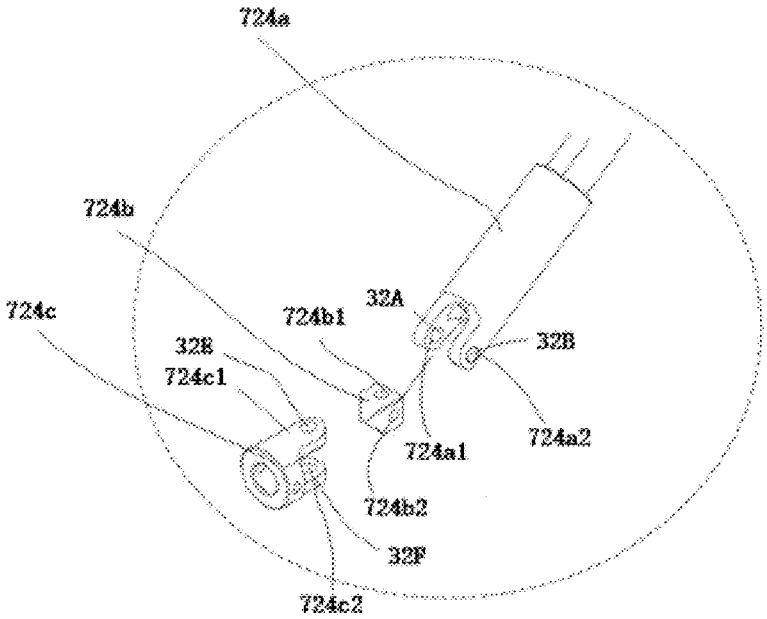
FIG. 115 is a schematic perspective exploded view of a second adapter assembly of the adjustment device according to an embodiment.

Please refer to FIG. 105 and FIG. 115. In an embodiment of the disclosure, a third side plate 724*c*1 and a fourth side plate 724*c*2 may be arranged on the second mounting base

724*c*. The third side plate 724*c*1 and the fourth side plate 724*c*2 may be arranged opposite to an end of the second mounting base 724*c*, so that there is a gap between the third side plate 724*c*1 and the fourth side plate 724*c*2, and the second adjustment component 724*b* may be rotably arranged in the gap. In order to facilitate a rotation of the second adjustment component 724*b*, the third side plate 724*c*1 may be provided with a third opening hole 32E, the fourth side plate 724*c*2 may be provided with a fourth opening hole 32F, the third opening hole 32E and the fourth opening hole 32F are arranged opposite to each other. Third holes 724*b*1 may be symmetrically arranged on the second adjustment component 724*b*, so that the two third holes 724*b*1 may be matched with the third opening hole 32E and the fourth opening hole 32F respectively. The third opening hole 32E may be fixed with one of the third through holes 724*b*1 by the tightening screw, and the fourth opening hole 32F may be fixed with the other third hole 724*b*1 through the tightening screw, so that the second adjustment component 724*b* may be rotably arranged in the second mounting base 724*c*.

Please refer to FIG. 105 and FIG. 115. In an embodiment of the disclosure, a first side plate 724*a*1 and a second side plate 724*a*2 may be arranged on the second link 724*a*. The first side plate 724*a*1 and the second side plate 724*a*2 may be arranged opposite to a side of the second link 724*a*, so that there is a gap between the first side plate 724*a*1 and the second side plate 724*a*2, and the second adjustment component 724*b* may be rotatably arranged in the gap. In order to facilitate the rotation of the second adjustment component 724*b*, the first side plate 724*a*1 may be provided with a first opening hole 32A, the second side plate 724*a*2 may be provided with a second opening hole 32B, the first opening hole 32A and the second opening hole 32B are arranged opposite to each other. Fourth holes 724*b*2 may be symmetrically arranged on the first adjustment component 723*b*, so that the two fourth holes 724*b*2 may be matched with the first opening hole 32A and the second opening hole 32B respectively. The first opening hole 32A may be fixed with one of the fourth through holes 724*b*2 by the tightening screw, and the second opening hole 32B may be fixed with the other fourth through hole 724*b*2 through the tightening screw, so that the second adjustment component 724*b* may be rotably arranged in the second link 724*a*.

Figure 108:
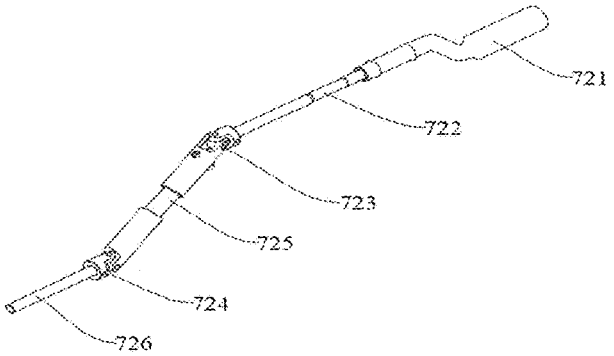
FIG. 108 is another schematic perspective view of the adjustment device according to an embodiment.
Figure 109:
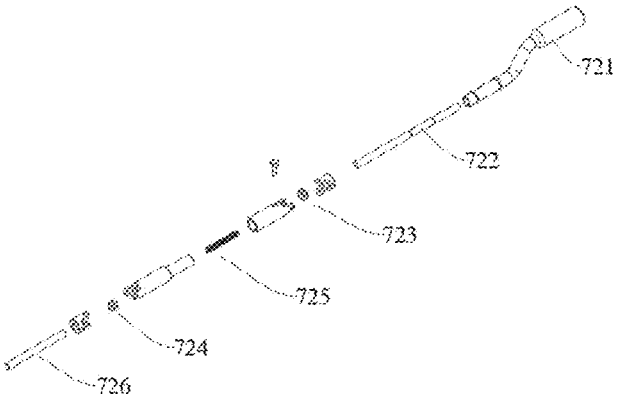
FIG. 109 is an exploded view of FIG. 108 according to an embodiment.
Figure 110:
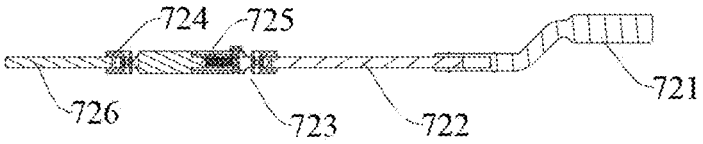
FIG. 110 is a cross-sectional view of FIG. 108 according to an embodiment.

Please refer to FIG. 105 and FIG. 108. In an embodiment of the disclosure, through arranging the first adjustment assembly 723, the connecting assembly 722 may rotate in a direction along the first adjustment component 723*b*. The first connecting rod 725 may rotate in another direction along the first adjustment component 723*b*, and planes on which the two directions are located may have a certain angle. For example, in this embodiment, the two planes may be perpendicular to each other. Through arranging the second adjustment assembly 724, the first connecting rod 725 may rotate in a direction along the second adjustment component 724*b*. The second connecting rod may rotate in another direction along the second adjustment component 724*b*, and planes on which the two directions are located may have a certain angle. For example, in this embodiment, the two planes may be perpendicular to each other. Therefore, through a matching of the first adjustment assembly 723 with the second adjustment assembly 724, the adjustment device may rotate in multiple directions as a whole, which may avoid conditions such as jamming or sticking.

Please refer to FIG. 105, FIG. 108 through FIG. 110. In an embodiment of the disclosure, in an initial state, a height of the control assembly 60 is equivalent to a height of the transmission structure 710 connected with the impeller assembly 20. At this time, the handle 727 is in an initial position. However, when a height of the user is relatively high and the user is turning the handle 727, the user often needs to adjust his own height by half-squatting, which is complicated to operate, and cause a certain safety hazard. At this time, the height of the control assembly 60 may be adjusted upwardly, so that the operation part 721 will also be adjusted upwards, and the first connecting rod 725 will extend outward by a certain length, which means that the coupling part 733 may protrude from an inside of the first link 723*c*1. At this time, a height of the first adjustment assembly 723 is substantially the same as that of the control assembly 60, a height of the second adjustment assembly 724 is substantially the same as the height of the transmission structure 710, and the height of the first adjustment assembly 723 is higher than the height of the second adjustment assembly 724, so that a height of the handle 727 can be rotated and matched with the user, and there is no abnormal sound and loosening phenomenon when rotating.

Please refer to FIG. 105, FIG. 108 through FIG. 110. In an embodiment of the disclosure, when the user is short and is turning the handle 727, a hand coordination is more troublesome, and the operation is more complicated, which causes a certain safety hazard. At this time, the height of the control assembly 60 may be adjusted downwardly, so that the operation part 721 will also be adjusted downwardly, and the first connecting rod 725 may be retracted inward by a certain length, which means that the coupling part 733 may be retracted toward the inside the first link 723*c*1. At this time, the height of the first adjustment assembly 723 is substantially the same as that of the control assembly 60, the height of the second adjustment assembly 724 is substantially the same as the height of the transmission structure 710, and the height of the first adjustment assembly 723 is lower than the height of the second adjustment assembly 724, so that at this time, the height of the handle 727 can be rotated and matched with the user, and there is no abnormal sound and loosening phenomenon when rotating.

The disclosure provides the snow thrower. Through using belts or chains for connection, a wear between components is reduced, there is no transmission gap, and the cost is low. Through arranging the first motor on the impeller housing, a larger accommodating space may be provided for the battery assembly. Through setting the chute control assembly, the snow blowing direction of the snow thrower may be adjusted, and the snow throwing direction of the impeller housing may be controlled simply and directly. Through arranging multiple assemblies on each side of the wheel, a center of the snow thrower may be stabilized above the wheel. With the snow thrower provided by the disclosure, a snow removal is more flexible and convenient, and the cost is reduced.

Figure 116:
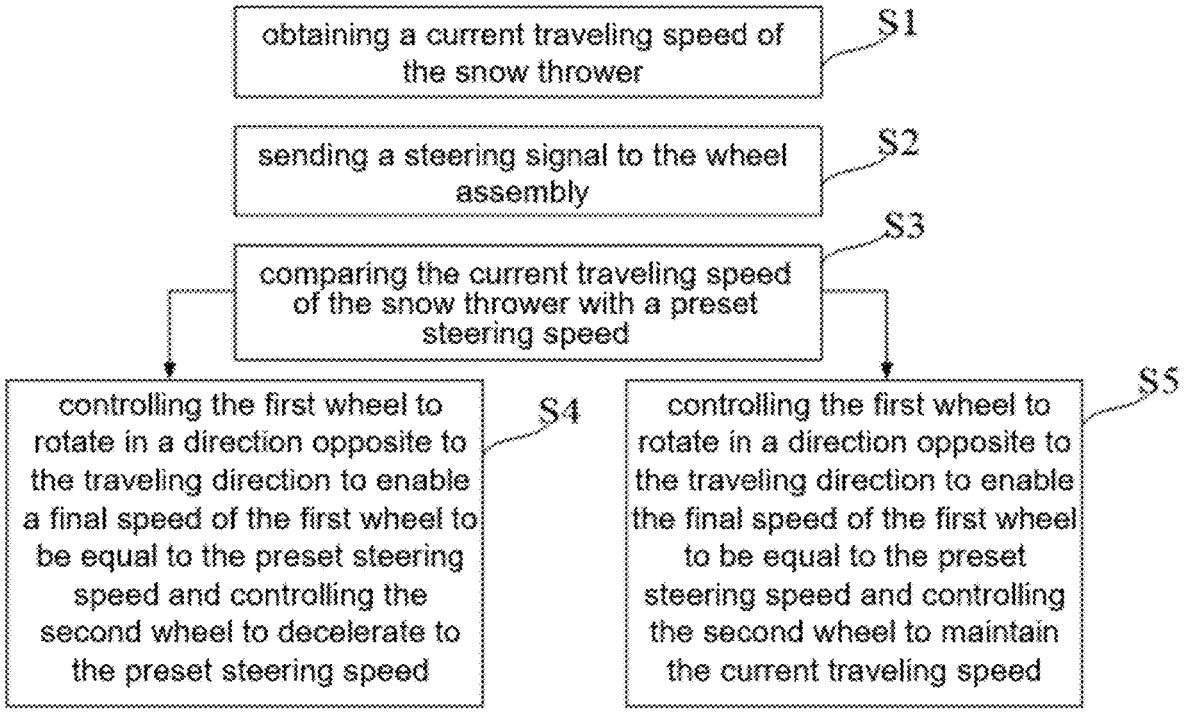
FIG. 116 is a flowchart of a steering direction of the snow thrower of the disclosure according to an embodiment.
Figure 117:
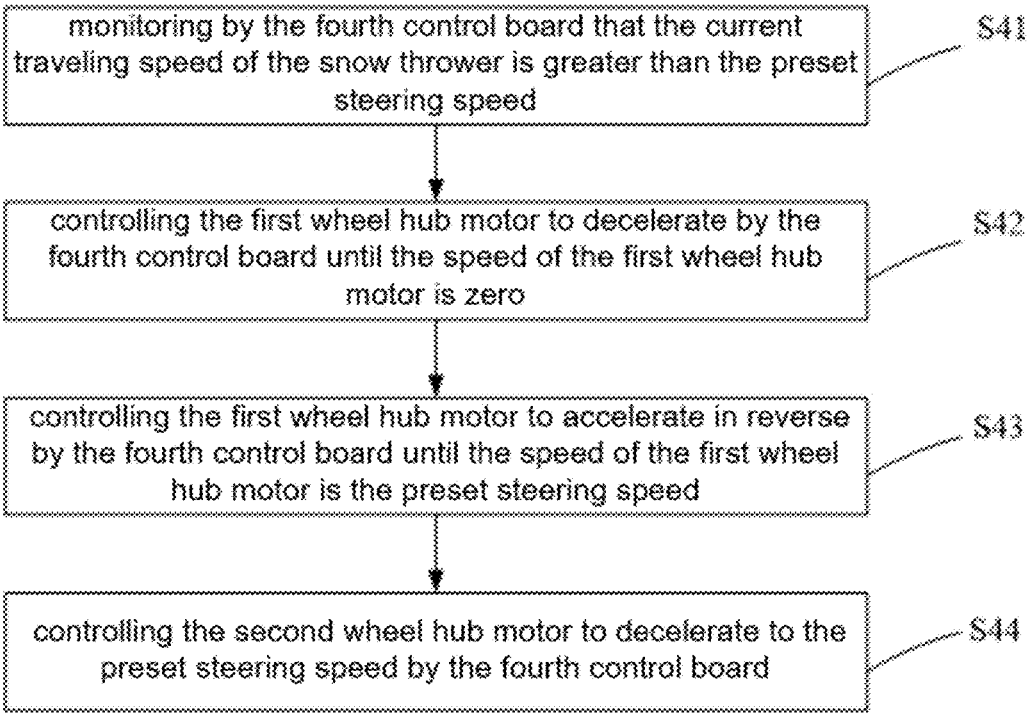
FIG. 117 is a flowchart of operation S4 of the disclosure according to an embodiment.

Please refer to FIG. 116. The disclosure provides a steering method of the snow thrower. The steering method includes:

- S1: obtaining a current traveling speed of the snow thrower,
- S2: sending a steering signal to the wheel assembly,
- S3: comparing the current traveling speed of the snow thrower with a preset steering speed,
- S4: controlling the first wheel to rotate in a direction opposite to the traveling direction so that a final speed of the first wheel is substantially equal to the preset steering speed and controlling the second wheel to decelerate to the preset steering speed, if the current traveling speed of the snow thrower is greater than the preset steering speed, and S5: controlling the first wheel to rotate in a direction opposite to the traveling direction if the current traveling speed of the snow thrower is equal to the preset steering speed to enable the final speed of the first wheel to be substantially equal to the preset steering speed and keep a speed of the second wheel.

Please refer to FIG. 51, FIG. 73, FIG. 74 and FIG. 116. In S1, when the snow thrower 1 is in a process of snow removal, the first speed adjustment lever 614*a* may be toggled. The first speed adjustment lever 614*a* is connected with the fourth control board 904*a* (traveling control board). The fourth control board 904*a* adjusts rotation speeds of the first wheel hub motor 501*a* and the second wheel hub motor 501*b*, thereby adjusting rotation speeds of the first wheel 500*a* and the second wheel 500*b*, which means that the traveling speed of the snow thrower 1 may be adjusted. In this embodiment, the traveling speed of the snow thrower 1 may be from 20 rpm to 80 rpm, for example, 20 rpm, 23 rpm, 25 rpm, 37 rpm, and 50 rpm, 60 rpm or 80 rpm. In this embodiment, the snow thrower 1 may include multiple forward gears, for example, four forward gears. Each time the first speed adjustment lever 614*a* is toggled, the traveling speed of the snow thrower 1 may be adjusted once, so the current traveling speed of the snow thrower 1 may be obtained. Of course, when the first speed adjustment lever 614*a* is toggled, the first speed adjustment lever 614*a* sends a speed adjustment signal to the fourth control board 904*a*, and the fourth control board 904*a* may adjust the speeds of the first wheel hub motor 501*a* or the second wheel hub motor 501*b*, so the current traveling speed of the snow thrower 1 may be obtained through the fourth control board 904*a*. Of course, the snow thrower 1 may also move backward by toggling the first speed adjustment lever 614*a*. A backward speed of the snow thrower 1 is, for example, from 20 rpm to 25 rpm, such as 20 rpm, 23 rpm or 25 rpm. In this embodiment, the speed of the first wheel hub motor 501*a* or the second wheel hub motor 501*a* may be monitored through the fourth control board 904*a*, so as to monitor the current traveling speed of the snow thrower 1, or the current traveling speed of the snow thrower 1 may be obtained through monitoring the gear in which the first speed adjustment lever 614*a* is located.

Please refer to FIG. 51, FIG. 73, FIG. 74, FIG. 116 through FIG. 118. In S2 and S3, when the snow thrower 1 needs to be steered, the steering signal may be sent to the wheel assembly 50, and the wheel assembly 50 will execute a corresponding steering after receiving the steering signal. In this embodiment, the first pressing structure 626 (first steering handle) or the second pressing structure 627 (second steering handle) may be pressed to send the steering signal to the wheel assembly 50. In this embodiment, a control of the snow thrower 1 to steer to the left is taken as an example for description. The first pressing structure 626 enables the wheel assembly 50 to receive a signal to steer to a first direction, which means that the first pressing structure 626 may enable the snow thrower 1 to steer to the left (the first direction). The second pressing structure 627 enables the wheel assembly 50 to receive a signal to steer to a second direction, which means that the second pressing structure 627 may enable the snow thrower 1 to steer to the right (the second direction). In this embodiment, principles of the steering of the snow thrower 1 to the first direction or the second direction are the same. After pressing the first pressing structure 626, the first pressing structure 626 sends the steering signal to the fourth control board 904*a*, and the fourth control board 904*a* controls the first wheel hub motor 501*a* and the second wheel hub motor 501*b* to steer. If the snow thrower 1 steers at an excessively low speed, an entire steering process will be too slow. If the snow thrower 1 steers at an excessive speed, a large centrifugal force will be generated, which causes a discomfort to the user. Therefore, in order to improve the operator's comfort when controlling the snow thrower 1 to steer, the snow thrower 1 of this embodiment is set with the preset steering speed, so that the snow thrower 1 may steer within a better speed range. After the wheel assembly 50 receives the steering signal, the fourth control board 904*a* compares a relationship between the current traveling speed of the snow thrower 1 and the preset steering speed.

Please refer to FIG. 51, FIG. 73, FIG. 74, FIG. 116 and FIG. 117. When the current traveling speed of the snow thrower 1 is greater than the preset steering speed, the S4 will be executed. The S4 includes:

S41: monitoring by the fourth control board that the current traveling speed of the snow thrower is greater than the preset steering speed, S42: controlling the first wheel hub motor to decelerate by the fourth control board until the speed of the first wheel hub motor is zero, S43: controlling the first wheel hub motor to accelerate in reverse by the fourth control board until the speed of the first wheel hub motor is the preset steering speed, and S44: controlling the second wheel hub motor to decelerate to the preset steering speed by the fourth control board.

Please refer to FIG. 51, FIG. 73, FIG. 74, FIG. 117, FIG. 121 and FIG. 122. In S41 through S44, first, the current traveling speed of the snow thrower 1 is monitored through the fourth control board 904*a*. When the fourth control board 904*a* monitors that the current traveling speed of the snow thrower 1 is greater than the preset steering speed, the fourth control board 904*a* controls the first wheel hub motor 501*a* to decelerate until the speed of the first wheel hub motor 501*a* is zero. Then the fourth control board 904*a* controls the first wheel hub motor 501*a* to reversely accelerate, so that the speed of the first wheel hub motor 501*a* increases until the speed of the first wheel hub motor 501*a* reaches the preset steering speed, and then the first wheel hub motor 501*a* is then allowed to maintain this speed. Then the fourth control board 904*a* controls the second wheel hub motor 501*b* to decelerate until the speed of the second wheel hub motor 501*b* is equal to the preset steering speed and a traveling direction of the second wheel hub motor 501*b* is then allowed to be maintained. Since the first wheel hub motor 501*a* and the second wheel hub motor 501*b* have the same speed and opposite traveling directions, the first wheel 500*a* and the second wheel 500*b* rotate around a center point of the connecting line between the first wheel 500*a* and the second wheel 500*b*, so a steering radius of this snow thrower may be zero. In this embodiment, the first wheel 500*a* and the second wheel 500*b* may reach the preset steering speed at the same time, so a deceleration speed of the first wheel 500*a* is greater than a deceleration speed of the second wheel 500*b*. Of course, the first wheel 500*a* may also reach the preset steering speed first, and then the second wheel 500*b* reaches the preset steering speed. A time difference between the first wheel 500*a* and the second wheel 500*b* reaching the preset steering speed may be very short, for example, less than 1 second. Of course, in some embodiments, final speeds of the first wheel 500*a* and the second wheel 500*b* are different. For example, the final speed of the first wheel 500*a* is less than the final speed of the second wheel 500*b*, then the steering radius of the snow thrower 1 is not equal to zero. Of course, since a difference between the two speeds is very small, the steering radius of the snow thrower 1 is also very small, and the snow thrower 1 may be turned in a narrow area.

Figure 118:
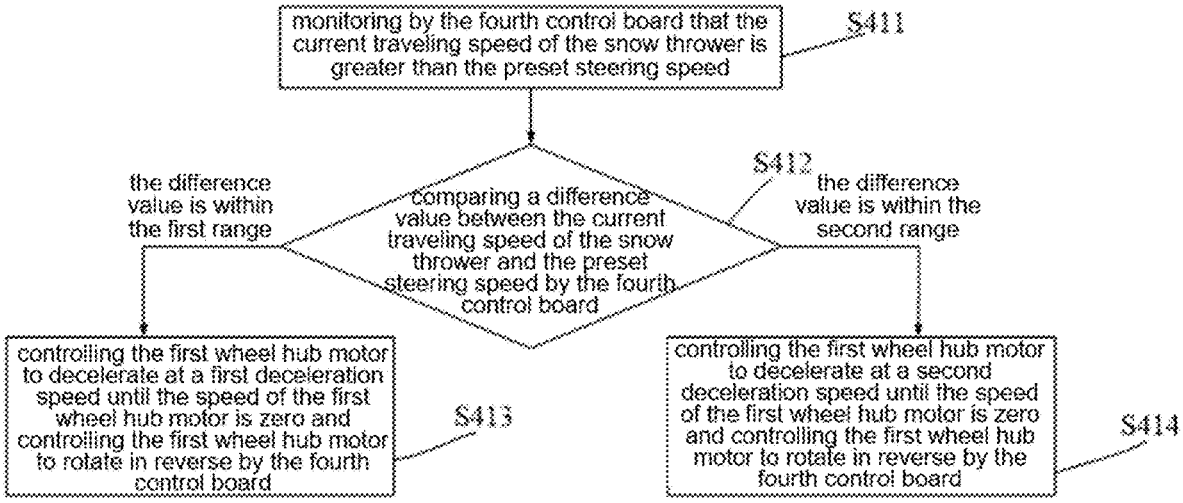
FIG. 118 is another flowchart of the operation S4 of the disclosure according to an embodiment.
Figure 119:
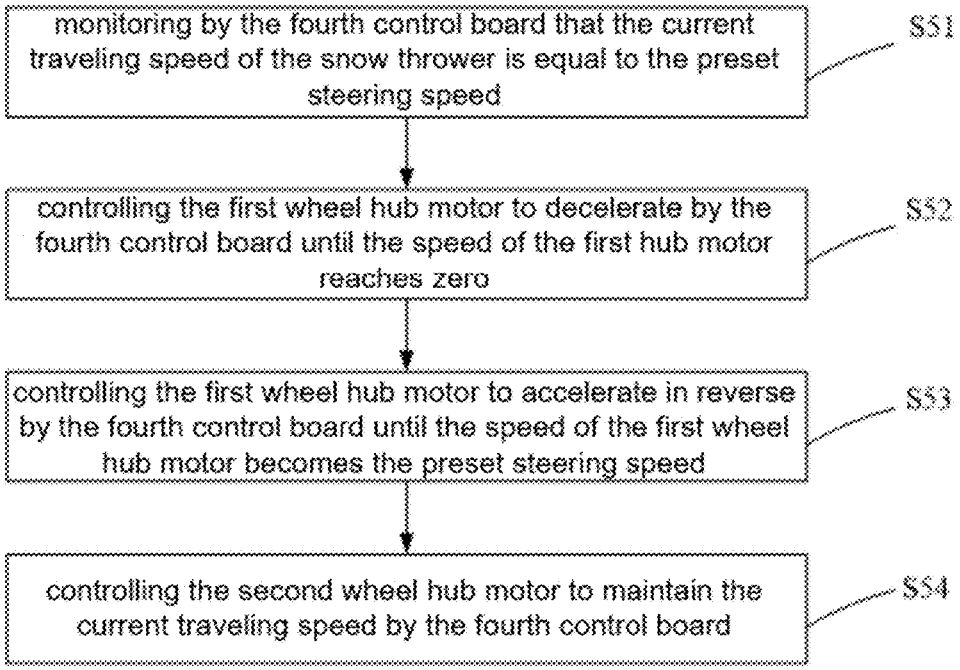
Figure 120:
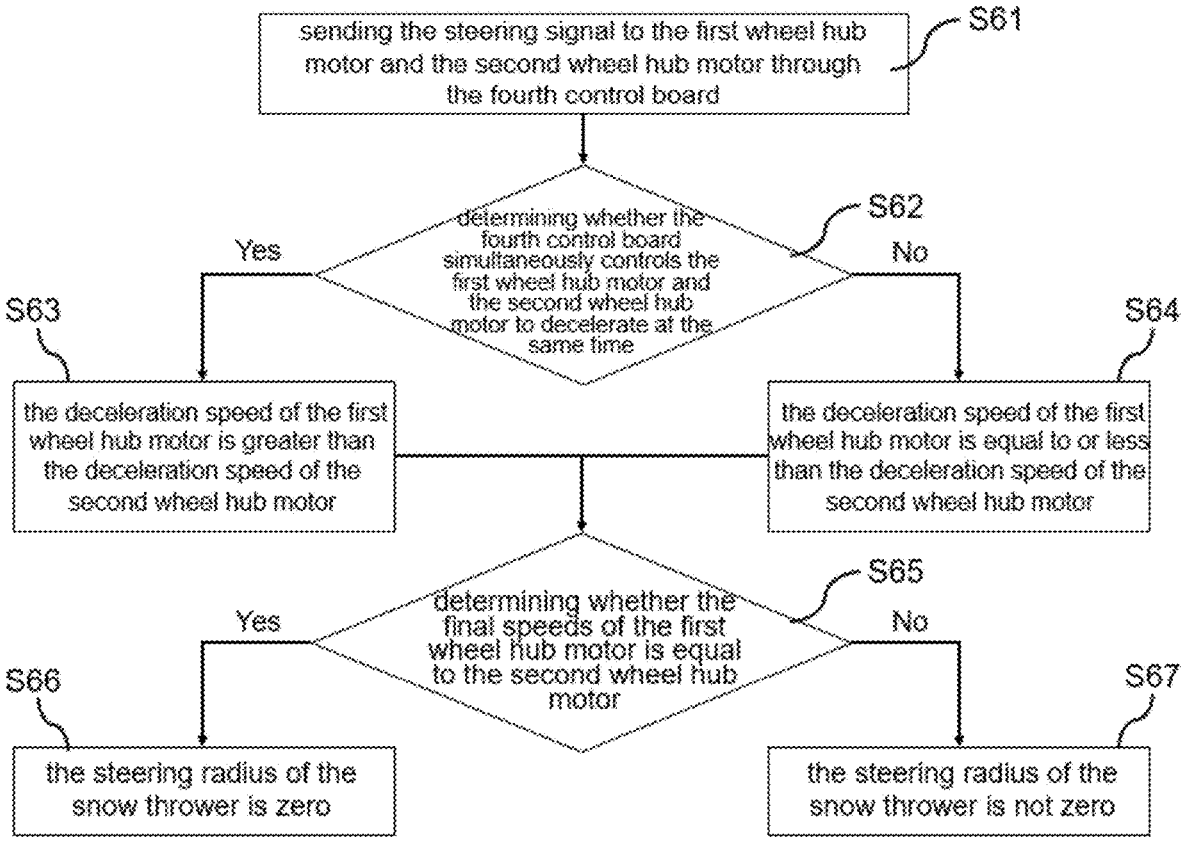

Please refer to FIG. 118. In this embodiment, the fourth control board 904*a* further controls the first wheel hub motor 501*a* to decelerate at different deceleration speed rates, for example the control method includes:

S411: monitoring by the fourth control board 904*a* that the current traveling speed of the snow thrower is greater than the preset steering speed, S412: comparing a difference value between the current traveling speed of the snow thrower and the preset steering speed by the fourth control board 904*a*, S413: controlling the first wheel hub motor to decelerate at a first deceleration speed until the speed of the first wheel hub motor is zero and controlling the first wheel hub motor to rotate in reverse by the fourth control board 904*a* if the difference is within a first range, and S414: controlling the first wheel hub motor to decelerate at a second deceleration speed until the speed of the first wheel hub motor is zero and controlling the first wheel hub motor to rotate in reverse by the fourth control board 904*a* if the difference is within a second range.

Please refer to FIG. 51, FIG. 73, FIG. 74, FIG. 118, FIG. 121 and FIG. 122. In S411 to S414, when the fourth control board 904*a* monitors that the current traveling speed of the snow thrower 1 is greater than the preset steering speed, the fourth control board 904*a* compares a difference between the current traveling speed of the snow thrower 1 and the preset steering speed. When the difference between the current traveling speed of the snow thrower 1 and the preset steering speed is within the first range, the fourth control board 904*a* controls the first wheel hub motor 501*a* to decelerate at the first deceleration speed until the speed of the first wheel hub motor 501*a* reaches zero. Then the fourth control board 904*a* controls the first wheel hub motor 501*a* to rotate in reverse, and controls the first wheel hub motor 501*a* to reversely accelerate, so that the speed of the first wheel hub motor 501*a* becomes the preset steering speed. The first range is, for example, from 10 rpm to 20 rpm. When the difference between the current traveling speed of the snow thrower 1 and the preset steering speed is within the second range, the fourth control board 904*a* controls the first wheel hub motor 501*a* to decelerate at the second deceleration speed until the speed of the first wheel hub motor 501*a* reaches zero. Then the fourth control board 904*a* controls the first wheel hub motor 501*a* to reversely rotate, so that the speed of the first wheel hub motor 501*a* becomes the preset steering speed. The second range is, for example, from 20 rpm to 40 rpm. In this embodiment, the first range is less than the second range, so the first deceleration speed is less than the second deceleration speed. Of course, when the first range is greater than the second range, the first deceleration speed is greater than the second deceleration speed. That is to say, when the difference between the traveling speed of the snow thrower 1 and the preset steering speed is larger, the deceleration speed of the first wheel hub motor 501*a* is also larger. It should be noted that, in S3, the fourth control board 904*a* further controls the second wheel hub motor 501*b* to decelerate until the speed of the second wheel hub motor 501*b* is equal to the preset steering speed, and maintains the traveling direction of the second wheel hub motor 501*b*. Since the speeds of the first wheel hub motor 501*a* and the second wheel hub motor 501*b* are finally the same, the deceleration speed of the first wheel hub motor 501*a* is greater than the deceleration speed of the second wheel hub motor 501*b*. The fourth control board 904*a* may control the deceleration speeds of the first wheel hub motor 501*a* and the second wheel hub motor 501*b* at the same time, and may also decelerate the first wheel hub motor 501*a* first and then decelerate the second wheel hub motor 501*b*. In this embodiment, the preset steering speed is, for example, from 10 rpm to 20 rpm, such as 10 rpm, 15 rpm or 20 rpm.

Please refer to FIG. 51, FIG. 73, FIG. 74, FIG. 116 and FIG. 119. If the traveling speed of the snow thrower 1 is equal to the preset steering speed, then execute to S5. The S5 includes:

S51: monitoring by the fourth control board that the current traveling speed of the snow thrower is equal to the preset steering speed, S52: controlling the first wheel hub motor to decelerate by the fourth control board until the speed of the first hub motor reaches zero, S53: controlling the first wheel hub motor to accelerate in reverse by the fourth control board until the speed of the first wheel hub motor becomes the preset steering speed, and S54: controlling the second wheel hub motor to maintain the current traveling speed by the fourth control board.

Please refer to FIG. 51, FIG. 73, FIG. 74, FIG. 116 and FIG. 119. A process of controlling the first wheel hub motor 501*a* by the fourth control board 904*a* may refer to S42 and S43. When the fourth control board 904*a* controls a steering of the second wheel 500*b*, the speed of the second wheel hub motor 501*a* is maintained, and a traveling direction of the second wheel 500*b* is also maintained. Since finally the first wheel hub motor 501*a* and the second wheel hub motor 501*b* have the same speed and opposite traveling directions, the steering of the first wheel hub motor 501*a* and the second wheel hub motor 501*b* may be realized, which realizes the steering of the snow thrower 1.

Please refer to FIG. 51, FIG. 73, FIG. 74 and FIG. 120. In this embodiment, a process of the fourth control board 904*a* controlling the steering of the first wheel 500*a* and the second wheel 500*b* may further include:

S61: sending the steering signal to the first wheel hub motor 501*a* and the second wheel hub motor 501*b* through the fourth control board 904*a*, S62: determining whether the fourth control board 904*a* simultaneously controls the first wheel hub motor 500*a* and the second wheel hub motor 500*b* to decelerate at the same time, S63: if yes, controlling the deceleration speed of the first wheel hub motor 501*a* greater than the deceleration speed of the second wheel hub motor 502*a*. Since the deceleration speed of the first wheel hub motor 501*a* is greater than the deceleration speed of the second wheel hub motor 502*a*, the final speed of the first wheel hub motor 501*a* may be equal to the final speed of the second wheel hub motor 501*b*, and both of them reach the final speed at the same time.

S64: if no, controlling the deceleration speed of the first wheel hub motor 501*a* equal to or less than the deceleration speed of the second wheel hub motor 502*a*. For example, the first wheel hub motor 501*a* decelerates first, so the deceleration speed of the first wheel hub motor 501*a* may be equal to or less than the deceleration speed of the second wheel hub motor 502*a*, so that both may reach the final speed at the same time.

S65: comparing whether the final speeds of the first wheel hub motor 501*a* and the second wheel hub motor 502*a* are the same when both of them reach their final speeds, S66: if yes, obtaining a result that the final speed of the first wheel hub motor 501*a* is the same as the final speed of the second wheel hub motor 501*b*, for example, if both are equal to the preset steering speed, the steering radius of the snow thrower 1 is zero, and S67: if no, obtaining a result that the final speed of the first wheel hub motor 501*a* is not equal to the final speed of the second wheel hub motor 501*b*, for example, the final speed of the first wheel hub motor 501*a* is less than the final speed of the second wheel hub motor 501*b*, so the steering radius of the snow thrower 1 is not zero.

Please refer to FIG. 51, FIG. 73, FIG. 74, FIG. 121 and FIG. 122. In some embodiments, when the current traveling speed of the snow thrower 1 is less than the preset steering speed, the fourth control board 904*a* controls the first wheel hub motor 501*a* to decelerate until the speed of the first wheel hub motor 501*a* reaches zero. Then the first wheel hub motor 501*a* is accelerated in a reverse direction, so that the speed of the first wheel hub motor 501*a* is equal to the speed of the second wheel hub motor 502*a*. The fourth control board 904*a* maintains the current speed of the second wheel hub motor 502*a*. Since the first wheel 500*a* and the second wheel 500*b* have the same speed and opposite traveling directions, the first wheel 500*a* and the second wheel 500*b* may rotate around the center point of the connecting line between the first wheel 500*a* and the second wheel 500*b*, thereby achieving the steering of snow thrower 1. Of course, in other embodiments, when the current traveling speed of the snow thrower 1 is less than the preset steering speed, the fourth control board 904*a* may further control the second wheel hub motor 502*a* to accelerate, and control the first wheel hub motor 501*a* to rotate in the reverse direction until the speed of the first wheel hub motor 501*a* is the same as the speed of the second wheel hub motor 502*a*, which means that both are preset steering speeds.

Figure 121:
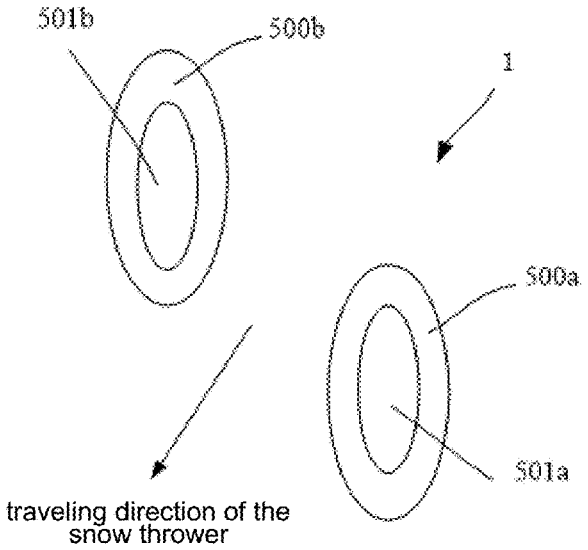
Figure 122:
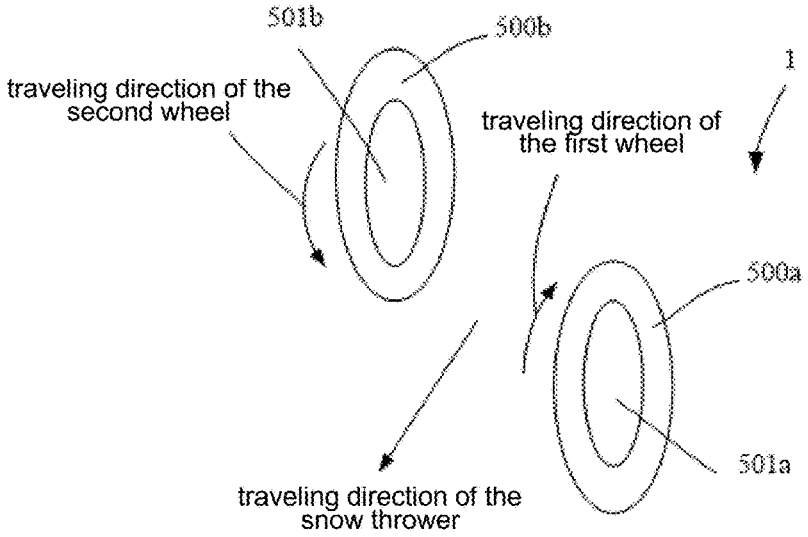
Figure 123:
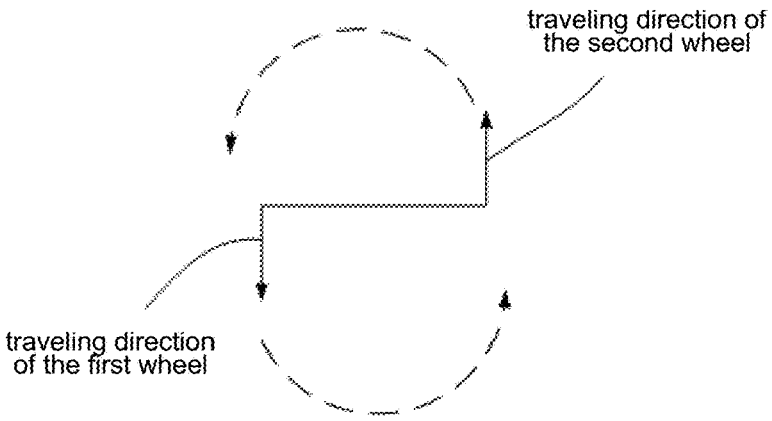

Please refer to FIG. 121 through FIG. 123. When the snow thrower 1 is steering, the traveling direction of the first wheel 500*a* is opposite to the traveling direction of the second wheel 500*b*, the speeds of the second wheel 500*b* and the first wheel 500*a* are the same, so the first wheel 500*a* and the second wheel 500*b* will define approximate moments, so that the first wheel 500*a* and the second wheel 500*b* will rotate around the center point of the connecting line between the first wheel 500*a* and the second wheel 500*b*, which means that the steering radius of the first wheel 500*a* and the second wheel 500*b* is zero, therefore, the snow thrower 1 may steer in a narrow area, and the operation is simple. Dashed arrows in the FIG. 123 may represent the steering directions of the first wheel 500*a* and the second wheel 500*b*, respectively. It should be noted that, when the snow thrower 1 is in the backward direction, the steering of the snow thrower 1 during a backward process may be referred to the above description, which will not be described in this embodiment.

In summary, the disclosure provides the snow thrower and the steering method thereof. The snow thrower may include the wheel assembly, the traveling control board and the steering handle. The wheel assembly includes the first wheel and the second wheel. When the snow thrower is steering, first the current traveling speed of the snow thrower is obtained, then the steering handle is pressed to send the steering signal to the traveling control board, and the traveling control board sends the steering signal to the wheel assembly and compares the current traveling speed of the snow thrower with the preset steering speed. When the current traveling speed of the snow thrower is greater than the preset steering speed, the traveling control board controls the first wheel to decelerate. When the speed of the first wheel is zero, the traveling control board controls the first wheel to rotate in the reverse direction, and accelerates the first wheel to the preset steering speed. The traveling control board further controls the second wheel to decelerate to the preset steering speed. The speeds of the first wheel and the second wheel reach the preset steering speed at the same time, and the steering direction of the first wheel and the second wheel is opposite, so the snow thrower may rotate around a center point between the first wheel and the second wheel, which quickly realizes the steering of the snow thrower. The steering radius of the snow thrower is zero, so it may steer in a narrow area. The steering process of the snow thrower is simple and easy to operate, which saves the operator's physical strength.

In the description of this specification, a description with reference to the terms "this embodiment", "embodiment", "specific embodiment", etc. means that a specific feature, structure, material or characteristic described in connection with this embodiment or example is included in at least one embodiment or example of the disclosure. In this specification, schematic representations of the above terms do not necessarily refer to the same embodiment or example. Furthermore, the particular features, structures, materials or characteristics described may be combined in any suitable manner in any one or more embodiments or examples.

The embodiments of the disclosure described above are only used to help illustrate the disclosure. The embodiments do not exhaustively describe all the details, nor do they limit the disclosure to the specific embodiments described. Obviously, many modifications and variations are possible according to this specification. The embodiments are specifically described in the specification in order to better explain the principles and practical applications of the disclosure, so that those skilled in the art can well understand and utilize the disclosure. The disclosure is limited only by the claims and their full scope and equivalents.

What is claimed is:

1. A snow thrower, comprising:

a chassis, a wheel assembly, coupled to the chassis at a rear of the snow thrower, and configured to support the snow thrower to enable the snow thrower to walk on a surface, the wheel assembly comprising wheels, a working assembly, coupled to the chassis, the working assembly comprising an auger assembly and an impeller assembly, the auger assembly comprising an auger and an auger housing at least partially accommodating the auger, the impeller assembly comprising an impeller and an impeller housing at least partially accommodating the impeller, a power assembly, comprising a motor, the motor being coupled to the impeller housing and configured to drive the working assembly to work, and a battery assembly, configured to supply power to the power assembly and the wheel assembly, the battery assembly comprising at least one battery;

wherein, the motor is mounted on an upper portion of the impeller housing, and an output shaft of the motor is oriented facing the rear of the snow thrower.

2. The snow thrower according to claim 1, further comprising:

a first rotation shaft, connected with the auger housing, and the auger being connected on the first rotation shaft, and a second rotation shaft, connected with the first rotation shaft, and the impeller being connected on the second rotation shaft.

3. The snow thrower according to claim 2, further comprising a fan, wherein the fan is connected with the second rotation shaft, and the fan is located in the chassis.

4. The snow thrower according to claim 2, further comprising:

a worm gear, sleeved on the first rotation shaft, and the second rotation shaft being meshed with the worm gear, and a worm gear housing, provided with a first penetrating hole and a second penetrating hole, the worm gear being located in the first penetrating hole, one end of the second rotation shaft being located in the second penetrating hole, and the worm gear being meshed to the second rotation shaft in the worm gear housing.

5. The snow thrower according to claim 2, wherein the motor is connected with the working assembly through a transmission assembly, the transmission assembly comprises:

a first transmission wheel, arranged on an output shaft of the motor, a second transmission wheel, connected with the second rotation shaft to drive the second rotation shaft to rotate, and a belt or a chain, configured to connect the first transmission wheel with the second transmission wheel.

6. The snow thrower according to claim 5, further comprising a tensioning structure to tension the belt, wherein the tensioning structure comprises:

a mounting plate, connected with the impeller housing, a tensioning plate, connected on the mounting plate, a tensioning wheel, arranged on the tensioning plate, a first tensioning spring, one end of the first tensioning spring being connected with the tensioning plate, and the other end of the first tensioning spring being connected with a fixed base of the motor, a ratchet wheel, arranged on the tensioning plate, a ratchet pawl, arranged on the mounting plate, and a second tensioning spring, arranged on the mounting plate, one end of the ratchet pawl being matched with the ratchet wheel, and the other end of the ratchet pawl being connected with the second tensioning spring.

7. The snow thrower according to claim 1, wherein a movement gap is between the impeller and an inner side wall of the impeller housing, and the movement gap gradually increases along a rotation direction of the impeller.

8. The snow thrower according to claim 1, wherein a center of gravity of the battery assembly is located on a central axis in a forward direction of the snow thrower.

9. The snow thrower according to claim 1, wherein the wheel assembly further comprises:

a wheel hub motor, an output shaft of the wheel hub motor configured to be connected with the chassis, and the wheels configured to be coupled to the wheel hub motor, and a fixed part, arranged on the chassis, and the fixed part configured to be connected with the output shaft.

10. The snow thrower according to claim 9, wherein at least two wheel hub motors are provided, and each of the wheel hub motors is independently controlled.

11. The snow thrower according to claim 1, further comprising a control board assembly, wherein the control board assembly is fixed in the chassis, and configured to control the battery assembly, the power assembly and the wheel assembly.

12. The snow thrower according to claim 1, wherein the chassis comprises:

a connecting surface, connected with the working assembly, a fixed component, connected with the working assembly, the fixed component defining a gap with the connecting surface, and a main housing, clamped in the gap and connected with the connecting surface and the fixed component.

13. The snow thrower according to claim 1, further comprising a control assembly, wherein the control assembly comprises:

an operation console, a first speed adjustment lever, configured to adjust a traveling speed and/or traveling direction of the wheel assembly, and the first speed adjustment lever being arranged on the operation console, and a second speed adjustment lever, configured to adjust a running speed of the working assembly, and the second speed adjustment lever being arranged on the operation console, wherein the first speed adjustment lever is arranged at a first angle with a first direction, the second speed adjustment lever is arranged at a second angle with the first direction, and the first direction is a direction parallel to a rotation axis of the wheel assembly.

14. The snow thrower according to claim 13, wherein the control assembly comprises:

a first trigger, configured to realize a first function, a linkage shaft, connected with the first trigger, a second trigger, rotatably connected with the linkage shaft to realize a second function, and an interlocking structure, arranged on the linkage shaft and connected with the second trigger.

15. The snow thrower according to claim 13, wherein a display light is arranged on the operation console, and the display light comprises a flexible light bar.

16. The snow thrower according to claim 1, further comprising a chute control assembly, wherein the chute control assembly comprises:

a chute, a rotation component, one end of the rotation component being connected with the chute, a connecting shaft, connected with the rotation component, a second gear, connected with the connecting shaft to drive the connecting shaft to rotate, a first gear, meshed with the second gear, and a rocking trigger, one end of the rocking trigger being connected with the first gear, and the other end of the rocking trigger extending to an operation end of the snow thrower.

17. The snow thrower according to claim 1, further comprising an adjustment device, wherein the adjustment device comprises:

an operation part, a connecting assembly, one end of the connecting assembly being connected with one end of the operation part, a first connecting rod, one end of the first connecting rod being rotatably connected with the connecting assembly, and a second connecting rod, one end of the second connecting rod being rotatably connected with the first connecting rod.

18. The snow thrower according to claim 1, wherein the motor is connected with the working assembly through a transmission assembly, the transmission assembly comprises:

a transmission housing, and a sprocket assembly, mounted inside the transmission housing, the sprocket assembly being integral with the transmission housing, and the sprocket assembly comprises:

a driving sprocket, rotatably mounted with one end inside the transmission housing, and connected with the power assembly, a driven sprocket, rotatably mounted with the other end inside the transmission housing, and a chain, mounted around an outside of the driving sprocket and the driven sprocket and meshed with the driving sprocket and the driven sprocket, the driving sprocket being in a transmission connection with the driven sprocket through the chain.

19. A steering method of a snow thrower, the snow thrower comprising:

a chassis, a wheel assembly, coupled to the chassis at a rear of the snow thrower, the wheel assembly comprising a first wheel and a second wheel, a working assembly, coupled to the chassis, the working assembly comprising an auger assembly and an impeller assembly, the auger assembly comprising an auger and an auger housing at least partially accommodating the auger, the impeller assembly comprising an impeller and an impeller housing at least partially accommodating the impeller, and a power assembly, comprising a motor, the motor being coupled to the impeller housing and configured to drive the working assembly to work, and the motor being mounted on an upper portion of the impeller housing, an output shaft of the motor being oriented facing the rear of the snow thrower, and the steering method comprising:

obtaining a current traveling speed of the snow thrower, sending a steering signal to the wheel assembly, comparing the current traveling speed of the snow thrower with a preset steering speed, and controlling the first wheel to rotate in a direction opposite to the traveling direction, and controlling the second wheel to decelerate to the preset steering speed if the current traveling speed of the snow thrower is greater than the preset steering speed, and enabling a final speed of the first wheel to be equal to the preset steering speed.

* * * * *